US011957208B2

(12) United States Patent
Hatfield et al.

(10) Patent No.: US 11,957,208 B2
(45) **Date of Patent: *Apr. 16, 2024**

(54) SOLE STRUCTURES HAVING MULTIPLE HARDNESSES AND/OR FLEX PROMOTING STRUCTURES

(71) Applicant: NIKE, Inc., Beaverton, OR (US)

(72) Inventors: Tinker L. Hatfield, Portland, OR (US); Thomas G. Bell, Portland, OR (US); Rory S. Blanche, Portland, OR (US); Risha Dupre, Tigard, OR (US); Christopher Mellick, Portland, OR (US); Kaigin Olafson, Portland, OR (US); Andrew A. Owings, Portland, OR (US); Jeffrey C. Spanks, Portland, OR (US); Caitlin Vultaggio, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/145,488

(22) Filed: Dec. 22, 2022

(65) Prior Publication Data

US 2023/0123618 A1 Apr. 20, 2023

Related U.S. Application Data

(63) Continuation of application No. 17/145,777, filed on Jan. 11, 2021, now Pat. No. 11,553,758.
(Continued)

(51) Int. Cl.
*A43B 13/22* (2006.01)
*A43B 13/12* (2006.01)

(52) U.S. Cl.
CPC ..... *A43B 13/223* (2013.01); *A43B 13/122* (2013.01)

(58) Field of Classification Search
CPC ... A43B 13/223; A43B 13/122; A43B 13/141; A43B 5/12
See application file for complete search history.

(56) References Cited

U.S. PATENT DOCUMENTS 4,689,901 A 9/1987 Ihlenburg
4,759,136 A 7/1988 Stewart et al.
(Continued)

FOREIGN PATENT DOCUMENTS

CN 201782102 U 4/2011
CN 204599480 U 9/2015
(Continued)

OTHER PUBLICATIONS

Apr. 22, 2021—(WO) ISR—App. No. PCT/US21/012931.

*Primary Examiner* — Bao-Thieu L Nguyen
(74) *Attorney, Agent, or Firm* — Banner & Witcoff, Ltd.

(57) ABSTRACT

Footwear and sole structures include structures and properties, e.g., to support urban dance and urban dance moves. Such dance styles include various dance moves and movements that require contact between side edges of the wearer's shoes and the dance floor surface (e.g., made from concrete, asphalt, wood, etc.). Such dance styles also require transition of the body's center of mass along the edge(s) of the foot. Footwear and sole structures in accordance with this technology provide structures and properties to support to support such dance styles and moves, including one or more of: selected materials and/or selected material properties in various areas to promote sliding or gliding along various surfaces and/or other desired interactions with various surfaces; selected sizing and/or dimensional features of components in various areas; various flexion promoting structures and/or characteristics; etc.

12 Claims, 37 Drawing Sheets

Related U.S. Application Data

(60) Provisional application No. 63/119,823, filed on Dec. 1, 2020, provisional application No. 62/959,622, filed on Jan. 10, 2020.

(56) References Cited

U.S. PATENT DOCUMENTS

| | | | | |
|---|---|---|---|---|
| 5,014,449 | A | 5/1991 | Richard et al. | |
| 5,048,203 | A | 9/1991 | Kling | |
| 5,862,614 | A | 1/1999 | Koh | |
| 5,918,385 | A | 7/1999 | Sessa | |
| 7,096,603 | B2 | 8/2006 | Fusco | |
| 9,763,493 | B2 | 9/2017 | Nishiwaki et al. | |
| 10,806,213 | B2 | 10/2020 | Wawrousek et al. | |
| 11,553,758 | B2 * | 1/2023 | Hatfield | A43B 13/223 |
| 2006/0059716 | A1 | 3/2006 | Yamashita et al. | |
| 2007/0199211 | A1 | 8/2007 | Campbell | |
| 2010/0223818 | A1 | 9/2010 | Hampton | |
| 2012/0042539 | A1 | 2/2012 | Miner | |
| 2012/0042540 | A1 | 2/2012 | Miner | |
| 2012/0180344 | A1 | 7/2012 | Crowley, II et al. | |
| 2013/0000158 | A1 | 1/2013 | Dojan | |
| 2013/0047474 | A1 | 2/2013 | Healy et al. | |
| 2014/0259789 | A1 | 9/2014 | Dojan et al. | |
| 2015/0040436 | A1 | 2/2015 | Clerc et al. | |
| 2015/0089841 | A1 | 4/2015 | Smaldone et al. | |
| 2015/0181976 | A1 | 7/2015 | Cooper et al. | |
| 2015/0250260 | A1 | 9/2015 | Bessho et al. | |
| 2015/0342300 | A1 | 12/2015 | Cin et al. | |
| 2015/0351492 | A1 | 12/2015 | Dombrow et al. | |
| 2016/0262494 | A1 | 9/2016 | Weidl | |
| 2016/0295959 | A1 | 10/2016 | Dyer et al. | |
| 2016/0302957 | A1 | 10/2016 | Iglesias et al. | |
| 2016/0338446 | A1 * | 11/2016 | Merlo | A43B 13/36 |
| 2017/0150778 | A1 | 6/2017 | Youngs et al. | |
| 2017/0202296 | A1 | 7/2017 | Fuerst, Jr. et al. | |
| 2017/0202301 | A1 | 7/2017 | Amis et al. | |
| 2017/0258178 | A1 | 9/2017 | Cross et al. | |
| 2017/0258179 | A1 | 9/2017 | Conant et al. | |
| 2017/0340058 | A1 | 11/2017 | Madore | |
| 2018/0000191 | A1 | 1/2018 | Bacon et al. | |
| 2018/0084864 | A1 | 3/2018 | Takada et al. | |
| 2018/0132563 | A1 | 5/2018 | Hillyer et al. | |
| 2018/0249787 | A1 | 9/2018 | Fuerst, Sr. | |
| 2018/0289103 | A1 | 10/2018 | Bacon et al. | |
| 2018/0343979 | A1 | 12/2018 | Yoshida | |
| 2019/0037970 | A1 | 2/2019 | Klug et al. | |
| 2019/0208859 | A1 | 7/2019 | Mokos et al. | |
| 2019/0289961 | A1 | 9/2019 | Iuchi et al. | |
| 2020/0178644 | A1 | 6/2020 | Hillyer et al. | |
| 2020/0315285 | A1 * | 10/2020 | Winskowicz | A43B 5/001 |
| 2021/0195987 | A1 | 7/2021 | Haugen | |
| 2021/0259359 | A1 | 8/2021 | Maselino et al. | |
| 2021/0282497 | A1 | 9/2021 | Lyden | |
| 2021/0307452 | A1 | 10/2021 | Cin et al. | |
| 2021/0361028 | A1 | 11/2021 | Ishikawa et al. | |

FOREIGN PATENT DOCUMENTS

| | | | |
|---|---|---|---|
| CN | 205963089 | U | 2/2017 |
| CN | 107580464 | A | 1/2018 |
| CN | 209528016 | U | 10/2019 |
| CN | 209547114 | U | 10/2019 |
| CN | 209547123 | U | 10/2019 |

* cited by examiner

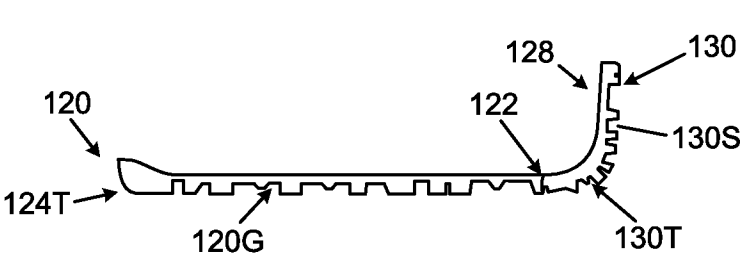
FIG. 8G
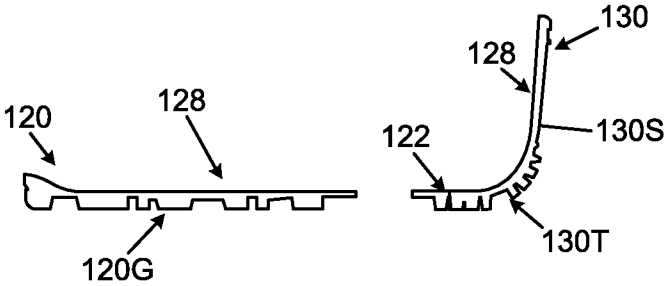
FIG. 8H
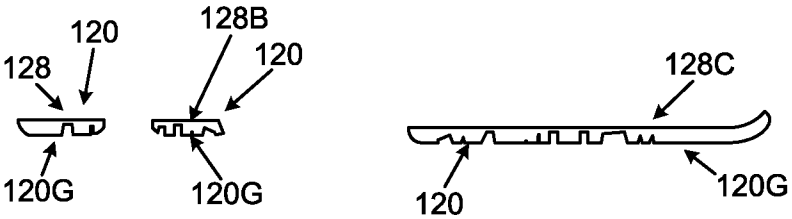
FIG. 8J
FIG. 8I
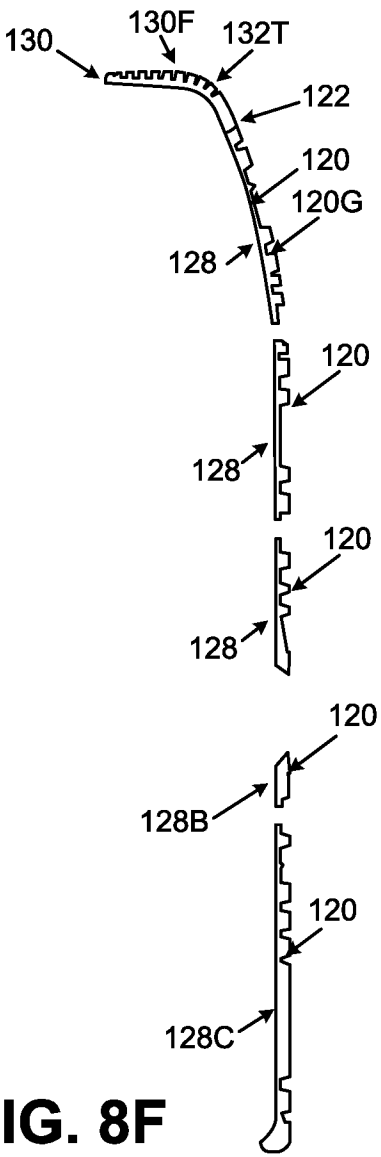
FIG. 8F

SOLE STRUCTURES HAVING MULTIPLE HARDNESSES AND/OR FLEX PROMOTING STRUCTURES

RELATED APPLICATION DATA

This application is: (a) a continuation application of co-pending U.S. patent application Ser. No. 17/145,777 filed Jan. 11, 2021, which application is a U.S. Non-Provisional Application and claims priority benefits based on each of: (b) U.S. Provisional Patent Appln. No. 62/959,622 filed Jan. 10, 2020 and (c) U.S. Provisional Patent Appln. No. 63/119,823 filed Dec. 1, 2020. Each of U.S. patent application Ser. No. 17/145,777, U.S. Provisional Patent Appln. No. 62/959,622, and U.S. Provisional Patent Appln. No. 63/119,823 is entirely incorporated herein by reference.

FIELD OF THE INVENTION

The present invention relates to articles of footwear and sole structures for articles of footwear including multiple sole structure components. Some articles of footwear and sole structures in accordance with aspects of this technology may be well suited for various types of dance and dance moves, such as urban dance and/or street dance (collectively referred to as "urban dance" herein). Such dance styles may include various dance moves that require contact between side edges of the wearer's shoes and various movements with the edges of the shoe in contact with the dance floor surface (e.g., made from concrete, asphalt, wood, etc.).

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces), and the upper also may include a heel counter to limit or control movement of the heel.

BRIEF DESCRIPTION OF THE DRAWINGS

The following Detailed Description will be better understood when considered in conjunction with the accompanying drawings in which like reference numerals refer to the same or similar elements in all of the various views in which that reference number appears.

(FIGS. 1F-1J are cross-sectional views taken along lines 1F-1F through 1J-1J in FIG. 1D);

(FIGS. 2F-2J are cross-sectional views taken along lines 2F-2F through 2J-2J in FIG. 2E);

(FIGS. 3F-3J are cross-sectional views taken along lines 3F-3F through 3J-3J in FIG. 3E);

(FIGS. 4E-4H are cross-sectional views taken along lines 4E-4E through 4H-4H in FIG. 4D);

(FIGS. 7F-7J are cross-sectional views taken along lines 7F-7F through 7J-7J in FIG. 7D);

FIGS. 8A-8J provide various views of an outsole in accordance with some examples of this technology (FIGS. 8F-8J are cross-sectional views taken along lines 8F-8F through 8J-8J in FIG. 8E);

(FIGS. 9F-9J are cross-sectional views taken along lines 9F-9F through 9J-9J in FIG. 9E);

(FIGS. 10G-10K are cross-sectional views taken along lines 10G-10G through 10K-10K in FIG. 10D);

(FIGS. 11F-11J are cross-sectional views taken along lines 11F-11F through 11J-11J in FIG. 8E); (FIGS. 12F-12J are cross-sectional views taken along lines 12F-12F through 12J-12J in FIG. 12E).

DETAILED DESCRIPTION

Figure 1A:
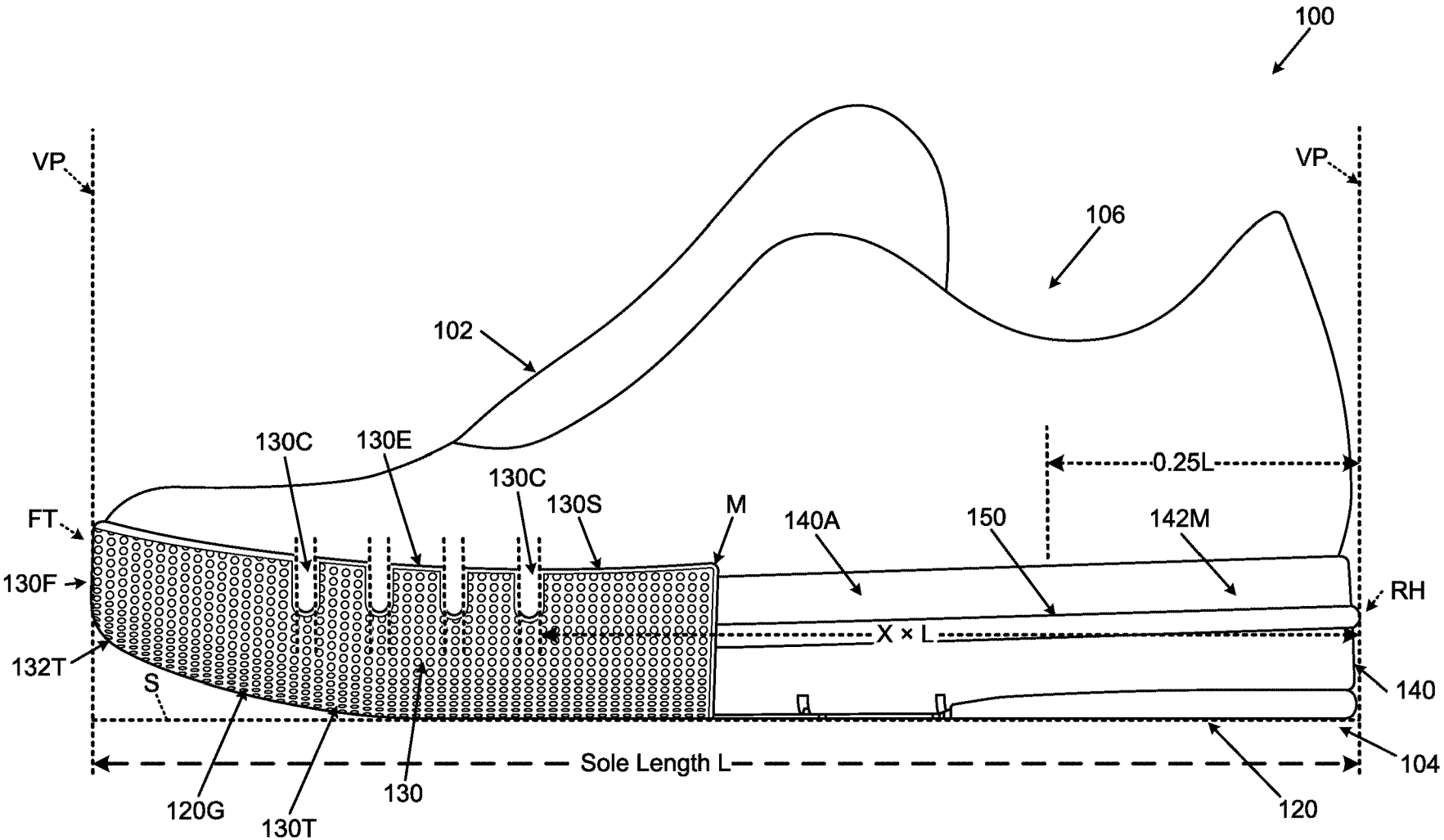
FIGS. 1A-1J provide various views of an article of footwear in accordance with some examples of this technology

In the following description of various examples of footwear structures and components according to the present disclosure, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, urban dance shoes, etc.), and the like.

Various structures and parameters of articles of footwear and sole structures thereof are described based on a "sole length" parameter L. The sole length L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP that are perpendicular to the horizontal support surface S are oriented to contact the rearmost heel (RH) location(s) and forwardmost toe (FT) location(s) of the article of footwear and/or sole structure. The parallel vertical planes VP should be oriented facing one another, e.g., extending into and out of the pages of FIGS. 1A-1C, and as far away from one another as possible while still in contact with the rearmost heel RH and forwardmost toe FT locations. The direct distance between these vertical planes VPs corresponds to the length (e.g., a longitudinal length) L of the article of footwear and/or sole structure. The locations of various footwear components are described in this specification based on their respective locations along the length L as measured forward from the rear heel vertical plane VP. The rearmost heel location(s) is (are) located at position 0 L and the forwardmost toe location(s) is (are) located at position 1 L along the sole length L. Intermediate locations along the sole length L are referred to by fractional locations (e.g., 0.25 L) along the sole length L measured forward from the rear heel vertical plane VP. The term "parallel planes" as used herein are planes oriented parallel to the vertical planes VP. These parallel planes may intersect the longitudinal length or longitudinal direction somewhere between P=0 L and P=1.0 L. Note FIGS. 1A-1C, including parallel plane location designator 0.25 L.

I. General Description of Aspects of This Technology

As noted above, articles of footwear and sole structures in accordance with aspects of this technology may be well suited for various types of dance and dance moves, including urban dance. Such dance styles include rapid movement and transitions as well as various dance moves that require contact between side edges of the wearer's shoes and the dance floor surface and various movements with the edges of the shoe in contact with the dance floor surface (e.g., which may be made from concrete, asphalt, wood, etc.). Such dance styles also require transition of the body's center of mass from the bottom to and along the edge(s) of the foot. Footwear, including the sole structures thereof in accordance with at least some examples of this technology, provide structures and properties to support several styles of urban dance and urban dance moves. This technology may include certain features, such as one or more of: selected materials in various areas to promote sliding or gliding along various surfaces; selected sizing and/or dimensional features of components in various areas; various flexion promoting structures and/or characteristics to promote desired flex in targeted areas; etc.

At least some aspects of this technology relate to sole structures for articles of footwear that include: (a) a first material having a first hardness, wherein the first material forms at least a majority of a ground-facing surface of the sole structure; and (b) a second material having a second hardness, wherein the second material extends from the first material and forms at least a first portion of an exterior surface of a sidewall of the sole structure. The first portion of the exterior surface of the sidewall formed by the second material may comprise a forefoot medial sidewall surface that includes at least a majority of a surface area of the exterior surface extending from: (i) a first forward toe location of the sole structure to (ii) a forefoot medial side location of the sole structure rearward of a first metatarsal head support region of the sole structure. In other examples of aspects of this technology, the first portion of the exterior surface of the sidewall of the sole structure may extend from a lateral side of the forefoot region, around a forward toe region, to a medial forefoot region of the sole structure (e.g., the first portion of the sidewall and/or the portion of the sidewall having the second hardness may originate forward of P=0.65 L on each side and extend forward around (and around only) the toe area of the sole structure forward of 0.65 L on each side). The term "majority" as used throughout this specification means any number or amount greater than one-half of the number or amount (or other parameter) being discussed. In such sole structures, the second hardness may be at least 15 Shore A hardness points higher than the first hardness. In some examples, the second hardness may be at least 18 Shore A hardness points higher, at least 20 Shore A hardness points higher, at least 22 Shore A hardness points higher, or even at least 24 Shore A hardness points higher than the first hardness.

Additionally or alternatively, at least some aspects of this technology relate to sole structures for articles of footwear that include: (a) a ground-facing surface; (b) a forefoot medial sidewall extending from a first forward toe location of the sole structure to a forefoot medial side location of the sole structure rearward of a first metatarsal head support region of the sole structure; (c) a medial transition region extending from the ground-facing surface to the forefoot medial sidewall, wherein the medial transition region includes a first portion having a first curvature, and wherein the first curvature extends continuously in an anterior-to-posterior direction of the sole structure for a distance of at least 20 mm (e.g., measured forward from a rear edge of the forefoot medial sidewall); (d) a forefoot lateral sidewall extending from a second forward toe location to a forefoot lateral side location of the sole structure rearward of a fifth metatarsal head support region of the sole structure; and (e) a lateral transition region extending from the ground-facing surface to the forefoot lateral sidewall, wherein the lateral transition region includes a "corner" (e.g., meaning herein a square corner or a corner within an angle of 80 degrees to 105 degrees) or a second curvature, wherein the corner or second curvature extends continuously in the anterior-to-posterior direction of the sole structure for a distance of at least 20 mm (e.g., measured forward from a rear edge of the forefoot lateral sidewall). The first curvature in such sole structures may extend in the anterior-to-posterior direction of the sole structure for at least 25 mm, at least 30 mm, at least 35 mm, at least 40 mm, at least 50 mm, at least 60 mm, at least 70 mm, or even at least 80 mm. The corner or the second curvature in such sole structures may extend continuously in the anterior-to-posterior direction of the sole structure for a distance of at least 25 mm, at least 30 mm, at least 35 mm, at least 40 mm, at least 50 mm, at least 60 mm, at least 70 mm, or even at least 80 mm. In such sole structures, the first curvature will have greater than a 5 mm radius (and in some examples, at least 5.5 mm, at least 6 mm, and/or even at least 6.5 mm over any of the above noted distance ranges), and/or the corner or the second curvature will have less than a 5 mm radius (and in some examples, less than 4.75 mm, less than 4.5 mm, or even less than 4.25 mm over any of the above noted distance ranges). Additional example features of these curvature aspects of sole structures in accordance with at least some examples of this technology are described in more detail below, e.g., including in conjunction with FIGS. 6A and 6B.

Additionally or alternatively, at least some aspects of this technology relate to sole structures for articles of footwear that include: (a) a first sole component including at least a portion of a ground-facing surface of the sole structure; and (b) a second sole component extending from the first sole component and including at least a portion of a sidewall of the sole structure. This sidewall comprises: (i) a forward toe sidewall at a forward toe location of the sole structure and (ii) a forefoot medial sidewall at a forefoot medial side location of the sole structure. In some examples, the forefoot medial sidewall may extend from the forward toe sidewall to a location at least rearward of a first metatarsal head support region of the sole structure. In some examples, the sidewall formed by the second sole component may comprise: (i) a forefoot lateral sidewall, (ii) a forward toe sidewall, and (iii) a forefoot medial sidewall, wherein the second sole component originates forward of 0.65 L on each of the medial and lateral sides of the sole but rearward of 0.9 L on each of the medial and lateral sides of the sole. In such structures, at least a majority of the second sole component (and/or at least a majority of an exposed surface of the forefoot medial sidewall formed by the second sole component) will have a hardness at least 15 or at least 18 Shore A hardness points higher than a hardness of a majority of the ground-facing surface of the first sole component.

Sole structures in accordance with some examples of this technology may include: (a) a first material having a first hardness, wherein the first material forms at least a majority of a ground-facing surface of the sole structure; and (b) a second material having a second hardness, wherein the second material extends from the first material and forms at least a first portion of an exterior surface of a sidewall of the sole structure. In such structures, the first portion of the exterior surface of the sidewall formed by the second material comprises a forefoot sidewall surface that includes at least a majority of a surface area of the exterior surface extending from: (i) a forefoot lateral side location of the sole structure to (ii) a forefoot medial side location of the sole structure around a forward toe region of the sole structure. The second hardness may be at least 15 Shore A hardness points higher than the first hardness.

In any of the sole structures and/or aspects of the technology described above (and those described in more detail below), the first sole component, the ground-facing surface, and/or a material of at least a majority of the ground-facing surface of the first sole component and/or sole structure may be made from a material (e.g., the "first material" herein) having a hardness between 50 Shore A and 75 Shore A, and in some examples, a hardness between 55 Shore A and 72 Shore A and/or a hardness below 75 Shore A. Additionally or alternatively, the second sole component (and/or at least a portion of an exposed surface of one or more of the forefoot lateral sidewall, the forward toe sidewall, and/or the forefoot medial sidewall) may be made from a material (e.g., the "second material" herein) having a hardness between 80 Shore A and 110 Shore A, and in some examples, a hardness between 88 Shore A and 100 Shore A and/or a hardness above 85 Shore A. Additionally or alternatively, in such sole structures, the second sole component (and/or at least a portion of an exposed surface of one or more of the forefoot lateral sidewall, the forward toe sidewall, and/or the forefoot medial sidewall) may have hardness at least 15 Shore A hardness points higher (and in some examples, at least 18 Shore A hardness points higher, at least 20 Shore A hardness points higher, at least 22 Shore A hardness points higher, or even at least 24 Shore A hardness points higher) than the hardness of the first sole component, the ground-facing surface, and/or a material of at least a majority of the ground-facing surface of the first sole component and/or sole structure.

Additionally or alternatively, sole structures in accordance with at least some examples of this technology may include: (a) an outsole component including a ground-facing surface, an upper-facing surface opposite the ground facing surface, and an outsole sidewall extending from the ground-facing surface, and (b) a midsole component including a polymeric foam element engaged with the upper-facing surface of the outsole component. The outsole sidewall may extend continuously, e.g., from: (i) a forefoot lateral side location of the sole structure to (ii) a forefoot or midfoot medial side location of the sole structure around a forward toe region of the sole structure. The midsole component may form a lateral sidewall of the sole structure rearward of a lateral side end of the outsole sidewall at the forefoot lateral side location of the outsole component. In some example structures, the outsole sidewall may include a medial sidewall top edge having a plurality of medial recesses (e.g., wave troughs, cutouts, etc.) extending toward the ground-facing surface and/or the lateral sidewall formed by the midsole component may include a lateral sidewall top edge having a plurality of lateral recesses (e.g., wave troughs, cutouts, etc.) extending toward the ground-facing surface. When present on both the outsole sidewall and the lateral sidewall formed by the midsole component, one or more of the plurality of medial recesses may align in a transverse direction across the sole structure, e.g., in a forefoot region of the sole structure. The ground-facing surface and the outsole sidewall described above may be made from materials having any of the hardness difference features described above for the first material and the second material.

Additional aspects of this technology relate to methods of making sole structures and/or articles of footwear of the various types described above. Such methods may include: (a) placing a first starting material (e.g., one or more preforms) for the first sole component (e.g., including a majority of the ground-facing surface of the sole structure) in a mold; (b) placing a second starting material (e.g., one or more preforms) for the second sole component (e.g., including a majority of at least the forefoot medial sidewall (and in some examples, at least a portion of a forward toe sidewall and/or at least a portion of a forefoot lateral sidewall) of the sole structure) in the mold; and (c) applying heat and/or pressure to mold the first starting material and the second starting material to a desired shape and to join the first starting material with the second starting material via a co-molded bond. This action may melt-bond the starting materials together, cross-link the materials together, e.g., in some examples while also curing the first starting material and/or the second starting material, to thereby join the starting materials together as a unitary, one-piece structure.

The first material (e.g., forming at least a majority of the ground-facing surface of the sole structure and/or the first sole component mentioned above) may be a rubber material, including rubbers conventionally known and used in footwear sole structures. The second material (e.g., forming at least a majority of surface area of the exterior surface of the forefoot medial sidewall of the sole structure and/or the second sole component mentioned above) may be a rubber material, including rubbers that are harder than the first material. In general, under similar conditions (e.g., similar temperature conditions, engaging the same type of surface, etc.), harder rubber materials will tend to have less friction (and thus feel more "slick") than softer rubber materials of the same general composition. Thus, as used herein, harder materials generally also will tend to have slicker surface engagement properties than the softer materials described herein.

Given the general description of features, examples, aspects, structures, processes, and arrangements according to certain examples of this technology provided above, a more detailed description of specific example sole structures, articles of footwear, and/or methods in accordance with this technology follows.

II. Detailed Description of Example Articles of Footwear, Sole Structure, and Other Components/Features According to Aspects of This Technology Referring to the figures and following discussion, various examples of foot support components, sole structures, and articles of footwear in accordance with aspects of this technology are described.

Figure 1B:
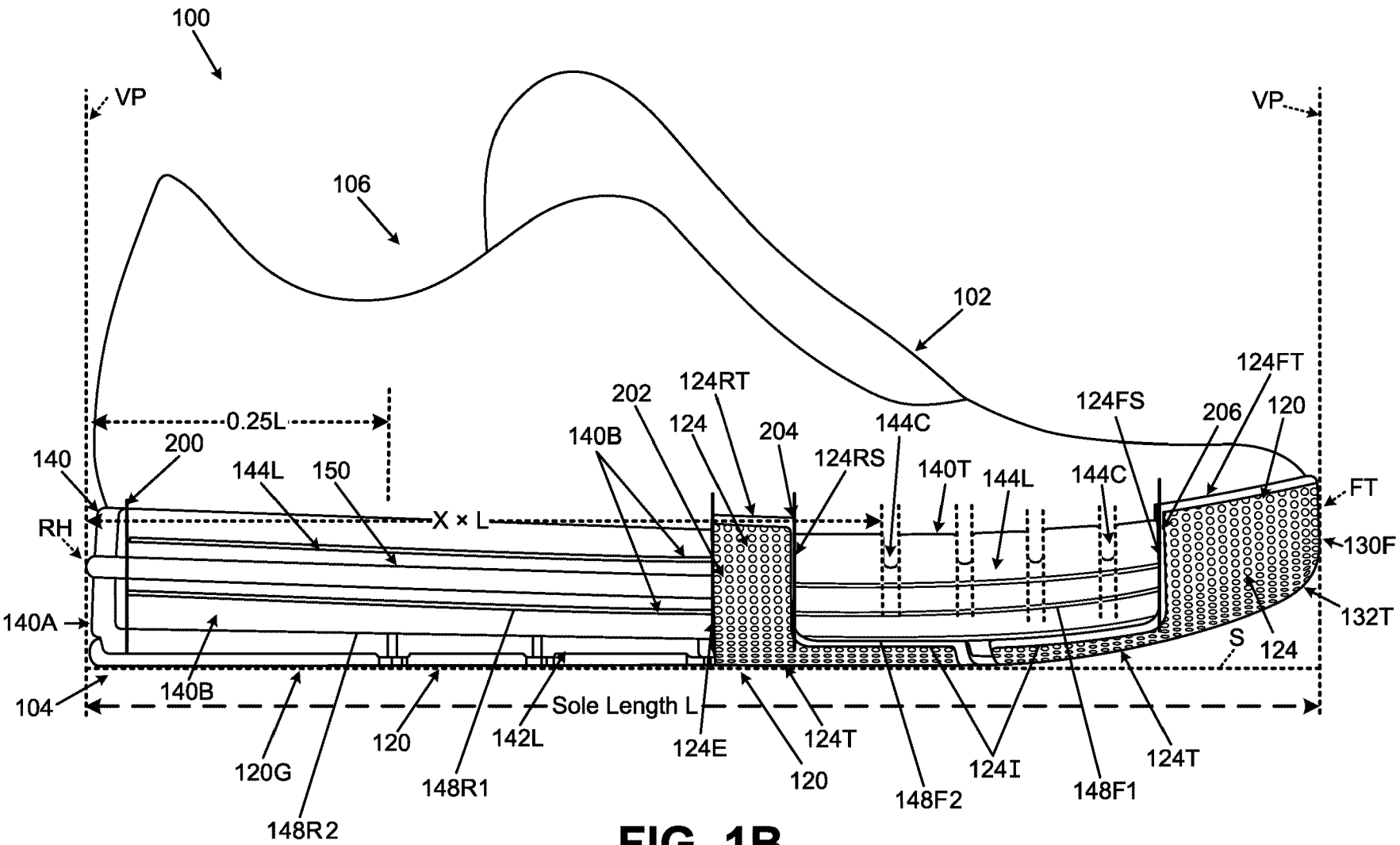
Figure 1C:
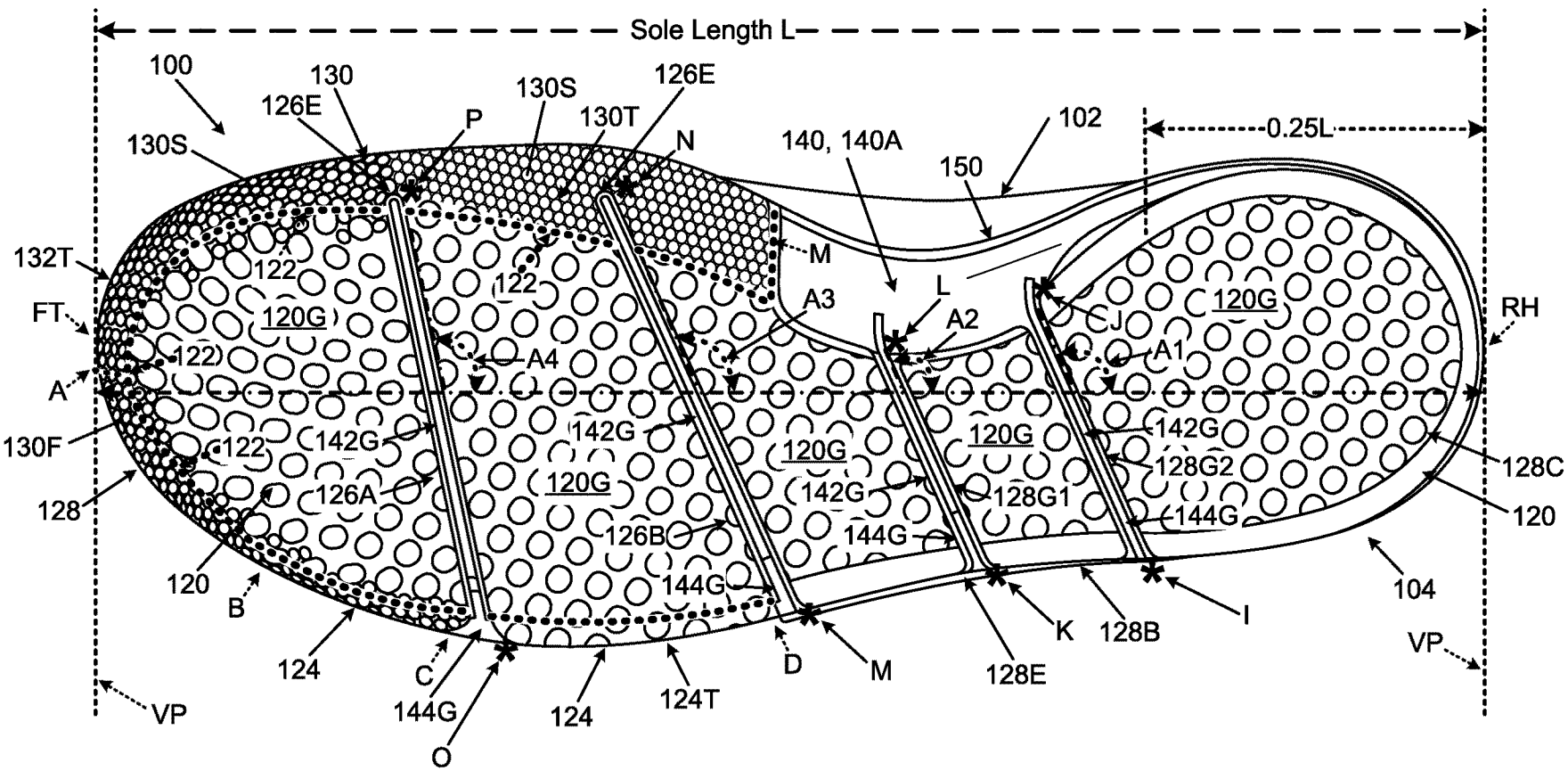
Figure 1D:
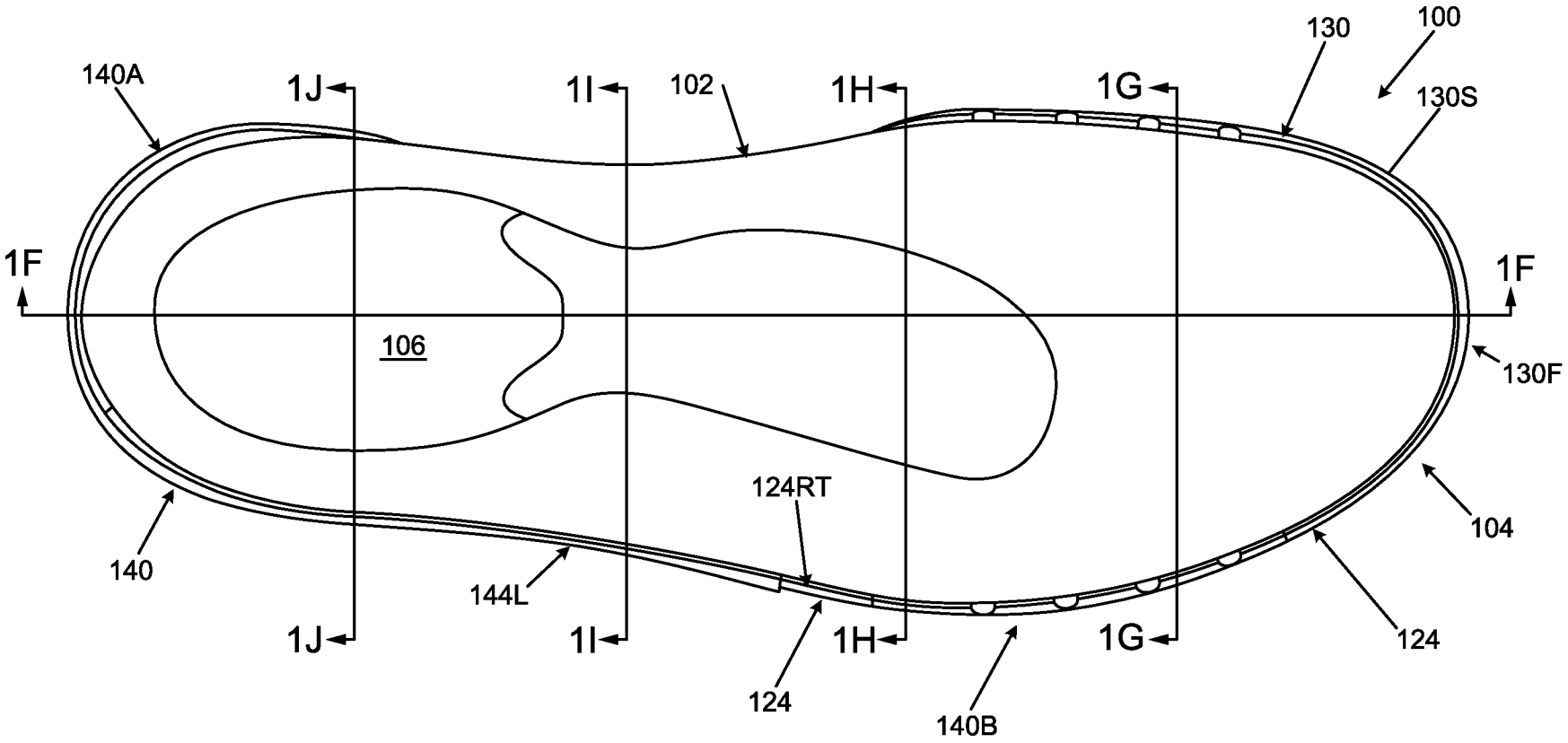
Figure 1E:
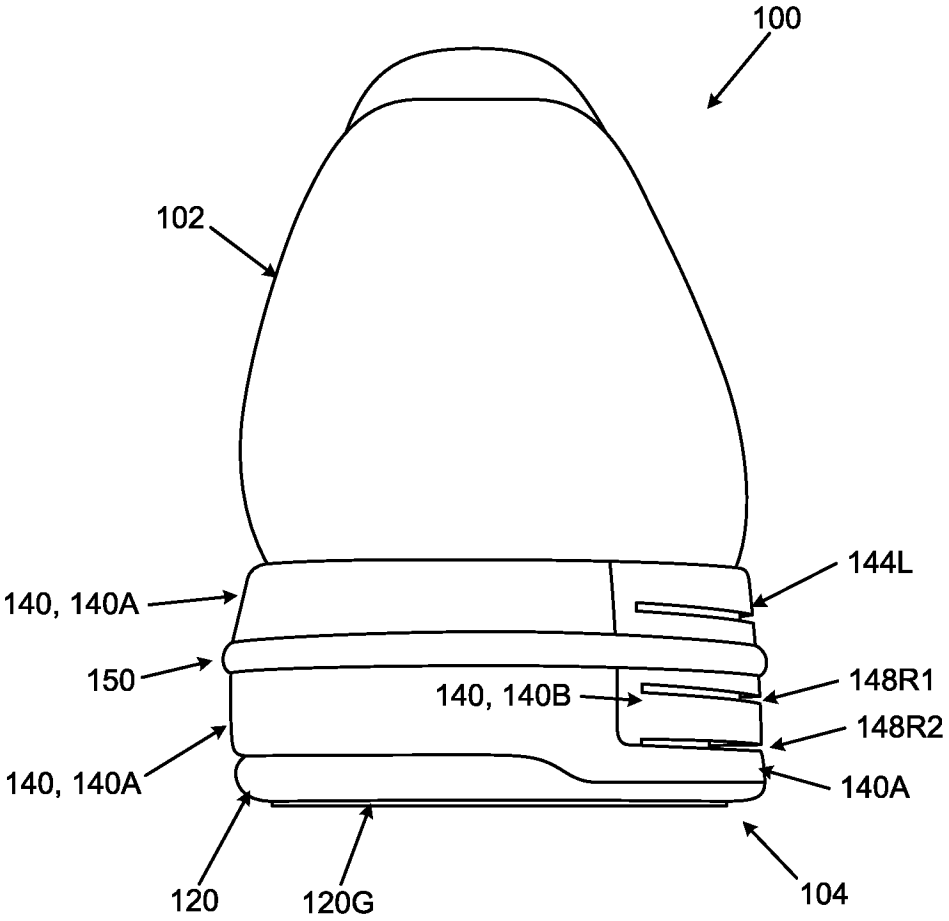
Figure 1F:
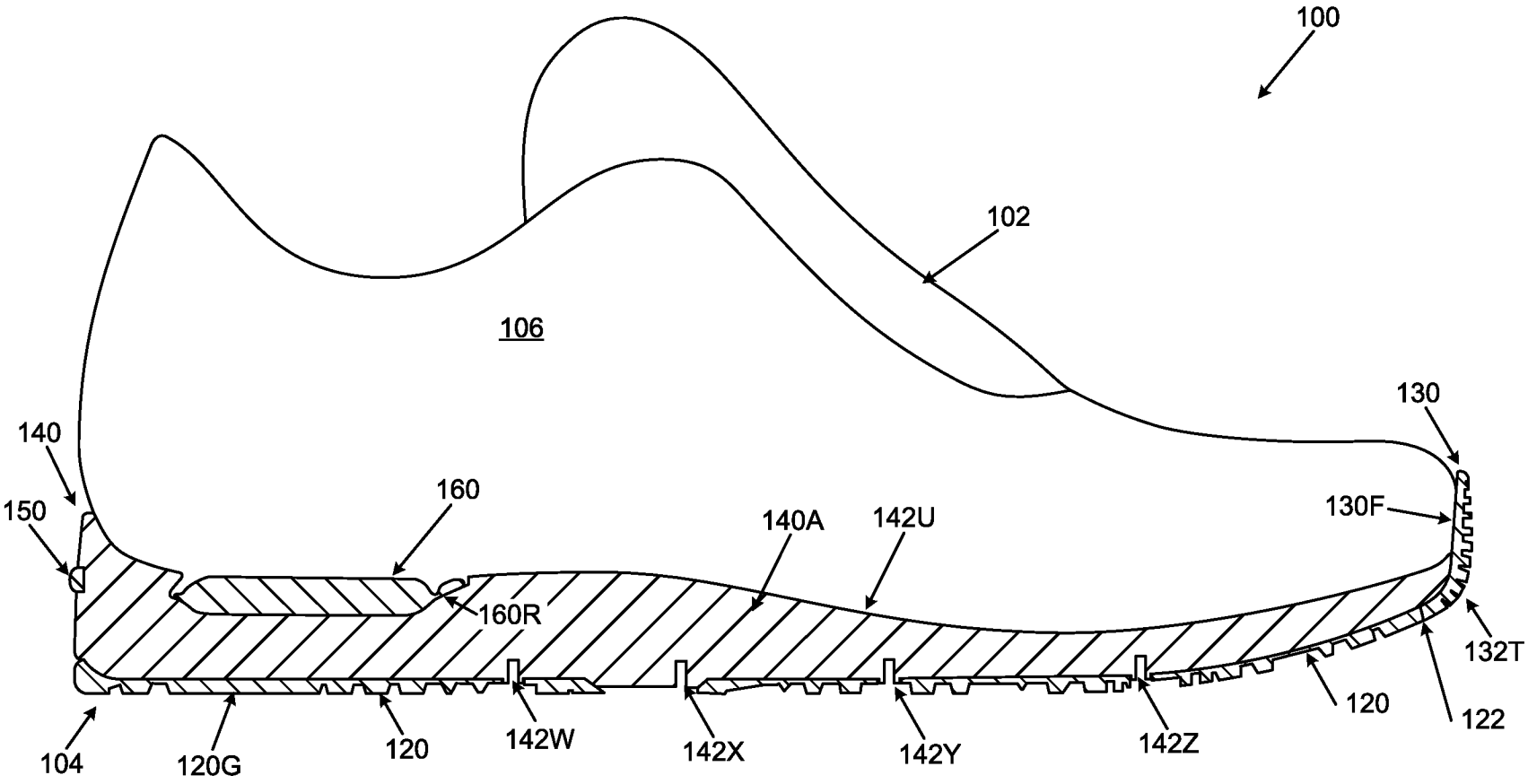
Figure 1G:
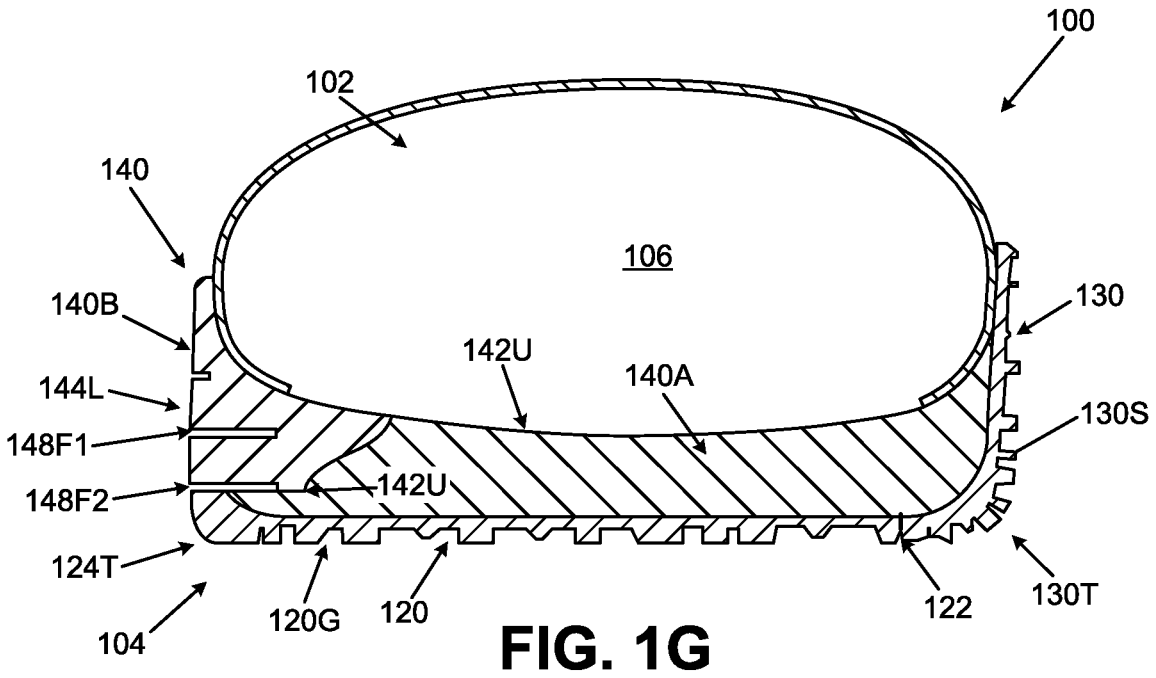
Figure 1H:
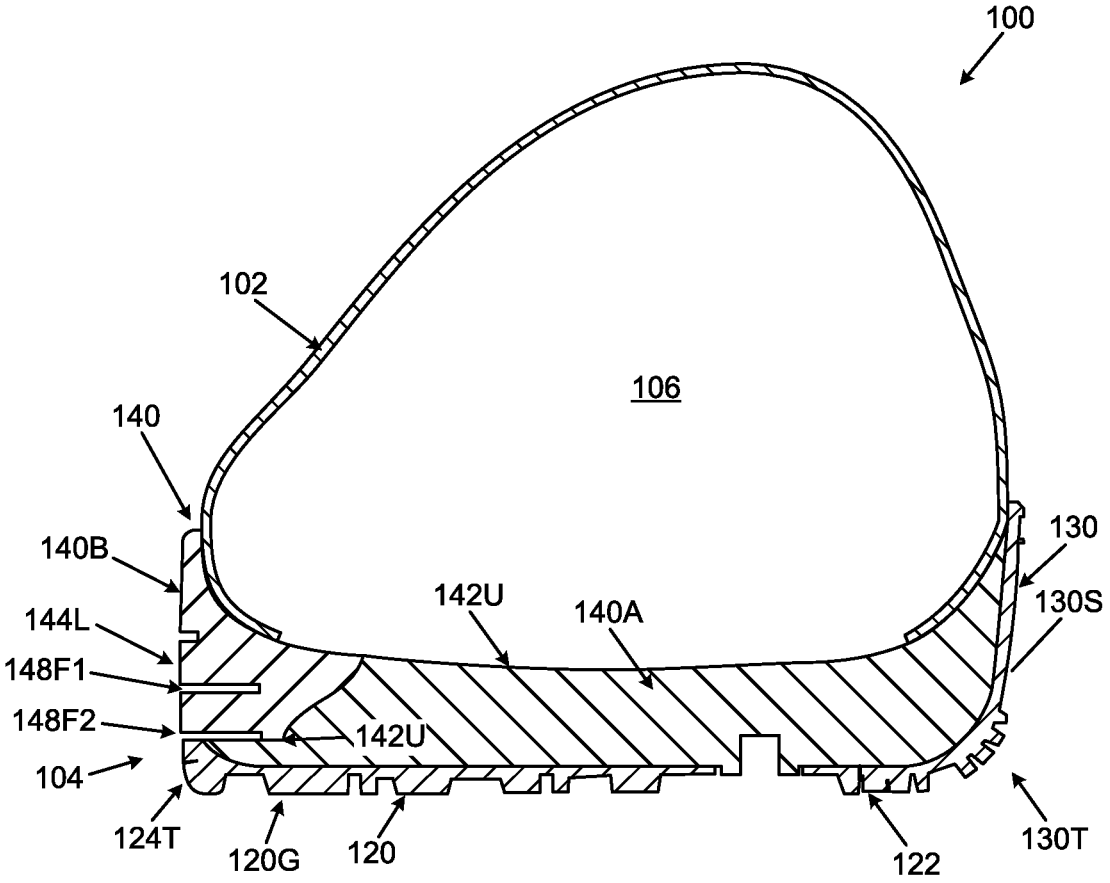
Figure 1J:
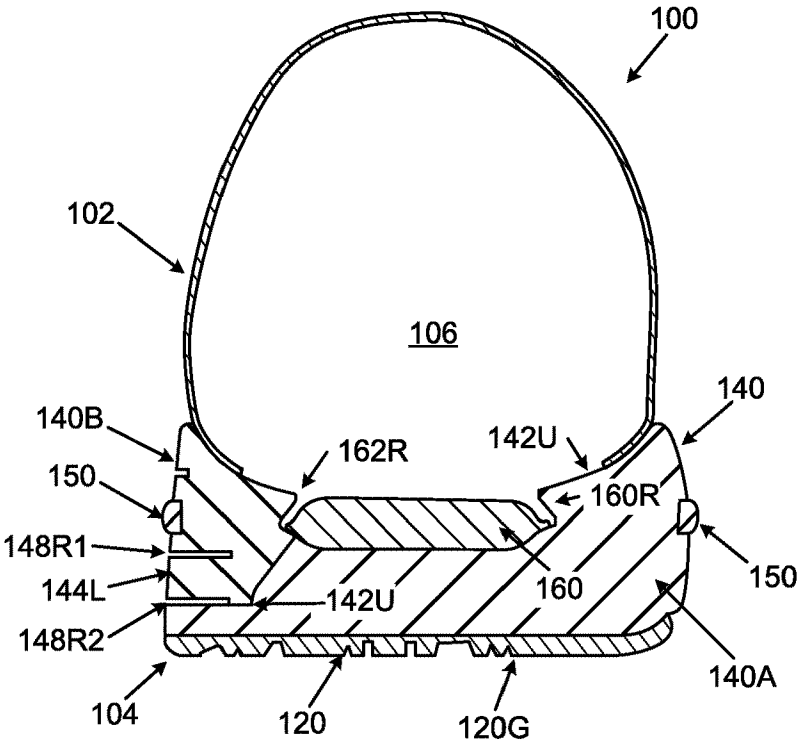
Figure 1I:
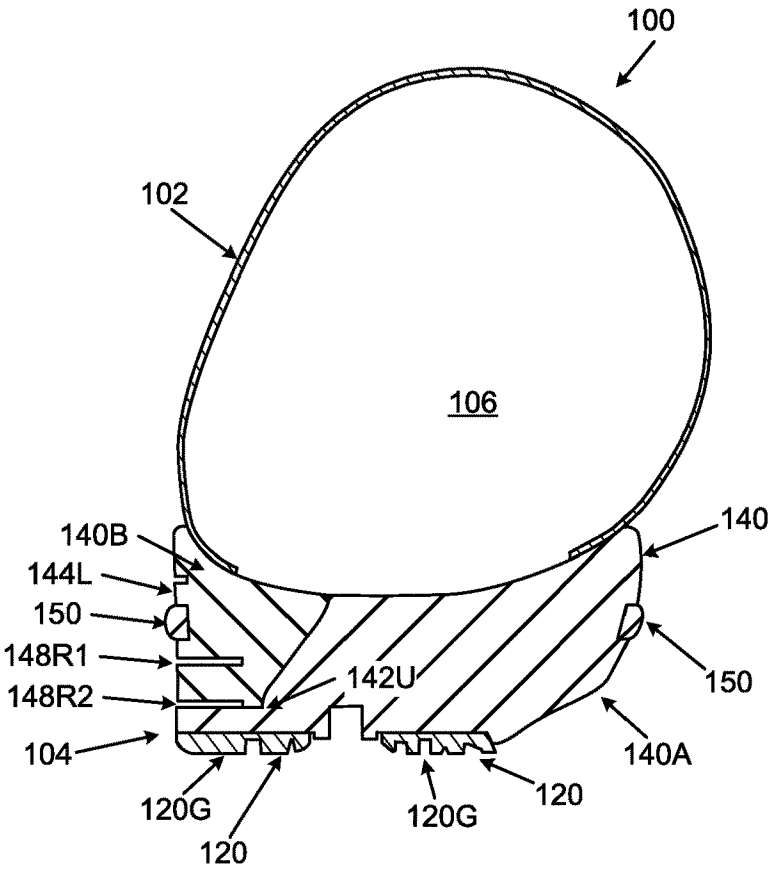
Figure 2D:
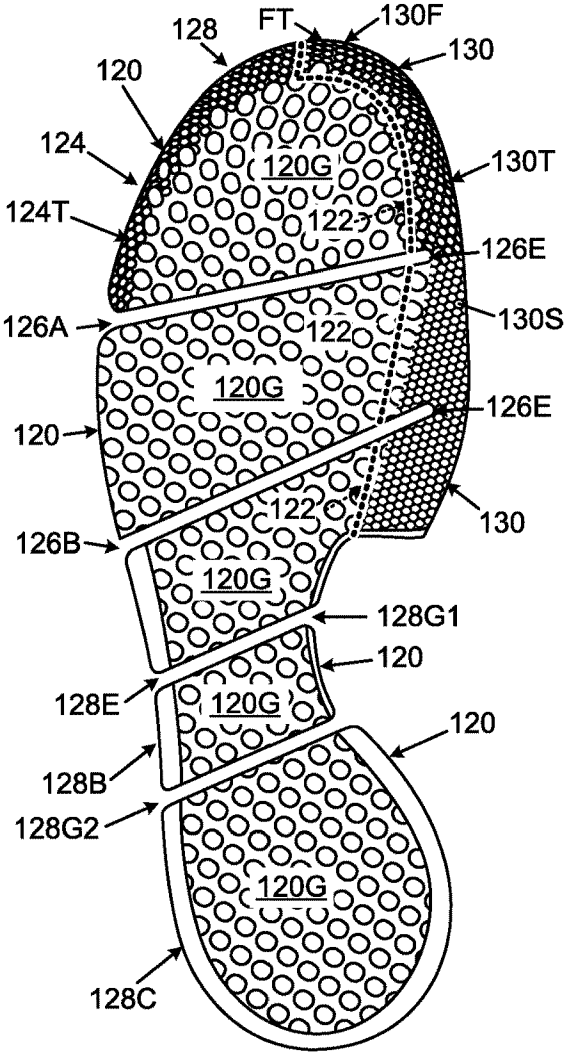
FIGS. 2A-2J provide various views of an outsole in accordance with some examples of this technology
Figure 2A:
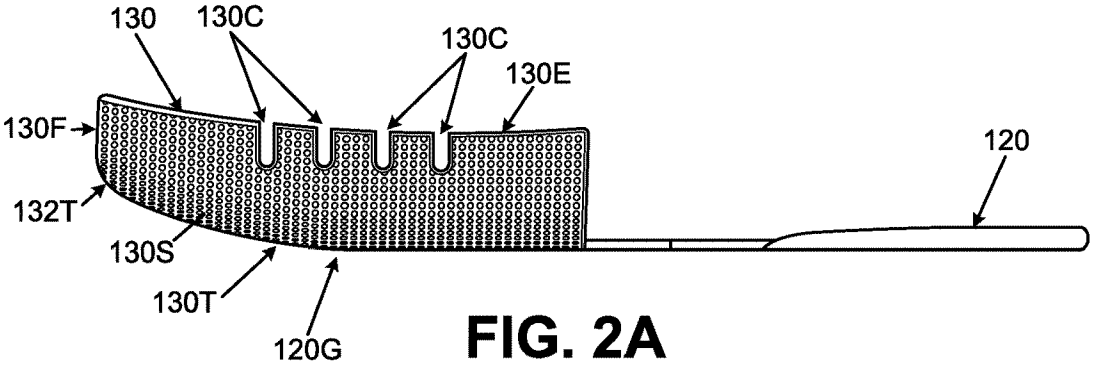
Figure 2B:
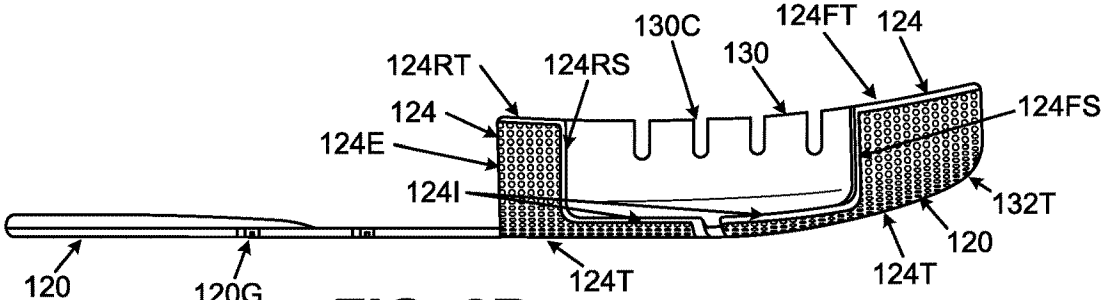
Figure 2C:
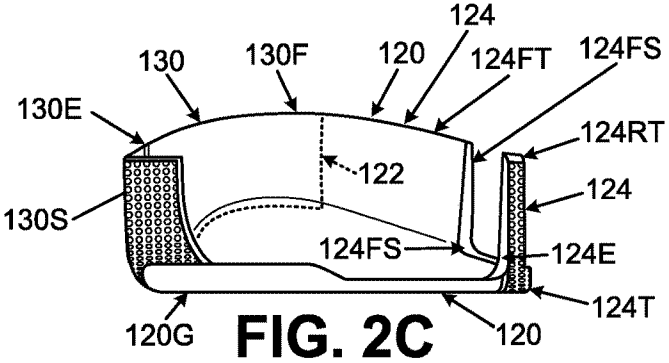
Figure 2G:
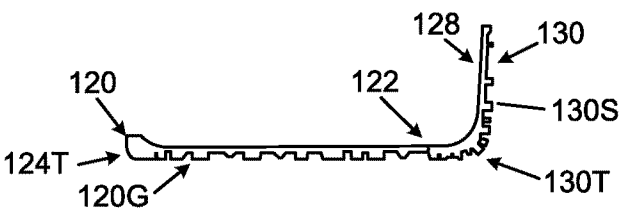
Figure 2H:
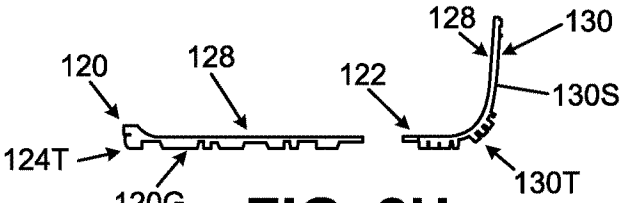
Figure 2I:
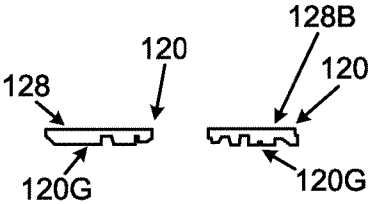
Figure 2J:
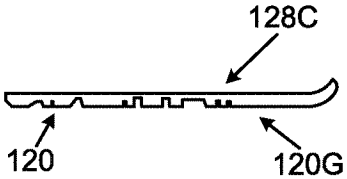
Figure 2F:
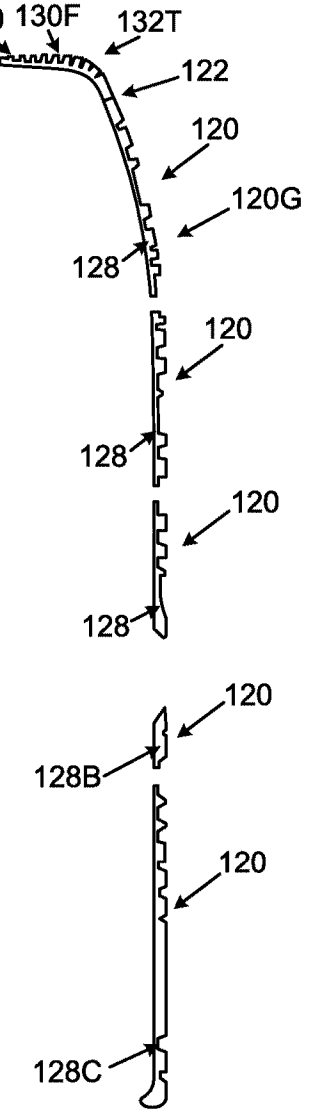
Figure 2E:
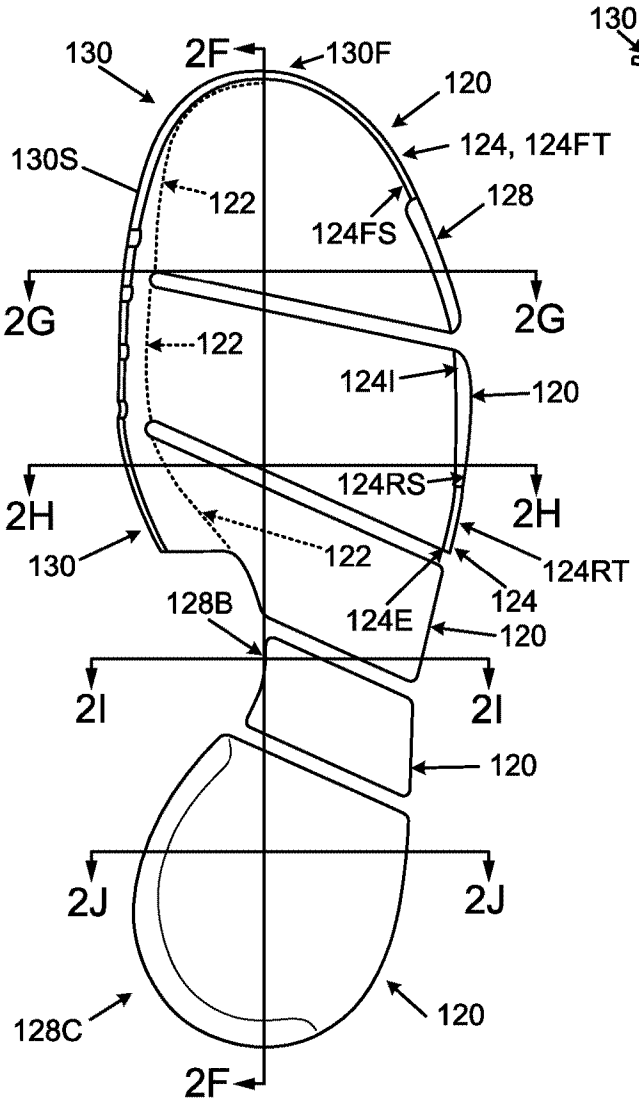
Figure 3D:
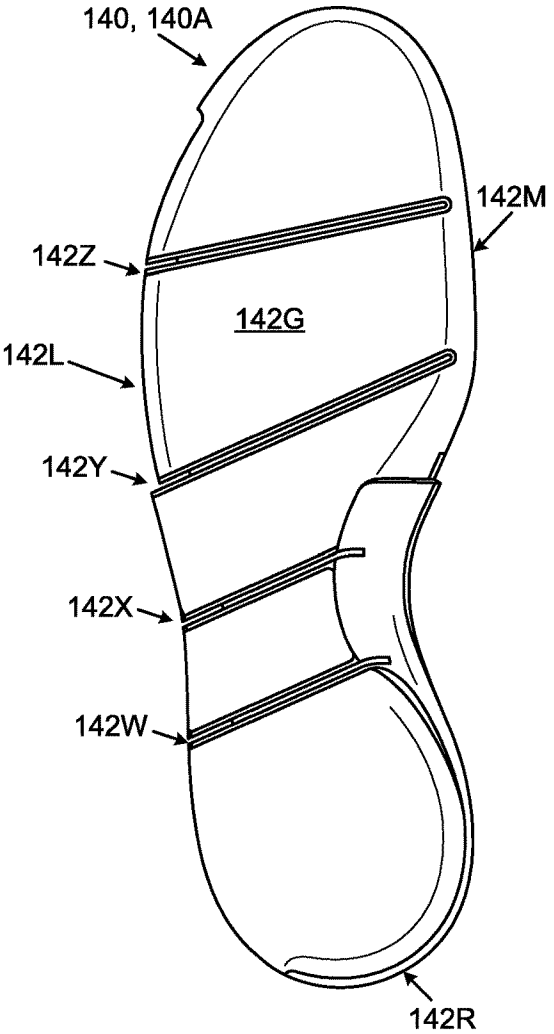
FIGS. 3A-3J provide various views of a first midsole component in accordance with some examples of this technology
Figure 3A:
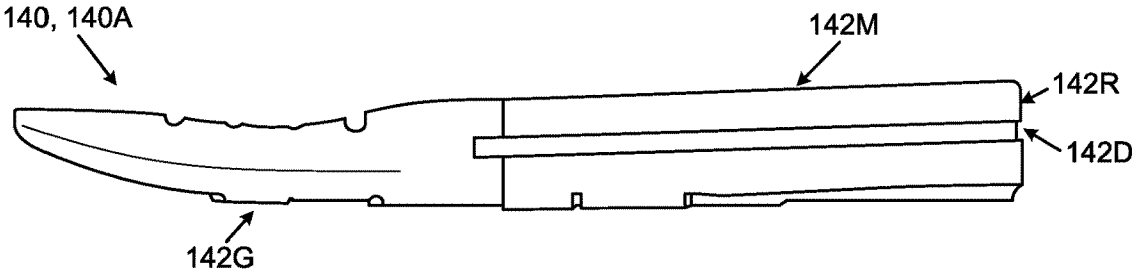
Figure 3B:
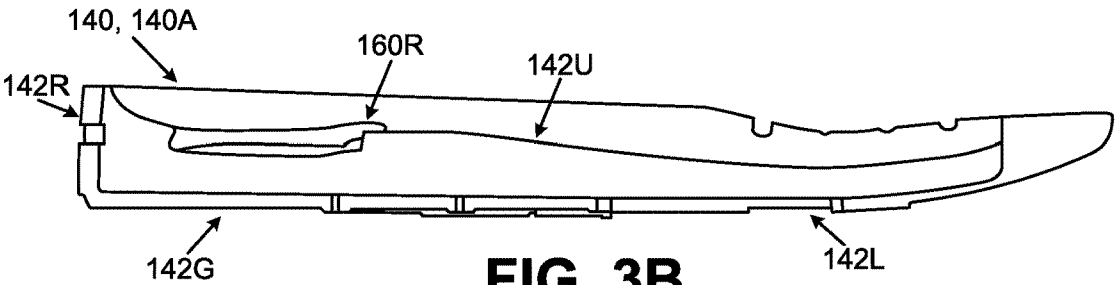
Figure 3C:
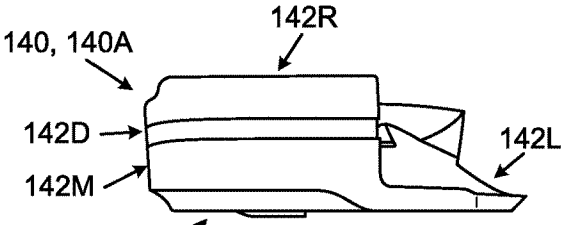
Figure 3G:
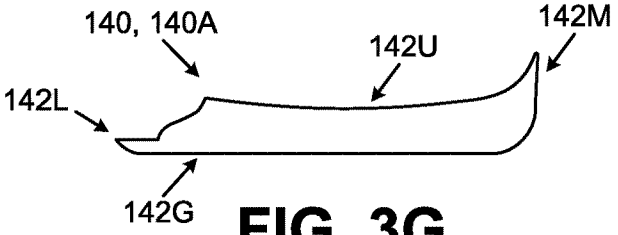
Figure 3H:
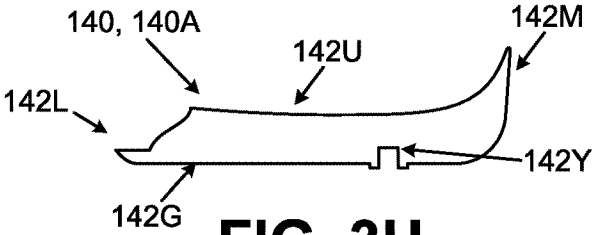
Figure 3I:
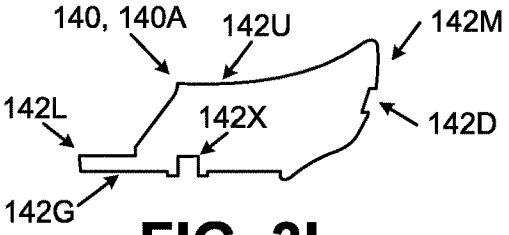
Figure 3J:
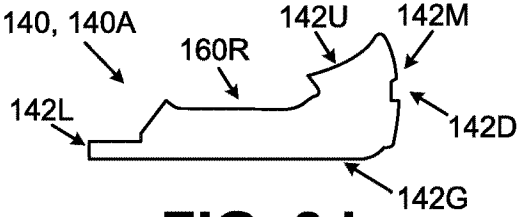
Figure 3F:
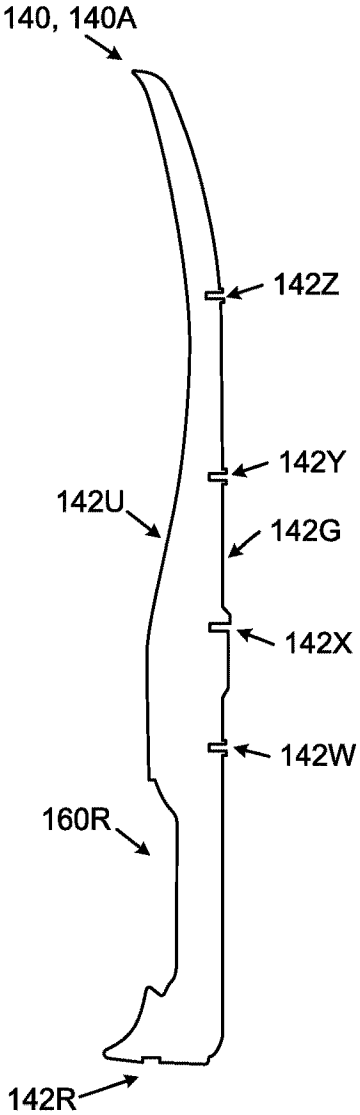
Figure 3E:
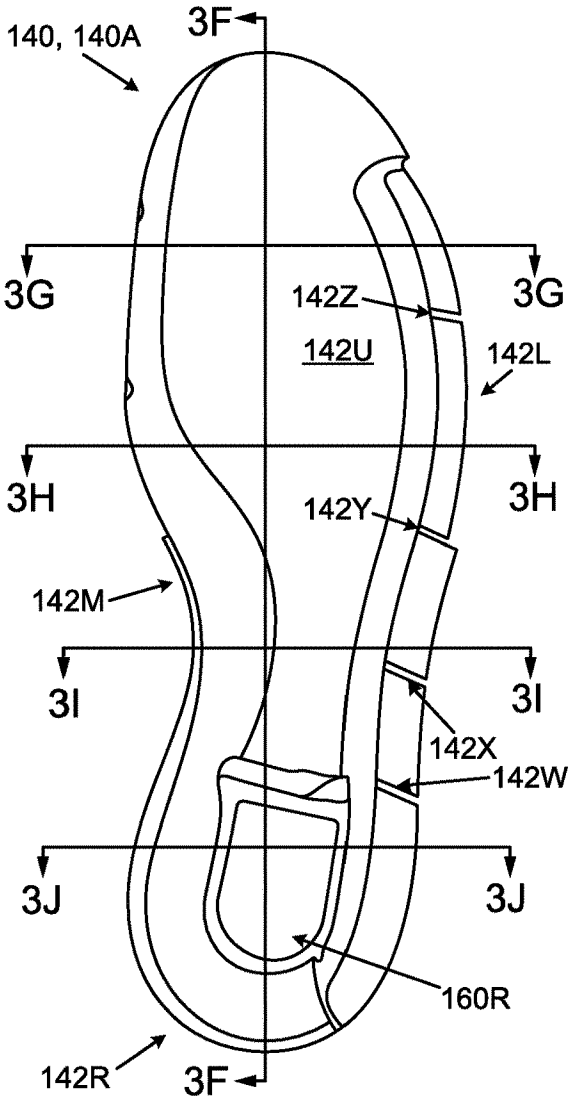
Figure 4A:
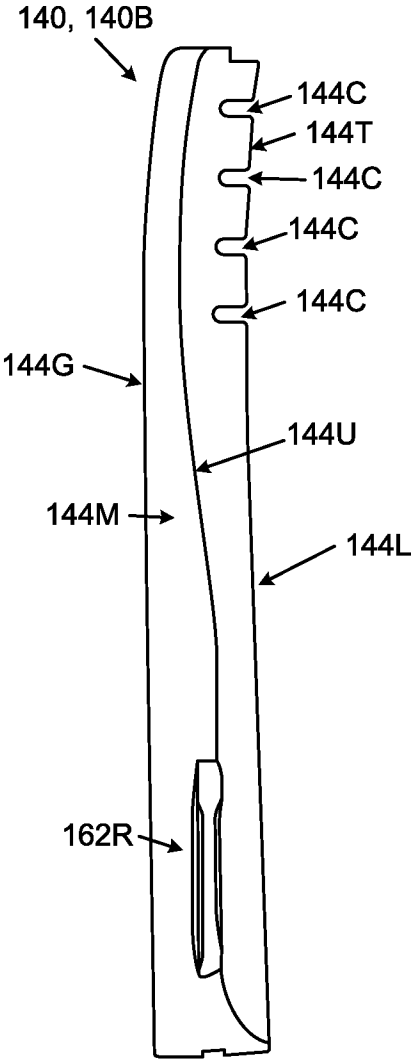
FIGS. 4A-4H provide various views of a second midsole component in accordance with some examples of this technology
Figure 4B:
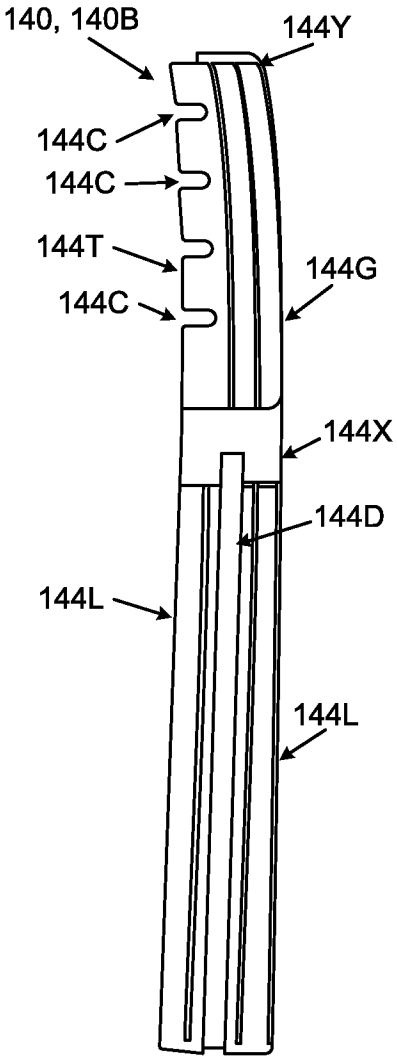
Figure 4C:
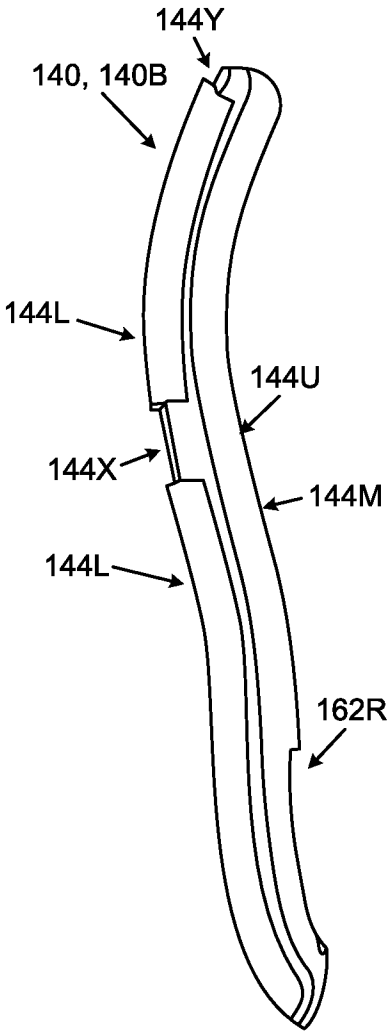
Figure 4D:
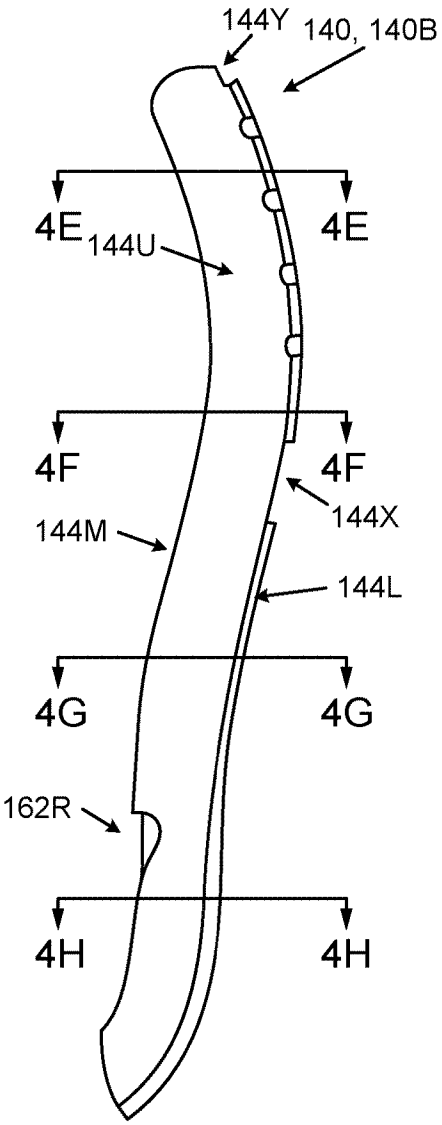
Figure 4E:
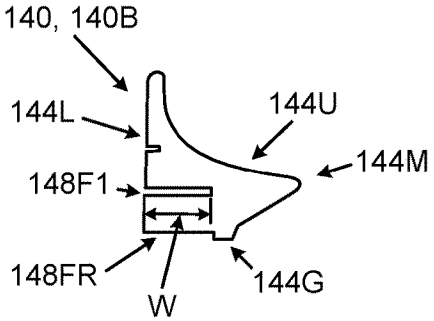
Figure 4F:
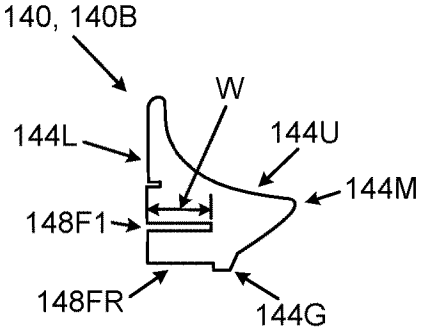
Figure 4G:
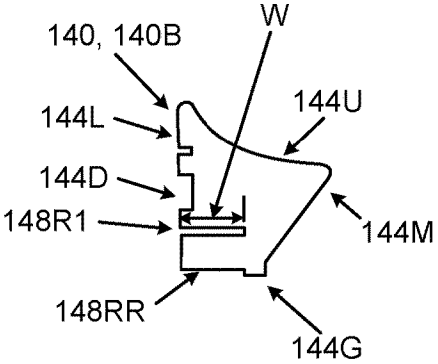
Figure 4H:
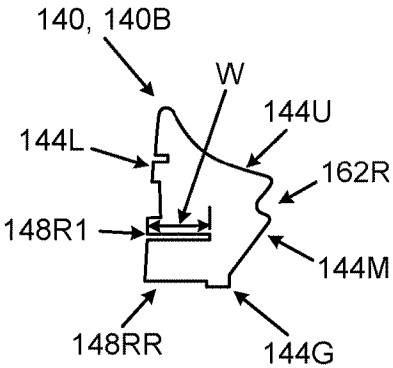
Figure 5:
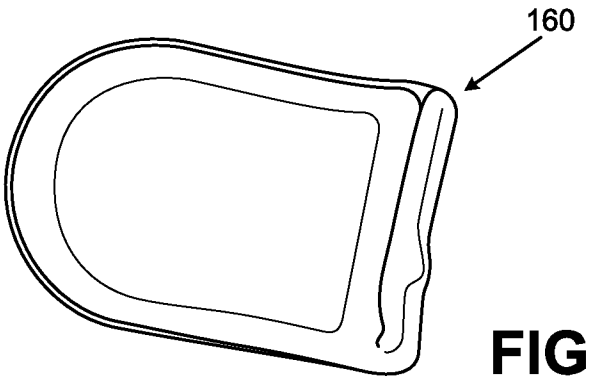
FIG. 5 illustrates an example fluid-filled bladder that may be included in sole structures in accordance with some examples of this technology.

FIGS. 1A-1J provide various views of an article of footwear 100 containing sole structures 104 in accordance with at least some aspects of this technology. FIG. 1A provides a medial side view; FIG. 1B provides a lateral side view; FIG. 1C provides a bottom view; FIG. 1D provides a top view; FIG. 1E provides a rear view; FIG. 1F provides a longitudinal cross sectional view along line 1F-1F in FIG. 1D; FIG. 1G provides a transverse cross sectional view along line 1G-1G in FIG. 1D; FIG. 1H provides a transverse cross sectional view along line 1H-1H in FIG. 1D; FIG. 1I provides a transverse cross sectional view along line 1I-1I in FIG. 1D; and FIG. 1J provides a transverse cross sectional view along line 1J-1J in FIG. 1D. FIGS. 2A-2J provide various views of outsole components 120/130 of this example sole structure 104 as follows: FIG. 2A provides a medial side view of outsole components 120/130; FIG. 2B provides a lateral side view; FIG. 2C provides a rear view; FIG. 2D provides a bottom view; FIG. 2E provides a top view; FIG. 2F provides a longitudinal cross sectional view along line 2F-2F in FIG. 2E; FIG. 2G provides a transverse cross sectional view along line 2G-2G in FIG. 2E; FIG. 2H provides a transverse cross sectional view along line 2H-2H in FIG. 2E; FIG. 2I provides a transverse cross sectional view along line 2I-21 in FIG. 2E; and FIG. 2J provides a transverse cross sectional view along line 2J-2J in FIG. 2E. FIGS. 3A-3J provide various views of midsole component 140A of this example sole structure 104 as follows: FIG. 3A provides a medial side view of midsole component 140A; FIG. 3B provides a lateral side view; FIG. 3C provides a rear view; FIG. 3D provides a bottom view; FIG. 3E provides a top view; FIG. 3F provides a longitudinal cross sectional view along line 3F-3F in FIG. 3E; FIG. 3G provides a transverse cross sectional view along line 3G-3G in FIG. 3E; FIG. 3H provides a transverse cross sectional view along line 3H-3H in FIG. 3E; FIG. 3I provides a transverse cross sectional view along line 3I-31 in FIG. 3E; and FIG. 3J provides a transverse cross sectional view along line 3J-3J in FIG. 3E. FIGS. 4A-4H provide various views of midsole component 140B of this example sole structure 104 as follows: FIG. 4A provides a medial side view of midsole component 140B; FIG. 4B provides a lateral side view; FIG. 4C provides a bottom view; FIG. 4D provides a top view; FIG. 4E provides a transverse cross sectional view along line 4E-4E in FIG. 4D; FIG. 4F provides a transverse cross sectional view along line 4F-4F in FIG. 4D; FIG. 4G provides a transverse cross sectional view along line 4G-4G in FIG. 4D; and FIG. 4H provides a transverse cross sectional view along line 4H-4H in FIG. 4D. FIG. 5 provides a view of a fluid-filled bladder 160 that may be provided in sole structures 104 in accordance with at least some examples of this technology.

The term "sole structure" as used herein may include any one or more foot support parts, e.g., forming the entirety and/or a portion of an overall sole for an article of footwear 100. Such "foot support parts" may include, for example, any individual part and/or combination of two or more foot support parts described in the examples below and shown in the figures. Various features, characteristics, and/or parts of example articles of footwear 100 and sole structures 104 thereof are described in more detail below.

The article of footwear 100 of FIG. 1A includes an upper 102 and a sole structure 104 engaged with the upper 102. The upper 102 and sole structure 104 may be engaged together in any desired manner, including in manners conventionally known and used in the footwear arts (such as by one or more of adhesives or cements, stitching or sewing, mechanical connectors, etc.).

The upper 102 (which may be formed from one or more parts), potentially together with the sole structure 104, defines a foot-receiving interior chamber 106 for containing a wearer's foot. The bottom of the upper 102 may include a strobel or other component engaged with or integrally formed with another portion of the upper 102. The upper 102 may include other components as well. For example, the upper 102 may include a tongue member located across the foot instep area and positioned to moderate the feel of the footwear's closure system on the wearer's foot; a closure system (e.g., including one or more of a lace type closure system, a zippered closure system, a buckle type closure system, elastic stretch elements, etc.); a heel counter; a toe cap; securing straps; etc. Additionally or alternatively, the upper 102 may include a "sock-like" upper component, e.g., made from fabric and configured to closely fit the wearer's foot like a conventional sock.

The upper 102 may be made from any desired material(s) and/or in any desired constructions and/or manners without departing from this technology. As some more specific examples, all or at least a portion of the upper 102 (and optionally a majority, substantially all, or even all of the upper 102) may be formed as a woven textile component, a knitted textile component, another textile component, a natural leather component, a synthetic leather component, a polymeric component (e.g., a TPU, etc.), etc. The components for upper 102 may have structures and/or constructions like those used in footwear products commercially available from NIKE, Inc. of Beaverton, OR and/or other manufacturers, including conventional structures and constructions as are known and used in the art.

Additionally or alternatively, if desired, the upper 102 construction may include uppers having foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, uppers 102 and articles of footwear 100 in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, uppers 102 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, uppers of the types described in U.S. Pat. Nos. 7,347,011 and/or 8,429,835 may be used without departing from this technology (each of U.S. Pat. Nos. 7,347,011 and 8,429,835 is entirely incorporated herein by reference).

Example articles of footwear 100, sole structures 104, and components thereof now will be described in more detail. The sole structure 104 of this illustrated example includes multiple parts, including: (a) a first outsole component 120 (e.g., having conventional hardness and/or coefficient of friction properties), (b) a second outsole component 130 (e.g., having harder and/or reduced coefficient of friction properties as compared to the first outsole component 120); and (c) a midsole component 140 (e.g., made from one or more parts, such as parts 140A and 140B). In some examples, such sole structures 104 may include additional components, e.g., such as one or more decorative components 150, one or more fluid-filled bladders 160, etc.

As shown in FIGS. 1A-2J, in this illustrated example sole structure 104, the outsole comprises two different components, portions, and/or materials having different properties, namely: first outsole component 120 and second outsole component 130. The first outsole component 120 may be formed from a first material having a first hardness, and this first material (and/or first outsole component 120) may form at least a majority of a ground-facing surface 120G of the sole structure 104. In some more specific examples, this first material (and/or this first outsole component 120) may form at least 60%, at least 75%, at least 85%, or even at least 90% of a ground-facing surface 120G of the sole structure 104 (e.g., measured based on overall surface area of the ground-facing surface 120G).

The outsole of this example further includes a second outsole component 130, e.g., formed from a second material having a second hardness. This second hardness (e.g., of the second outsole component 130) forms at least a portion (e.g., at least a majority) of the forefoot medial sidewall 130S of the sole structure 104. This second outsole component 130 has a hardness at least 18 Shore A hardness points higher than a hardness of the material forming a majority of the ground-facing surface 120G of the first outsole component 120. As some additional or alternative examples, the second outsole component 130, the forefoot medial sidewall 130S, and/or a material forming at least a portion (e.g., at least a majority) of the forefoot medial sidewall 130S may have hardness (the "second hardness" mentioned above) at least 15 Shore A hardness points higher, at least 20 Shore A hardness points higher, at least 22 Shore A hardness points higher, or even at least 24 Shore A hardness points higher than the hardness of the first outsole component 120, the ground-facing surface 120G, and/or a material forming at least a majority of the ground-facing surface 120G of the sole structure 104 (the "first hardness" mentioned above). In any of the sole structures 104 and/or aspects of this technology, the first outsole component 120, the ground-facing surface 120G, and/or a material of at least a majority of the ground-facing surface 120G of the sole structure 104 may be made from a material having a hardness (the "first hardness") between 50 Shore A and 75 Shore A, and in some examples, a hardness between 55 Shore A and 72 Shore A and/or a hardness below 75 Shore A. Additionally or alternatively, the second sole component 130, the forefoot medial sidewall 130S, and/or a material of at least a portion (e.g., at least a majority) of the forefoot medial sidewall 130S may be made from a material having a hardness (the "second hardness") between 80 Shore A and 110 Shore A, and in some examples, a hardness between 88 Shore A and 100 Shore A and/or a hardness above 85 Shore A.

This second material (and second outsole component 130) extends from the first material and is engaged with the first material (and first outsole component 120). In at least some examples of this technology, the first outsole component 120 and the second outsole component 130 will be fixedly joined together to form a unitary, one-piece construction, e.g., with the first outsole component 120 and the second outsole component 130 joined together by a melt bonded connection, a cross-linked connection, and/or in-molded connection. As more specific examples, the unitary, one-piece construction can be formed: (a) by placing one or more pre-forms of the second outsole component 130 in a mold (e.g., along at least the medial forefoot side perimeter edge and/or the forward toe sidewall edge), (b) by placing one or more pre-forms of the first outsole component 120 in the mold and in direct contact with the pre-form(s) of the second outsole component 130, and (c) closing the mold (if needed) with application of heat and/or pressure. The pre-form parts are held in the mold for a sufficient time and under sufficient heat and pressure to: (a) shape the pre-forms into the desired shapes (e.g., based on the shape of the mold cavity surfaces), (b) physically join the pre-forms together (e.g., by at least partially melting and contacting the softened/melted materials at their interface, and thereafter solidifying the parts together into a single piece construction), and/or (c) chemically join the pre-forms together (e.g., by cross-linking or other chemical reaction to join (chemically link) atoms of the first outsole component 120 and atoms of the second outsole component 130 to one another across their interface). Note, for example, the processes described in U.S. Pat. No. 10,226,906 B2, which patent is entirely incorporated herein by reference.

This type of permanent connection to form a unitary, one-piece outsole component from the first outsole component 120 and the second outsole component 130 can be particularly beneficial for use of the sole structure in various urban dance environments. Many urban dance moves produce substantial stress on soles and generate significant forces (including shear forces). Outsoles having multiple parts that are joined together only by adhesives and/or cements may have insufficient strength across the adhesive/cement bond to hold together for a significant time and/or for at least some of the desired dance moves. Thus, at least some example sole structures according to this technology will have melt-bonded and/or cross-linked engagement of components 120, 130 to form a unitary, one-piece construction.

The two different hardness features (and therefore slickness features) may be provided in other ways as well. For example, if desired, an outsole component including different hardness in the forefoot ground-facing surface 120G and the forefoot medial sidewall 130S may be formed as a single component (e.g., by molding a single composition) and then at least one of the two portions of the outsole component (e.g., a portion corresponding to first outsole component 120 and/or a portion corresponding to the second outsole component 130) may be treated (e.g., coated with a material, sprayed with a material, irradiated (e.g., with laser or other radiation), etc.) to alter the hardness of one portion with respect to the other portion.

In this illustrated example, the second outsole component 130 and/or the second (harder) material thereof forms at least a first portion of an exterior surface of a medial sidewall 130S of the sole structure 104 (e.g., from Point A at a forward toe location to point M at a medial forefoot/midfoot area in FIG. 1C). FIGS. 1C, 1F-1H, and 2C-2H generally show an interface 122 location between the first outsole component 120 and the second outsole component 130 in accordance with some examples of this technology. FIGS. 1F-1H, and 2C-2H show the second outsole component 130 and its (harder) material extending from the medial midfoot/forefoot location M at least to the forward toe FT region of the overall outsole component (designated at location A in FIG. 1C). Thus, the first portion of the exterior surface of the sidewall 130S formed by the second material comprises a forefoot medial sidewall 130S surface that includes at least a majority of a surface area of the exterior surface of the sidewall of the sole structure 104 extending from: (i) a first forward toe location of the sole structure 104 (e.g., Point A) to (ii) a forefoot or midfoot medial side location of the sole structure 104 rearward of a first metatarsal head support region of the sole structure 104 (e.g., rear edge M). In the example of these figures, the medial sidewall 130S of the outsole terminates at the rear edge M.

The second outsole component 130 (e.g., the harder material described above) may originate at rear edge M along the medial sidewall 130S. Thus, forward of rear edge M, at least a majority (and in some examples, at least 60%, at least 75%, at least 80%, at least 85%, at least 90%, at least 95%, or even 100%) of the medial sidewall 130S surface area may be formed of the harder material described above. Rear edge M, the second outsole component 130, and/or the medial sidewall 130S having the harder material properties described above may originate at a location forward of 0.4 L (measured forward from the rear heel RH vertical plane VP location), and in some examples forward of 0.45 L or forward of 0.5 L. As some additional examples, rear edge M, the second outsole component 130, and/or the medial sidewall 130S having the harder material properties described above may originate at a location between 0.4 L and 0.65 L, or even between 0.45 L and 0.6 L. In the illustrated example of FIG. 1C, rear edge M, the second outsole component 130, and the medial sidewall 130S of the sole structure 104 having the harder material properties described above is located at about 0.51 L. Also, in this illustrated example, the second outsole component 130 and the medial sidewall 130S of the sole structure 104 having the harder material properties described above extends to (and beyond) the forward toe location FT (at Point A). Alternatively, if desired, the second outsole component 130 and/or the medial sidewall 130S of the sole structure 104 having the harder material properties described above may terminate on the medial side of the forward toe location FT, e.g., between 0.85 L and 1 L, and in some examples, between 0.9 L and 0.99 L or even between 0.92 L and 0.98 L. Thus, the harder material of second outsole component 130 may form all or substantially all of the medial sidewall 130S in the forefoot region of the shoe and even all or substantially all of the medial sidewall of the overall sole structure 104 forward of 0.5 L.

As some alternatives, however, FIG. 1C further shows that the second outsole component 130 and/or the second (harder) material thereof may extend around and form an exterior surface of at least a portion of the lateral sidewall 124 of the sole structure 104 along a forefoot portion of the lateral side of the sole structure 104 (e.g., to locations B, C, and/or Din FIG. 1C). This is shown in FIG. 1C by the broken interface line 122 extending to Points B, C, and D (interface line 122 indicates the interface between outsole components 120 and 130, e.g., melt-bonded and/or cross-linked together, as described above). When present on the lateral sidewall 124 side, the harder material may extend rearward to a location forward of 0.4 L (measured forward from the rear heel RH vertical plane VP location), and in some examples forward of 0.45 L or forward of 0.5 L. As some additional examples, when present on the lateral sidewall 124 side, the harder material may extend rearward to a location between 0.4 L and 0.9 L, between 0.45 L and 0.8 L, or even between 0.48 L and 0.75 L.

The harder material of at least the medial sidewall 130S may continue downward in a vertical direction with respect to the sole structure 104 from a top edge of the second outsole component 130 to locations along the bottom (i.e., at the ground contacting surface) of the sole structure 104. As generally shown in FIGS. 1A-2J, the sole structure 104 incudes: (a) a ground-facing surface (including 120G formed from the first outsole component 120); (b) a forefoot medial sidewall 130S extending from a first forward toe location of the sole structure 104 at least to a medial side location M of the sole structure 104 rearward of a first metatarsal head support region of the sole structure 104; and (c) a forefoot lateral sidewall 124 extending from a second forward toe location to a lateral side location D of the sole structure 104 rearward of a fifth metatarsal head support region of the sole structure 104. A medial transition region 130T extends from the ground-facing surface to the forefoot medial sidewall 130S, and this medial transition region 130T includes a first portion having a first curvature. Similarly, a lateral transition region 124T extends from the ground-facing surface to the forefoot lateral sidewall 124, and this lateral transition region 124T includes a corner (e.g., a square corner or a corner within 80 degrees to 105 degrees) or a second curvature. Each of the first curvature and the second curvature of the medial transition region 130T and the lateral transition region 124T, respectively, extends continuously in an anterior-to-posterior direction of the sole structure 104 for a distance of at least 15 mm, and in some examples, at least 20 mm, at least 25 mm, at least 30 mm, at least 40 mm, at least 50 mm, or even at least 60 mm. The first curvature and second curvature features may be located within the various sole structure 104 length parameters for the medial sidewall 130L and the lateral sidewall 124 described above (e.g., at a location forward of 0.4 L and/or any of the other ranges described above for the material of the lateral sidewall 124 of the first outsole component 120 and/or for the harder material of the sidewall 130S of the second outsole component 130).

Additionally, in at least some aspects of this technology, a forward toe sidewall 130F will extend: (a) from the first forward toe location to the second forward toe location and (b) from the forefoot medial sidewall 130S (that includes the harder forefoot medial sidewall surface) to the forefoot lateral sidewall 124. Thus, the forward toe sidewall 130F connects sidewalls 130S, 124. A forward toe transition region 132T extends from the ground-facing surface to the forward toe sidewall 130F.

In at least some examples of this technology, the first curvature of the medial transition region 130T will extend over any of the length parameters and/or ranges described above with a curvature greater than a 5 mm radius (and/or in the other curvature ranges described above). If desired, the first curvature of the medial transition region 130T may vary over its length, e.g., get a larger (or less sharp) curvature in the anterior-to-posterior direction. Additionally or alternatively, if desired, in at least some examples of this technology, the second curvature of the lateral transition region 124T will extend over any of the length parameters and/or ranges described above with a corner or a curvature less than a 5 mm radius (and/or in the other angular or curvature ranges described above). When a forward toe sidewall 130F is present, curvature of the forward toe transition region 132T may vary, e.g., smoothly changing from the curvature of the forward end of the lateral transition region 124T to the curvature of the forward end of medial transition region 130T. Thus, in at least some examples of this technology, the curvature of the forward toe transition region 132T may increase (or get less sharp) in a direction from the forefoot lateral sidewall 124/lateral transition region 124T to the forefoot medial sidewall 130S/medial transition region 130T.

The rounded first curvature of the medial transition region 130T and at least a portion of the forward toe transition region 132T may be useful in various urban dance moves, e.g., as a wearer transitions his/her body weight to concentrate it on the medial side and/or forward toe area(s) of the foot. The relatively large and rounded first curvature of the medial transition region 130T allows the weight to transition relatively smoothly and predictably from the ground-facing surface 120G to the medial sidewall 130S as the wearer rolls the foot inward to engage the medial sidewall 130S with the contact surface. The relatively large and rounded first curvature of the medial transition region 130T also helps prevent a sudden and abrupt weight transfer to the side of the feet (and sidewall 130S of the second outsole component 130), e.g., to prevent an undesired sudden "tipping point" when transferring weight to the sides of the feet. The relatively large and rounded curvature of the forward toe transition region 132T, when present, allows the weight to transition relatively smoothly from the ground-facing surface 120G to the forward toe sidewall 130F (and, optionally, from there to the medial sidewall 130S) as the wearer shifts weight toward the forward toe area of the sole structure 104.

In some examples of this technology, the medial transition region 130T may be formed from the harder rubber composition and/or component described above. Thus, a portion of the forefoot medial peripheral edge of the ground-facing surface of the outsole may be formed of the harder rubber composition/component, e.g., shown by the broken interface line 122 in FIG. 1C. This peripheral edge of the ground-facing surface of the outsole formed of the harder rubber composition and/or component may be at least 2 mm wide, and in some examples, at least 3 mm wide, or even at least 5 mm wide. In some sole structures 104, it may be advantageous if this harder rubber composition/component does not extend too far into the ground-facing surface 120G of the outsole. As some more specific examples, the peripheral edge of the ground-facing surface 120G of the outsole formed of the harder rubber composition/component may be less than 20 mm wide, and in some examples, less than 16 mm wide, or even less than 12 mm wide. These ranges may provide the desired hardness properties at the forefoot side edge(s) of the sole structure 104 for various urban dance moves without making the overall ground facing surface 120G overly (or unnecessarily) hard (and therefore slick).

FIGS. 1A-1J further show that the sole structure 104 includes a midsole 140. The midsole 140 may include any number of parts or components without departing from this technology. This illustrated example midsole 140 includes three midsole components: (a) a first (e.g., medial side) midsole component 140A (see also FIGS. 3A-3J), (b) a second (e.g., lateral side) midsole component 140B (see also FIGS. 4A-4H), and (c) a fluid-filled bladder 160 (e.g., as are conventionally known and used in the footwear arts; see also FIG. 5). The midsole 140 provides support for the wearer's foot, absorbs impact forces, and generally improves the comfort and stability of the footwear 100.

While other structures and combinations are possible, in the illustrated example midsole 140, the first midsole component 140A constitutes the largest midsole component, supporting at least 60% (and in some examples, at least 50%, at least 75%, at least 80%, at least 90%, or even at least 95%) of the plantar surface of a wearer's foot. The first midsole component 140A may be made from a polymeric foam material, e.g., as are conventionally known and used in the footwear arts (e.g., ethylvinylacetate ("EVA") foams, polyurethane foams, etc.).

First midsole component 140A includes an upper-facing surface 142U, a ground-facing surface 142G, a medial sidewall 142M, a lateral side edge 142L, and a rear wall 142R. The upper-facing surface 142U may be contoured, e.g., to better support and conform to the shape of a wearer's foot. Additionally, in this illustrated example, the upper-facing surface 142U defines a receptacle 160R for receiving a heel based fluid-filled bladder 160. Further, the ground-facing surface 142G of this example includes four relatively deep flexion grooves 142W, 142X, 142Y, and 142Z that extend across the first midsole component 140A in a generally lateral heel-to-medial forefoot direction. The flexion grooves 142W to 142Z may extend completely from the medial sidewall 142M to the lateral edge 142L of first midsole component 140A. Although four flexion grooves 142W-142Z are shown in this illustrated example, more or fewer such flexion grooves (optionally oriented in the lateral heel-to-medial forefoot direction) may be included, such as from 2 to 8 such grooves, and optionally, from 3 to 6 such grooves. The deep flexion grooves may be, for example, from 3 to 10 mm deep over at least a majority of their lengths (or even at least 60%, at least 70%, or even at least 80% of their lengths) and in some examples, from 4 to 8 mm deep (over any of those length ranges). The deep flexion grooves 142W-142Z may be formed in the first midsole component 140A in any desired manner, such as during a molding process (e.g., when the first midsole component 140A is formed by molding), by cutting (e.g., using a blade, laser, etc.), directly formed via a rapid manufacturing process (e.g., a rapid manufacturing additive fabrication technique, a rapid manufacturing subtractive fabrication technique, etc.), etc. In the illustrated example, grooves 142W to 142Z are well positioned to provide flexibility and support for some desired urban dance moves.

The second midsole component 140B of this illustrated example provides at least a portion of a lateral sidewall 144L and lateral edge support for the sole structure 104 and article of footwear 100. While other proportions are possible, in some examples of this technology, the second midsole component 140B supports less than 40% (and in some examples, less than 50%, less than 25%, less than 20%, less than 10%, or even less than 5%) of the plantar surface of a wearer's foot. The second midsole component 140B may be made from a polymeric foam material, e.g., as are conventionally known and used in the footwear arts (e.g., ethylvinylacetate ("EVA") foams, polyurethane foams, etc.). The material of the second midsole component 140B may differ from the material of the first midsole component 140A, e.g., in hardness, resilience, other performance properties, composition, etc., although this is not a requirement in all examples of this technology.

Second midsole component 140B of this example includes an upper-facing surface 144U, a ground-facing surface 144G, the lateral sidewall 144L, and a medial side edge 144M. The upper-facing surface 144U may be contoured, e.g., to better support and conform to the shape of a wearer's foot. Additionally, in this illustrated example, the upper-facing surface 144U and/or the medial side edge 144M define a portion of a receptacle 162R (e.g., cooperating with the receptacle 160R formed in the first midsole component 140A) for receiving the heel based fluid-filled bladder 160. If multiple fluid-filled bladders are present, multiple receptacles and/or portions thereof may be defined in first midsole component 140A and/or second midsole component 140R (or other sole structure 104 component). FIGS. 4B through 4D further show that the lateral sidewall 144L of the second midsole component 140B of this example includes structures 144X and 144Y (e.g., recesses or the like) for receiving surfaces of the outsole (e.g., the forefoot lateral sidewall 124 of first outsole component 120). FIG. 1B shows the forefoot lateral sidewall 124 engaged with surfaces of the lateral sidewall 144L of the second midsole component 140B that include the structures 144X and 144Y.

Further, although not required in all examples of this technology, outer surfaces of first midsole component 140A and second midsole component 140B include grooves 142D and 144D, respectively, for receiving the optional decorative element 150. In this illustrated example, the decorative element 150 includes an elongated bead of TPU having a different color from the first midsole component 140A and second midsole component 140B. Other or different decorative structures and elements may be provided, if desired.

Some further features of this example sole structure 104 and article of footwear 100 now will be described in conjunction with FIGS. 1B, 2B, 2C, and 2E. The first feature relates to the forefoot lateral sidewall 124 of first outsole component 120. With the sole structure 104 (and article of footwear 100) supported on the ground-facing surface 120G in an unloaded condition (e.g., with no weight applied to it other than the weight of other sole structure 104 and/or other footwear 100 components), this example forefoot lateral sidewall 124 comprises: (a) a rear top edge 124RT, (b) a rear side edge 124RS extending downward from the rear top edge 124RT, (c) a forward top edge 124FT, (d) a forward side edge 124FS extending downward from the forward top edge 124FT, and (e) an intermediate top edge 1241 extending from the rear side edge 124RS to the forward side edge 124FS. The intermediate top edge 1241 may extend for any desired distance in the anterior-to-posterior direction of the sole structure 104. As some more specific examples, this intermediate top edge 1241 will extend for a longitudinal (or anterior-to-posterior) distance of at least 25 mm, at least 30 mm, at least 35 mm, at least 40 mm, at least 50 mm, or even at least 60 mm. Additionally or alternatively, this intermediate top edge 1241 may be spaced vertically downward with respect to the rear top edge 124RT and/or the forward top edge 124FT by any desired distance. These distances constitute the height dimensions of the rear side edge 124S and/or the forward side edge 124FS, respectively. These vertical spacings and height dimensions may be a distance of at least 10 mm, and in some examples, at least 6 mm, at least 8 mm, at least 12 mm, at least 15 mm, at least 18 mm, or even at least 20 mm.

As some additional potential features, the rearmost edge 124E of the forefoot lateral sidewall 124 may be located within a range of 0.35 L to 0.65 L, and in some examples, between 0.4 L and 0.6 L. The rear side edge 124RS of the forefoot lateral sidewall 124 may be located within a range of 0.45 L to 0.75 L, and in some examples, between 0.5 L and 0.7 L. The forward side edge 124FS may be located within a range of 0.7 L and 0.95 L, and in some examples, between 0.75 L and 0.92 L.

As illustrated in FIGS. 1B, 2B, 2C, and 2E, top edge 124RT, 124FT, 1241 features and side edge 124RS, 124FS features of forefoot lateral sidewall 124 in this illustrated example form a gap in the lateral sidewall 124 between the rear side edge 124RS and the forward side edge 124FS. The midsole component 140 (and in this illustrated example, second midsole component 140B) is exposed in this gap. More specifically, as shown in FIG. 1B, an exterior surface of the lateral sidewall 144L of the midsole 140 (second midsole component 140B) is exposed at an exterior surface of the sole structure 104, e.g., extending above the intermediate top edge 1241 and from the rear side edge 124RS to the forward side edge 124FS. The lateral sidewall 144L of midsole 140 (midsole component 140B in this example) also is exposed rearward of rearmost edge 124E in this illustrated example sole structure 104.

The lateral sidewall 144L of the midsole component 140 (e.g., second midsole component 140B) in this example includes further features to assist in providing desired levels of flexibility and support, e.g., for urban dance uses. For example, as shown in FIGS. 1B, 4A, and 4B, at this lateral sidewall 144L, one or more cutouts 144C (or other recesses) are defined in the top edge 144T of the midsole 140 (e.g., second midsole component 140B). While four such cutouts 144C are shown in these figures, any desired number of cutouts 144C may be provided, including from 1 to 8 cutouts 144C, and in some examples, from 2 to 6 such cutouts 144C. The individual cutouts 144C may be at least 2 mm wide (in the anterior-to-posterior direction), and in some examples, from 2 mm to 15 mm wide, from 2.5 mm to 12 mm wide, or even from 3 mm to 8 mm wide. The individual cutouts 144C may be at least 2 mm tall (in the top-to-bottom direction), and in some examples, from 2 mm to 20 mm tall, from 3 mm to 16 mm tall, or even from 4 mm to 12 mm tall. When multiple cutouts 144C are provided in a lateral sidewall 144L of a midsole component 140, the cutouts may have the same or different sizes, shapes, etc. A sole structure 104 according to some examples of this technology may include any one or more of the above noted cutouts 144C, and/or the cutout(s) may be provided in any one or more of the positions and/or ranges of positions described in more detail below.

In the example of FIG. 1B: (a) at least a portion of the rearmost lateral sidewall cutout 144C in the lateral sidewall 144L of midsole 140 is located at about 0.65 L, (b) at least a portion of the next forward or rear intermediate lateral sidewall cutout 144C is located at about 0.71 L, (c) at least a portion of the next forward or forward intermediate lateral sidewall cutout 144C is located at about 0.77 L, and (d) at least a portion of the forwardmost lateral sidewall cutout 144C is located at about 0.83 C. Other longitudinal arrangements and/or spacings of cutouts 144C are possible without departing from this technology. As some examples, at least some portions of one or more lateral sidewall 144L cutouts 144C may be located within the various ranges shown in Table 1 below.

As some further potential features to enhance support and/or flexibility and to support the desired urban dance moves, the medial sidewall 130S (e.g., of second outsole component 130, and particularly the portion of the outsole sidewall 130S made from the harder outsole material) may include cutouts 130C (or other recesses). These medial side cutouts 130C may be similar in size, shape, and/or location to the cutouts 144C provided in the lateral sidewall 144L. As more specific examples, as shown in FIGS. 1A and 2A, at this medial sidewall 130S, one or more cutouts 130C are defined in the top edge 130E of the second outsole component 130. While four such cutouts 130C are shown in these figures, any desired number of cutouts 130C may be provided, including from 1 to 8 cutouts 130C, and in some examples, from 2 to 6 such cutouts 130C. The individual cutouts 130C may be at least 2 mm wide (in the anterior-to-posterior direction), and in some examples, from 2 mm to 15 mm wide, from 2.5 mm to 12 mm wide, or even from 3 mm to 8 mm wide. The individual cutouts 130C may be at least 2 mm tall (in the top-to-bottom direction), and in some examples, from 2 mm to 20 mm tall, from 3 mm to 16 mm tall, or even from 4 mm to 12 mm tall. When multiple cutouts 130C are provided in a medial sidewall 130S of a second outsole component 130, the cutouts 130C may have the same or different sizes, shapes, etc. A sole structure 104 according to some examples of this technology may include any one or more of the above noted cutouts 130C, and/or the cutout(s) 130C may be provided in any one or more of the positions and/or ranges of positions described in more detail below.

In the example of FIG. 1A: (a) at least a portion of the rearmost medial sidewall cutout 130C in the medial sidewall 130S of second outsole component 130 is located at about 0.65 L, (b) at least a portion of the next forward or rear intermediate medial sidewall cutout 130C is located at about 0.71 L, (c) at least a portion of the next forward or forward intermediate medial sidewall cutout 130C is located at about 0.77 L, and (d) at least a portion of the forwardmost medial sidewall cutout 130C is located at about 0.83 C. Other longitudinal arrangements and/or spacings of cutouts 130C are possible without departing from this technology. As some examples, at least some portions of one or more medial sidewall 130S cutouts 130C may be located within the various ranges shown in Table 1 below.

As noted above, the ground-facing surface 142G of the midsole 140 (and first midsole component 140A in the illustrated example) includes one or more relatively deep flexion grooves 142W, 142X, 142Y, and 142Z that extend across (e.g., completely across) the first midsole component 140A in a generally lateral heel-to-medial forefoot direction. Additional features of the sole structure 104 may combine with these flexion grooves 142W-142Z to enhance desired flexibility and support various urban dance moves. For example, as shown in FIGS. 1C and 2D (and others), the outsole component (e.g., either or both of outsole components 120, 130) may have at least one slit defined completely through it (from its upper-facing surface to its ground-facing surface 120G) that extends from an outermost lateral perimeter side edge of the outsole component (e.g., first outsole component 120) toward but not completely to the forefoot medial sidewall 130S outer surface. In the illustrated example, the first outsole component 120 includes two slits 126A and 126B (with slit 126A forward of slit 126B). Because the slits 126A and 126B do not extend to and through the sidewall 130S in this example, the overall outsole includes a forward outsole component part 128 (formed as a single piece including first outsole component 120 and second outsole component 130 fixed together) that extends from the forwardmost toe FT location to a rearmost end 128E or rear edge located generally in the midfoot region of the overall sole structure 104. The slit(s) 126A and/or 126B may extend in a generally lateral heel-to-medial forefoot direction for any desired distance. As some more specific examples, either or both of the slit(s) 126A and/or 126B may have a length dimension of at least 50 mm inward from the lateral perimeter edge of the outsole to their closed ends 126E, and in some examples, at least 40 mm, at least 60 mm, at least 75 mm, at least 80 mm, at least 90 mm, or even at least 100 mm. In some structures, the closed end(s) 126E will be located less than 25 mm (and in some examples, less than 20 mm, less than 15 mm, or even less than 10 mm) from the medial sidewall 130S).

As further shown in FIGS. 1C and 2D, the outsole of this example further includes: (a) an intermediate outsole component part 128B, e.g., located rearward and spaced from the forward outsole component part 128 by a first gap 128G1 and (b) a rearward outsole component part 128C, e.g., located rearward and spaced from the intermediate outsole component part 128B by a second gap 128G2. More or fewer outsole component parts may be included in an overall sole structure 104, if desired (e.g., two or more of parts 128, 128B, and/or 128C may be formed or joined together as a single part (e.g., joined at either or both perimeter edges, etc.)).

When the sole structure 104 is oriented on a horizontal surface on its ground-facing surface 120G in an unloaded condition, the slits 126A, 126B, and gaps 128G1 and 128G2 of the outsole are located to vertically align with the grooves 142Z, 142Y, 142X, and 142W, respectively, of the midsole 140 (first midsole component 140A, in this illustrated example). Thus, in this manner, the ground-facing surface 142G of the midsole 140 is visible and exposed at the bottom of the sole structure 104 in the slits 126A, 126B, and the gaps 128G1, 128G2, as shown in FIG. 1C. Additionally or alternatively, the ground facing surface 144G of the second midsole component 140B (when present) also may be visible and exposed at the bottom of the sole structure in at least some of the slits 126A, 126B, and/or the gaps 128G1, 128G2.

In the specific structure shown in FIG. 1C, the midsole grooves (e.g., 142W to 142Z) have the following features: (a) rearmost flexion groove's lateral edge (e.g., shown by star I) is located at 0.24 L, (b) rearmost flexion groove's medial edge (e.g., shown by star J) is located at 0.32 L, (c) rear intermediate flexion groove's lateral edge (e.g., shown by star K) is located at 0.36 L, (d) rear intermediate flexion groove's medial edge (e.g., shown by star L) is located at 0.44 L, (e) forward intermediate flexion groove's lateral edge (e.g., shown by star M) is located at 0.5 L, (f) forward intermediate flexion groove's medial edge (e.g., shown by star N) is located at 0.63 L, (g) forwardmost flexion groove's lateral edge (e.g., shown by star O) is located at 0.78 L, and (h) forwardmost flexion groove's medial edge (e.g., shown by star P) is located at 0.78 L. Additionally or alternatively, when made from a multi-part construction, the outsole may have the following features: (a) rear outsole component part 128C's forward lateral edge (e.g., shown by star I) is located at 0.24 L, (b) rear outsole component part 128C's forward medial edge (e.g., shown by star J) is located at 0.32 L, (c) middle outsole component part 128B's forward lateral edge (e.g., shown by star K) is located at 0.36 L, (d) middle outsole component part 128B's forward medial edge (e.g., shown by star L) is located at 0.44 L, (e) rear outsole slit 126B's lateral edge (e.g., shown by star M) is located at 0.5 L, (f) rear outsole slit 126B's medial edge at closed end 126E (e.g., shown by star N) is located at 0.63 L, (g) forward outsole slit 126A's lateral edge (e.g., shown by star O) is located at 0.72 L, and (h) forward outsole slit 126A's medial edge at closed edge 126E (e.g., shown by star P) is located at 0.78 L. As some additional examples, however, these groove edge locations, outsole edge locations, slit edge locations, and/or closed end locations may be located within the various ranges shown in Table 1 below.

As evident from the description above and FIGS. 1C, 2D, and 3D, the midsole grooves 142W to 142Z, slits 126A, 126B, and outsole gaps 128G1, 128G2 generally are angled with respect to the sole length dimension L (which is oriented perpendicular to and extending directly between the vertical planes VP located at the rear heel RH and forward toe FT locations). In the specifically illustrated example of FIG. 1C: (a) groove 142W and/or gap 128G2 is/are oriented at an angle of about 111 degrees from the L direction (angle A1), (b) groove 142X and/or gap 128G1 is/are oriented at an angle of about 111 degrees from the L direction (angle A2), (c) groove 142Y and/or slit 126B is/are oriented at an angle of about 115 degrees from the L direction (angle A3), and (d) groove 142Z and/or slit 126A is/are oriented at an angle of about 104 degrees from the L direction (angle A4). As some additional examples, however, these angles may be within the various ranges shown in Table 1 below. These angles, slits, gaps, and discrete parts help provide desired flexibility and foot support for the overall sole structure 104, e.g., for various urban dance moves and uses.

Still additional or alternative flex and foot support features may be incorporated into sole structures 104 in accordance with at least some examples of this technology. As shown in FIGS. 1E, 1G-1J, and 4E-4H, the midsole component 140 (and in the illustrated example, the second (or lateral side) midsole component 140B) includes a plurality of relatively deep, inwardly extending slits in the lateral wall 144L. A first forefoot slit 148F1 is shown in FIGS. 1G, 1H, 4E, and 4F, and a first rear slit 148R1 is shown in FIGS. 1E, 1I, 1J, 4G, and 4H. Additionally or alternatively, if desired, as shown in these figures, a second forefoot slit 148F2 and a second rear slit 148R2 may be provided in the lateral wall 144L. While the second slits 148F2 and/or 148R2 may be defined completely in the material of the midsole component 140 (like slits 148F1 and 148R1 are defined in midsole component 140B), in the illustrated example, the ground-facing surface 144G of the second midsole component 140B includes recessed surfaces 148FR and 148RR, and the slits 148F2 and/or 148R2 are defined between the recessed surfaces 148FR and 148RR and the upper-facing surface 142U of the first midsole component 140A or another sole component, such as first outsole component 120 (e.g., FIGS. 1G and 1H show that the slit 148F2 is defined in part between the recessed surface 148FR of the second midsole component 140B and the upper-facing surface of the first outsole component 120 along the extreme lateral edge of the sole structure 104). Any number of these relatively deep, inwardly extending slits may be included in a sole structure 104 and/or midsole 140 without departing from this technology. In the illustrated example, slits 148F2 and 148R2 are spaced vertically below slits 148F1 and 148R1, respectively.

In this illustrated example, the lateral sidewall 144 extends at least from a heel region to a midfoot region of the sole structure 104, and the inwardly extending slit 148R1 and/or inwardly extending slit 148R2 is/are defined in the lateral sidewall 144 (or between surfaces of sole structure components 104) extending continuously from the heel region to the midfoot region. Additionally or alternatively, the lateral sidewall 144 extends at least in a forefoot region of the sole structure 104, and the inwardly extending slit 148F1 and/or inwardly extending slit 148F2 is/are defined in the lateral sidewall 144 (or between surfaces of sole structure components 104) extending continuously in the forefoot region. The forefoot inwardly extending slits 148F1 and/or 148F2 (and the lateral sidewall 144 containing/defining them) may be formed as part of the same individual sole structure 104 component(s) as the rear inwardly extending slits 148R1 and/or 148R2 (and the lateral sidewall 144 containing/defining them), or they may be formed in or defined by different sole structure 104 components or parts.

As mentioned above, the slits 148F1, 148F2, 148R1, and/or 148R2 are relatively deep. In at least some examples of this technology, one or more of the slits 148F1, 148F2, 148R1, and/or 148R2 may extend inward (dimension W in FIGS. 4E-4H) for at least 6 mm, and in some examples, at least 8 mm, between 6 mm and 20 mm, between 8 mm and 15 mm, etc.). The height dimension may be less than the width dimension, e.g., less than 5 mm, less than 3 mm, or even less than 2 mm. The width dimension W and the height dimension may vary over an overall length of the individual slits 148F1, 148F2, 148R1, and/or 148R2. In some examples, the W/H ratio at a specific location along the slit(s) 148F1, 148F2, 148R1, and/or 148R2 may be within a range of: 3 to 20, 4 to 16, and/or even 5 to 12. This W/H ratio may be applicable over at least a majority of the length of the slit(s) 148F1, 148F2, 148R1, and/or 148R2, and in some examples, over at least 60%, at least 75%, at least 80%, at least 90%, at least 95%, or even over 100% of the length of the slit(s) 148F1, 148F2, 148R1, and/or 148R2.

In the example illustrated in FIG. 1B: (a) rear slit(s) 148R1 and/or 148R2 rear origin point is/are shown at line 200 located at 0.03 L, (b) rear slit(s) 148R1 and/or 148R2 forward origin point is/are shown at line 202 located at 0.51 L, (c) forefoot slit(s) 148F1 and/or 148F2 rear origin point is/are shown at line 204 located at 0.57 L, and (d) forefoot slit(s) 148F1 and/or 148F2 forward origin point is/are shown at line 206 located at 0.87 L. As some additional examples, however, these slit origin points may be located within the various ranges shown in Table 1 below.

The slit(s) 148F1, 148F2, 148R1, and/or 148R2, when present, provide an initial soft feel when force is applied to collapse the slit(s) 148F1, 148F2, 148R1, and/or 148R2 in their height dimension over the lateral edge of the wearer's foot. The width dimension W controls the proportion of the lateral edge of the foot that benefits from the presence of the slit(s) 148F1, 148F2, 148R1, and/or 148R2. The vertical height of the slit(s) 148F1, 148F2, 148R1, and/or 148R2 control the extent of vertical displacement and/or impact force attenuation (e.g., when the slit fully collapses, impact force is attenuated due to the interfacing surfaces of the midsole 140 at the top and bottom of the slit(s)). While not shown, the medial side may include one or more similar relatively deep inwardly extending slits of this type, e.g., having any of the dimensional and/or locational features described for slits 148F1, 148F2, 148R1 and/or 148R2.

Additional aspects of this technology relate to sole structures for articles of footwear that include one or more sole components having a plurality of flexure promoting structures having with any one or more of the properties and/or parameter values set forth in in Table 1 below:

TABLE 1

| Parameter | Value A | Value B | Value C |
|---|---|---|---|
| Rearmost Medial Sidewall Cutout 130C Location* | Between 0.55 L and 0.75 L | Between 0.6 L and 0.7 L | Between 0.62 L and 0.68 L |
| Rear Intermediate Medial Sidewall Cutout 130C Location* | Between 0.61 L and 0.81 L | Between 0.66 L and 0.76 L | Between 0.68 L and 0.74 L |
| Forward Intermediate Sidewall Cutout 130C Location* | Between 0.67 L and 0.87 L | Between 0.71 L and 0.83 L | Between 0.73 L and 0.81 L |
| Forwardmost Medial Sidewall Cutout 130C Location* | Between 0.73 L and 0.93 L | Between 0.78 L and 0.89 L | Between 0.8 L and 0.87 L |
| Rearmost Lateral Sidewall Cutout 144C Location* | Between 0.55 L and 0.75 L | Between 0.6 L and 0.7 L | Between 0.62 L and 0.68 L |
| Rear Intermediate Lateral Sidewall Cutout 144C Location* | Between 0.61 L and 0.81 L | Between 0.66 L and 0.76 L | Between 0.68 L and 0.74 L |
| Forward Intermediate Lateral Sidewall Cutout 144C Location* | Between 0.67 L and 0.87 L | Between 0.71 L and 0.83 L | Between 0.73 L and 0.81 L |
| Forwardmost Lateral Sidewall Cutout 144C Location* | Between 0.73 L and 0.93 L | Between 0.78 L and 0.89 L | Between 0.8 L and 0.87 L |
| Rearward Midsole Flexion Groove Lateral Edge (Star I, FIG. 1C) | Between 0.14 L and 0.34 L | Between 0.18 L and 0.3 L | Between 0.2 L and 0.28 L |
| Rearward Midsole Flexion Groove Medial Edge (Star J, FIG. 1C) | Between 0.22 L and 0.42 L | Between 0.26 L and 0.39 L | Between 0.29 L and 0.36 L |
| Rear Intermediate Midsole Flexion Groove Lateral Edge (Star K, FIG. 1C) | Between 0.26 L and 0.46 L | Between 0.3 L and 0.42 L | Between 0.32 L and 0.4 L |
| Rear Intermediate Midsole Flexion Groove Medial Edge (Star L, FIG. 1C) | Between 0.34 L and 0.54 L | Between 0.37 L and 0.51 L | Between 0.4 L and 0.47 L |
| Forward Intermediate Midsole Flexion Groove Lateral Edge (Star M, FIG. 1C) | Between 0.4 L and 0.6 L | Between 0.43 L and 0.57 L | Between 0.46 L and 0.54 L |
| Forward Intermediate Midsole Flexion Groove Medial Edge (Star N, FIG. 1C) | Between 0.53 L and 0.73 L | Between 0.57 L and 0.7 L | Between 0.59 L and 0.67 L |
| Forward Midsole Flexion Groove Lateral Edge (Star O, FIG. 1C) | Between 0.61 L and 0.82 L | Between 0.65 L and 0.78 L | Between 0.68 L and 0.75 L |
| Forward Midsole Flexion Groove Medial Edge (Star P, FIG. 1C) | Between 0.68 L and 0.9 L | Between 0.7 L and 0.86 L | Between 0.72 L and 0.83 L |
| Rear Outsole Component Part 128C Forward Lateral Edge | Between 0.14 L and 0.34 L | Between 0.18 L and 0.3 L | Between 0.2 L and 0.28 L |
| Rear Outsole Component Part 128C Forward Medial Edge | Between 0.22 L and 0.42 L | Between 0.26 L and 0.39 L | Between 0.29 L and 0.36 L |
| Middle Outsole Component Part 128B Forward Lateral Edge | Between 0.26 L and 0.46 L | Between 0.3 L and 0.42 L | Between 0.32 L and 0.4 L |
| Middle Outsole Component Part 128B Forward Medial Edge | Between 0.33 L and 0.53 L | Between 0.36 L and 0.5 L | Between 0.39 L and 0.46 L |
| Rear Outsole Slit 126B Lateral Edge | Between 0.4 L and 0.6 L | Between 0.43 L and 0.57 L | Between 0.46 L and 0.54 L |
| Rear Outsole Slit 126B Medial Edge or Closed End 126E | Between 0.53 L and 0.73 L | Between 0.57 L and 0.7 L | Between 0.59 L and 0.67 L |
| Forward Outsole Slit 126A Lateral Edge | Between 0.61 L and 0.82 L | Between 0.65 L and 0.78 L | Between 0.68 L and 0.75 L |
| Forward Outsole Slit 126A Medial Edge or Closed End 126E | Between 0.68 L and 0.9 L | Between 0.7 L and 0.86 L | Between 0.72 L and 0.83 L |
| Groove 142W and/or Gap 128G2 Angle from L Direction | Between 95 degrees and 125 degrees | Between 100 degrees and 122 degrees | Between 104 degrees and 118 degrees |
| Groove 142X and/or Gap | Between 95 | Between 100 | Between 104 |

TABLE 1-continued

| Parameter | Value A | Value B | Value C |
|---|---|---|---|
| 128G1 Angle from L Direction | degrees and 125 degrees | degrees and 122 degrees | degrees and 118 degrees |
| Groove 142Y and/or Slit | Between 100 | Between 105 | Between 110 |
| 126B Angle from L Direction | degrees and 130 degrees | degrees and 127 degrees | degrees and 120 degrees |
| Groove 142Z and/or Slit | Between 94 | Between 96 | Between 98 |
| 126A Angle from L Direction | degrees and 122 degrees | degrees and 116 degrees | degrees and 110 degrees |
| Rear Slit(s) 148R1 and/or 148R2 Rear Origin Point | Rearward of 0.2 L | Rearward of 0.15 L | Rearward of 0.1 L |
| Rear Slit(s) 148R1 and/or 148R2 Rear Origin Point | Between 0 L and 0.2 L | Between 0.01 L and 0.15 L | Between 0.02 L and 0.1 L |
| Rear Slit(s) 148R1 and/or 148R2 Forward Origin Point | Forward of 0.25 L | Forward of 0.3 L | Forward of 0.4 L |
| Rear Slit(s) 148R1 and/or 148R2 Forward Origin Point | Between 0.25 L and 0.65 L | Between 0.35 L and 0.62 L | Between 0.4 L and 0.6 L |
| Forefoot Slit(s) 148F1 and/or 148F2 Rear Origin Point | Between 0.5 L and 0.75 L | Between 0.52 L and 0.7 L | Between 0.54 L and 0.66 L |
| Forefoot Slit(s) 148F1 and/or 148F2 Forward Origin Point | Rearward of 0.98 L | Rearward of 0.95 L | Rearward of 0.92 L |
| Forefoot Slit(s) 148F1 and/or 148F2 Forward Origin Point | Between 0.72 L and 0.98 L | Between 0.76 L and 0.95 L | Between 0.82 L and 0.92 L |

*At least some portion of the noted cutouts, but not necessarily the entire cutout, will be located within the noted ranges Such sole structures including one or more sole components with a plurality of flexure promoting structures having any one or more of the properties and/or parameter values set forth in in Table 1 above further may include outsole component(s) having the combination of two different outsole hardness (and therefore slickness) features described above and/or any of the structures described above providing these different outsole hardness (and therefore slickness) features.

Figure 6A:
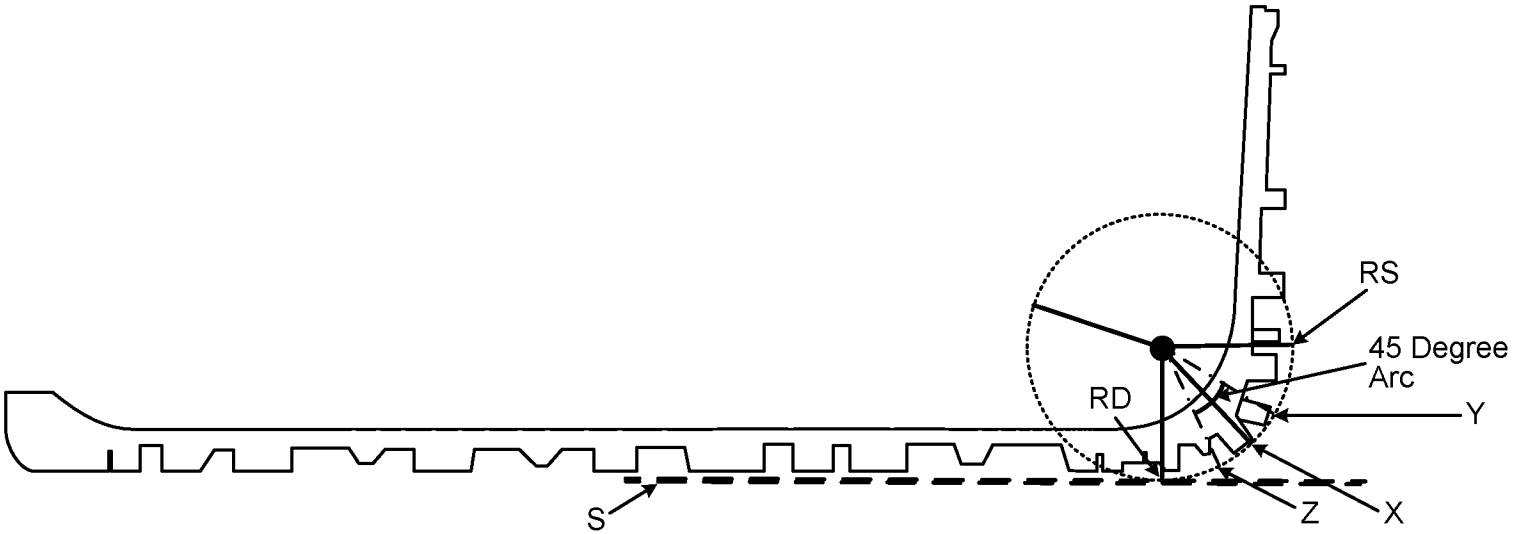
FIGS. 6A and 6B provide various views to illustrate bottom-to-sidewall transition region and curvature features in accordance with at least some examples of this technology.
Figure 6B:
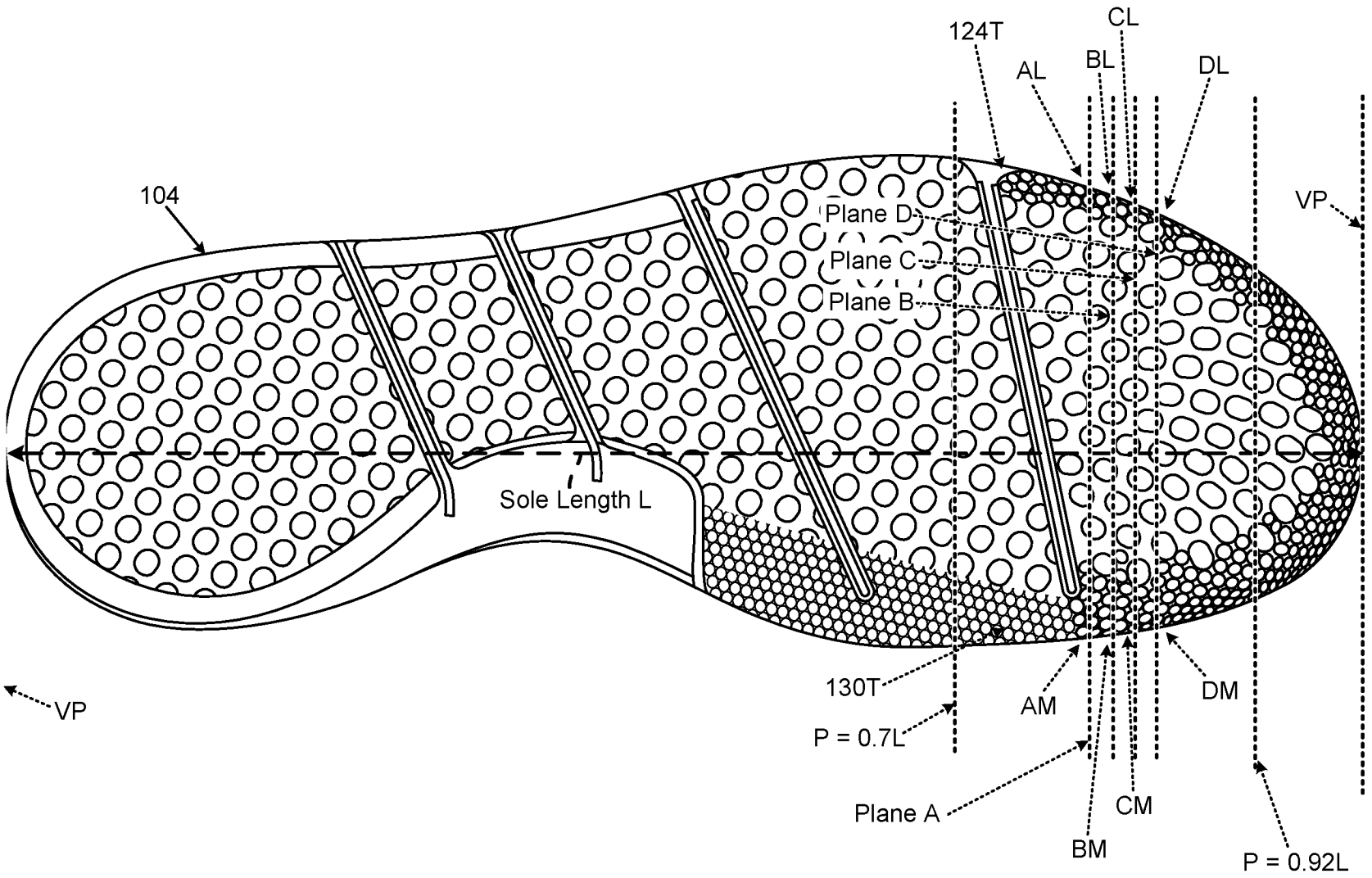

As described above and illustrated in more detail in conjunction with FIGS. 6A and 6B, the "first curvature" of the medial transition region 130T in sole structures 104 in accordance with at least some aspects of this technology may extend in the anterior-to-posterior direction of the sole structure 104 for at least 25 mm, at least 30 mm, at least 35 mm, at least 40 mm, at least 50 mm, at least 60 mm, at least 70 mm, or even at least 80 mm. These first curvature features may be provided, for example, within ranges of parallel planes located at P=0.7 L and P=0.92 L, or even between planes located at P=0.72 L and P=0.9 L, or between planes located at 0.75 L and 0.88 L. Similarly, the "corner" or "second curvature" of the lateral transition region 124T in sole structures 104 in accordance with at least some aspects of this technology may extend continuously in the anterior-to-posterior direction of the sole structure for a distance of at least 25 mm, at least 30 mm, at least 35 mm, at least 40 mm, at least 50 mm, at least 60 mm, at least 70 mm, or even at least 80 mm. These corner or second curvature features may be provided, for example, within ranges of parallel planes located at P=0.7 L and P=0.92 L, or even between planes located at P=0.72 L and P=0.9 L, or between planes located at 0.75 L and 0.88 L. Further: (a) the first curvature of the medial transition region 130T may be greater than a 5 mm radius (and in some examples, greater than a radii of at least 5.5 mm, at least 6 mm, and/or even at least 6.5 mm) over any of the above noted distance ranges and/or between any of the noted sets of parallel planes, and/or (b) the corner or the second curvature of the lateral transition region 124T may be less than a 5 mm radius (and in some examples, less than a radii of 4.75 mm, 4.5 mm, or even 4.25 mm) over any of the above noted distance ranges and/or between any of the noted sets of parallel planes.

The following describes how a "transition region" can be located and/or how it can be determined whether the "curvature" of that transition region is greater than or less than a predetermined radii. A "transition region" may be considered the region of a sole around its edge from the bottom surface to the sidewall surface of sole component 104 (e.g., from surface 120G to the sidewall surface(s) 124 and/or 130S of the sole component 104). The "transition region" may be determined as the region between the location of the sole structure 104 where: (a) a first tangent to the sidewall surface becomes more horizontal than vertical (moving downward from the top of the sidewall surface) and (b) a second tangent to the sidewall surface (at the same transverse cross sectional location) becomes more vertical than horizontal (moving upward from the bottom of the sole surface). If a specific sole structure design has a designed in, determinable, and/or measurable radius for a given cross sectional location on the sole structure 104 (e.g., from a CAD file design), that radius will correspond to the sole structure 104's radius at that transition region location. In that event, the designed in, determined, and/or measured radius can be compared to the predetermined radius of interest to see if the designed in, determined, and/or measured radius is greater than or less than the predetermined radius of interest.

FIG. 6A illustrates how a "transition region" can be located (e.g., if needed for a specific sole structure) and/or how it can be determined whether the "curvature" of that transition region is greater than or less than a predetermined radii (e.g., if needed for a specific sole structure transition region). First, the ground-facing surface 120G of a sole structure 104 is oriented on a horizontal base surface S with the transverse cross sectional location of the sole structure 104 at the plane location where measurement is desired. A circle with the radius of interest R (e.g., corresponding to the radius of curvature limitation being considered) is defined having a downward vertical radius point RD and a horizontally sideways radius point RS. A central 45 degree arc is located between the downward radius point RD and the sideways radius point RS, shown as the arc between points Y and Z in FIG. 6A. This 45 degree arc represents a "transition area" between the locations on the circle where an upper tangent to the arc becomes more horizontal than vertical (at point Y) and a lower tangent to the arc becomes more vertical than horizontal (at point Z). If the center of the central 45 degree arc (Point X) can be located on the outer surface of the sole structure and the entire surface of the sole structure lies on the central 45 degree arc between points Y and Z, then the transition region of that sole structure has the predetermined radius R. If the center of the central 45 degree arc (Point X) can be located on the outer surface of the sole structure in the sole structure's transition region and the entire surface of the sole structure lies on or inside the central 45 degree arc between points Y and Z, then the transition region of that sole structure has a curvature that is less than the predetermined radius R. If the sole structure surface extends outside the central 45 degree arc within the transition region of the sole structure, then that sole structure has a curvature greater than the predetermined radius. For sole structure surfaces including small nubs or ridges, the surface of the sole structure may be considered as a smoothed surface joining the outer surfaces of the raised nubs or ridges.

FIG. 6B illustrates some more specific example radii provided along the medial transition region 130T and the lateral transition region 124T in sole structures 104 in accordance with one example of this technology. The transition region 124T, 130T radii at the various parallel plane locations A-D of this example are as shown in Table 2:

TABLE 2

| Point | Parallel Plane Location | Transition Region Radii |
|---|---|---|
| AM | P = 0.797 L | 9 mm |
| AL | P = 0.797 L | 3.35 mm |
| BM | P = 0.815 L | 6.9 mm |
| BL | P = 0.815 L | 3.6 mm |
| CM | P = 0.829 L | 7.3 mm |
| CL | P = 0.829 L | 4.1 mm |
| DM | P = 0.847 L | 8 mm |
| DL | P = 0.847 L | 3.7 mm |

As shown in FIG. 6B and Table 2, the transition region curvature may vary in the posterior-to-anterior direction. Also, the forward toe transition region 132T may vary, e.g., bridging the differences in curvature between the medial sidewall 130S and the lateral sidewall 124.

While these specific examples of transition region radii and parallel plane locations are described for the sole structure 104 of FIG. 6B, sole structures in accordance with at least some examples of this technology may include one or more of the curvature properties described in Table 3 below:

TABLE 3

| Parameter | Parallel Plane Location | Transition Region Curvature |
|---|---|---|
| Medial Transition Region 130T | Forward of P = 0.7 L | >5 mm Radii |
| Medial Transition Region 130T | Forward of P = 0.7 L | >5.5 mm Radii |
| Medial Transition Region 130T | Forward of P = 0.7 L | >6 mm Radii |
| Medial Transition Region 130T | Forward of P = 0.7 L | >6.5 mm Radii |
| Medial Transition Region 130T | Forward of P = 0.72 L | >5 mm Radii |
| Medial Transition Region 130T | Forward of P = 0.72 L | >5.5 mm Radii |
| Medial Transition Region 130T | Forward of P = 0.72 L | >6 mm Radii |
| Medial Transition Region 130T | Forward of P = 0.72 L | >6.5 mm Radii |
| Medial Transition Region 130T | Forward of P = 0.75 L | >5 mm Radii |
| Medial Transition Region 130T | Forward of P = 0.75 L | >5.5 mm Radii |
| Medial Transition Region 130T | Forward of P = 0.75 L | >6 mm Radii |
| Medial Transition Region 130T | Forward of P = 0.75 L | >6.5 mm Radii |
| Medial Transition Region 130T | Between P = 0.7 L and P = 0.92 L | >5 mm Radii |
| Medial Transition Region 130T | Between P = 0.7 L and P = 0.92 L | >5.5 mm Radii |
| Medial Transition Region 130T | Between P = 0.7 L and P = 0.92 L | >6 mm Radii |
| Medial Transition Region 130T | Between P = 0.7 L and P = 0.92 L | >6.5 mm Radii |
| Medial Transition Region 130T | Between of P = 0.72 L and P = 0.9 L | >5 mm Radii |
| Medial Transition Region 130T | Between of P = 0.72 L and P = 0.9 L | >5.5 mm Radii |
| Medial Transition Region 130T | Between of P = 0.72 L and P = 0.9 L | >6 mm Radii |
| Medial Transition Region 130T | Between of P = 0.72 L and P = 0.9 L | >6.5 mm Radii |
| Medial Transition Region 130T | Between of P = 0.75 L and P = 0.88 L | >5 mm Radii |
| Medial Transition Region 130T | Between of P = 0.75 L and P = 0.88 L | >5.5 mm Radii |
| Medial Transition Region 130T | Between of P = 0.75 L and P = 0.88 L | >6 mm Radii |
| Medial Transition Region 130T | Between of P = 0.75 L and P = 0.88 L | >6.5 mm Radii |
| Medial Transition Region 130T | Forward of P = 0.7 L | Between 5 mm and 12 mm Radii |
| Medial Transition Region 130T | Forward of P = 0.7 L | Between 5.5 mm and 11 mm Radii |
| Medial Transition Region 130T | Forward of P = 0.7 L | Between 6 mm and 10.5 mm Radii |
| Medial Transition Region 130T | Forward of P = 0.7 L | Between 6.5 mm and 10 mm Radii |
| Medial Transition Region 130T | Forward of P = 0.72 L | Between 5 mm and 12 mm Radii |
| Medial Transition Region 130T | Forward of P = 0.72 L | Between 5.5 mm and 11 mm Radii |
| Medial Transition Region 130T | Forward of P = 0.72 L | Between 6 mm and 10.5 mm Radii |
| Medial Transition Region 130T | Forward of P = 0.72 L | Between 6.5 mm and 10 mm Radii |
| Medial Transition Region 130T | Forward of P = 0.75 L | Between 5 mm and 12 mm Radii |
| Medial Transition Region 130T | Forward of P = 0.75 L | Between 5.5 mm and 11 mm Radii |
| Medial Transition Region 130T | Forward of P = 0.75 L | Between 6 mm and 10.5 mm Radii |
| Medial Transition Region 130T | Forward of P = 0.75 L | Between 6.5 mm and 10 mm Radii |
| Medial Transition Region 130T | Between P = 0.7 L and P = 0.92 L | Between 5 mm and 12 mm Radii |
| Medial Transition Region 130T | Between P = 0.7 L and P = 0.92 L | Between 5.5 mm and 11 mm Radii |
| Medial Transition Region 130T | Between P = 0.7 L and P = 0.92 L | Between 6 mm and 10.5 mm Radii |
| Medial Transition Region 130T | Between P = 0.7 L and P = 0.92 L | Between 6.5 mm and 10 mm Radii |
| Medial Transition Region 130T | Between of P = 0.72 L and P = 0.9 L | Between 5 mm and 12 mm Radii |

TABLE 3-continued

| Parameter | Parallel Plane Location | Transition Region Curvature |
|---|---|---|
| Medial Transition Region 130T | Between of P = 0.72 L and P = 0.9 L | Between 5.5 mm and 11 mm Radii |
| Medial Transition Region 130T | Between of P = 0.72 L and P = 0.9 L | Between 6 mm and 10.5 mm Radii |
| Medial Transition Region 130T | Between of P = 0.72 L and P = 0.9 L | Between 6.5 mm and 10 mm Radii |
| Medial Transition Region 130T | Between of P = 0.75 L and P = 0.88 L | Between 5 mm and 12 mm Radii |
| Medial Transition Region 130T | Between of P = 0.75 L and P = 0.88 L | Between 5.5 mm and 11 mm Radii |
| Medial Transition Region 130T | Between of P = 0.75 L and P = 0.88 L | Between 6 mm and 10.5 mm Radii |
| Medial Transition Region 130T | Between of P = 0.75 L and P = 0.88 L | Between 6.5 mm and 10 mm Radii |
| Lateral Transition Region 124T | Forward of P = 0.7 L | <5 mm Radii |
| Lateral Transition Region 124T | Forward of P = 0.7 L | <4.75 mm Radii |
| Lateral Transition Region 124T | Forward of P = 0.7 L | <4.5 mm Radii |
| Lateral Transition Region 124T | Forward of P = 0.7 L | <4.25 mm Radii |
| Lateral Transition Region 124T | Forward of P = 0.72 L | <5 mm Radii |
| Lateral Transition Region 124T | Forward of P = 0.72 L | <4.75 mm Radii |
| Lateral Transition Region 124T | Forward of P = 0.72 L | <4.5 mm Radii |
| Lateral Transition Region 124T | Forward of P = 0.72 L | <4.25 mm Radii |
| Lateral Transition Region 124T | Forward of P = 0.75 L | <5 mm Radii |
| Lateral Transition Region 124T | Forward of P = 0.75 L | <4.75 mm Radii |
| Lateral Transition Region 124T | Forward of P = 0.75 L | <4.5 mm Radii |
| Lateral Transition Region 124T | Forward of P = 0.75 L | <4.25 mm Radii |
| Lateral Transition Region 124T | Between P = 0.7 L and P = 0.92 L | <5 mm Radii |
| Lateral Transition Region 124T | Between P = 0.7 L and P = 0.92 L | <4.75 mm Radii |
| Lateral Transition Region 124T | Between P = 0.7 L and P = 0.92 L | <4.5 mm Radii |
| Lateral Transition Region 124T | Between P = 0.7 L and P = 0.92 L | <4.25 mm Radii |
| Lateral Transition Region 124T | Between of P = 0.72 L and P = 0.9 L | <5 mm Radii |
| Lateral Transition Region 124T | Between of P = 0.72 L and P = 0.9 L | <4.75 mm Radii |
| Lateral Transition Region 124T | Between of P = 0.72 L and P = 0.9 L | <4.5 mm Radii |
| Lateral Transition Region 124T | Between of P = 0.72 L and P = 0.9 L | <4.25 mm Radii |
| Lateral Transition Region 124T | Between of P = 0.75 L and P = 0.88 L | <5 mm Radii |
| Lateral Transition Region 124T | Between of P = 0.75 L and P = 0.88 L | <4.75 mm Radii |
| Lateral Transition Region 124T | Between of P = 0.75 L and P = 0.88 L | <4.5 mm Radii |
| Lateral Transition Region 124T | Between of P = 0.75 L and P = 0.88 L | <4.25 mm Radii |
| Lateral Transition Region 124T | Forward of P = 0.7 L | Between a Corner and 5 mm Radii |
| Lateral Transition Region 124T | Forward of P = 0.7 L | Between a Corner and 4.75 mm Radii |
| Lateral Transition Region 124T | Forward of P = 0.7 L | Between a Corner and 4.5 mm Radii |
| Lateral Transition Region 124T | Forward of P = 0.7 L | Between a Corner and 4.25 mm Radii |
| Lateral Transition Region 124T | Forward of P = 0.72 L | Between a Corner and 5 mm Radii |
| Lateral Transition Region 124T | Forward of P = 0.72 L | Between a Corner and 4.75 mm Radii |
| Lateral Transition Region 124T | Forward of P = 0.72 L | Between a Corner and 4.5 mm Radii |
| Lateral Transition Region 124T | Forward of P = 0.72 L | Between a Corner and 4.25 mm Radii |
| Lateral Transition Region 124T | Forward of P = 0.75 L | Between a Corner and 5 mm Radii |
| Lateral Transition Region 124T | Forward of P = 0.75 L | Between a Corner and 4.75 mm Radii |
| Lateral Transition Region 124T | Forward of P = 0.75 L | Between a Corner and 4.5 mm Radii |
| Lateral Transition Region 124T | Forward of P = 0.75 L | Between a Corner and 4.25 mm Radii |
| Lateral Transition Region 124T | Between P = 0.7 L and P = 0.92 L | Between a Corner and 5 mm Radii |
| Lateral Transition Region 124T | Between P = 0.7 L and P = 0.92 L | Between a Corner and 4.75 mm Radii |
| Lateral Transition Region 124T | Between P = 0.7 L and P = 0.92 L | Between a Corner and 4.5 mm Radii |
| Lateral Transition Region 124T | Between P = 0.7 L and P = 0.92 L | Between a Corner and 4.25 mm Radii |
| Lateral Transition Region 124T | Between of P = 0.72 L and P = 0.9 L | Between a Corner and 5 mm Radii |
| Lateral Transition Region 124T | Between of P = 0.72 L and P = 0.9 L | Between a Corner and 4.75 mm Radii |
| Lateral Transition Region 124T | Between of P = 0.72 L and P = 0.9 L | Between a Corner and 4.5 mm Radii |
| Lateral Transition Region 124T | Between of P = 0.72 L and P = 0.9 L | Between a Corner and 4.25 mm Radii |
| Lateral Transition Region 124T | Between of P = 0.75 L and P = 0.88 L | Between a Corner and 5 mm Radii |
| Lateral Transition Region 124T | Between of P = 0.75 L and P = 0.88 L | Between a Corner and 4.75 mm Radii |
| Lateral Transition Region 124T | Between of P = 0.75 L and P = 0.88 L | Between a Corner and 4.5 mm Radii |
| Lateral Transition Region 124T | Between of P = 0.75 L and P = 0.88 L | Between a Corner and 4.25 mm Radii |

Sole structures may include one or more sole components having any one or more of the medial transition region and/or lateral transition region properties and/or parameter values set forth in in Table 3 above. Such sole structures further may include outsole component(s) having the combination of two different outsole hardness (and therefore slickness) features described above, any of the structures described above providing these different outsole hardness (and therefore slickness) features, and/or any one or more of the properties described above in conjunction with Table 1.

FIGS. 7A-9J show various views of an alternative sole structure 104 and component parts thereof in accordance with some examples of this technology. More specifically, FIGS. 7A-7J show various views of an overall sole structure 104, while FIGS. 8A-8J provide various views of the outsole structure (e.g., including outsole component parts 120 and 130) and FIGS. 9A-9J provide various views of a midsole structure (e.g., including component part 140). When the same reference number is used in FIGS. 7A-9J as those used in FIGS. 1A-6B, the same or similar parts are being referred to, and much of the overlapping and/or redundant disclosure is omitted from the discussion of FIGS. 7A-9J. Further, the sole structure 104 of FIGS. 7A-9J may have any of the component parts, features, options, properties, materials, alternatives, additions, and/or the like as described above for the similar sole structure 104 and/or component parts (e.g., 120, 130, 140, 150, 160, etc.) in FIGS. 1A-6B. Additionally or alternatively, the sole structure 104 and/or the component parts (e.g., 120, 130, 140, 150, 160, etc.) thereof shown in FIGS. 7A-9J may have any one or more and/or any combination of the features described above in Tables 1, 2, and/or 3. The sole structure 104 of FIGS. 7A-9J also may be engaged with a footwear upper, e.g., having any of the various materials, structures, properties, parts, features, options, alternatives, additions, etc., as described above for the upper 102 shown in FIGS. 1A-1J.

Figure 7A:
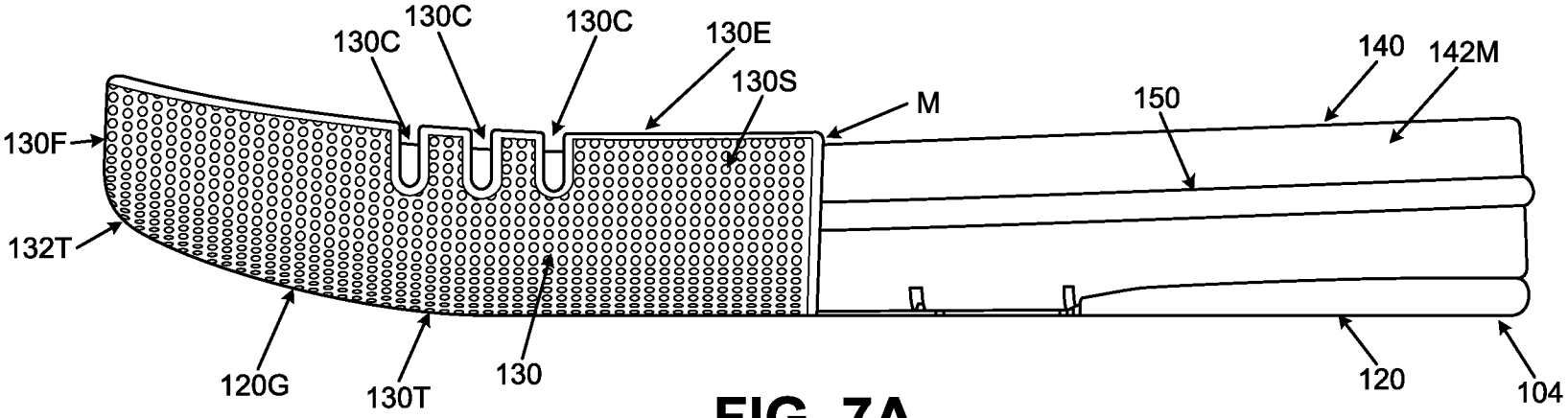
FIGS. 7A-7J provide various views of a sole structure for an article of footwear in accordance with some examples of this technology
Figure 7B:
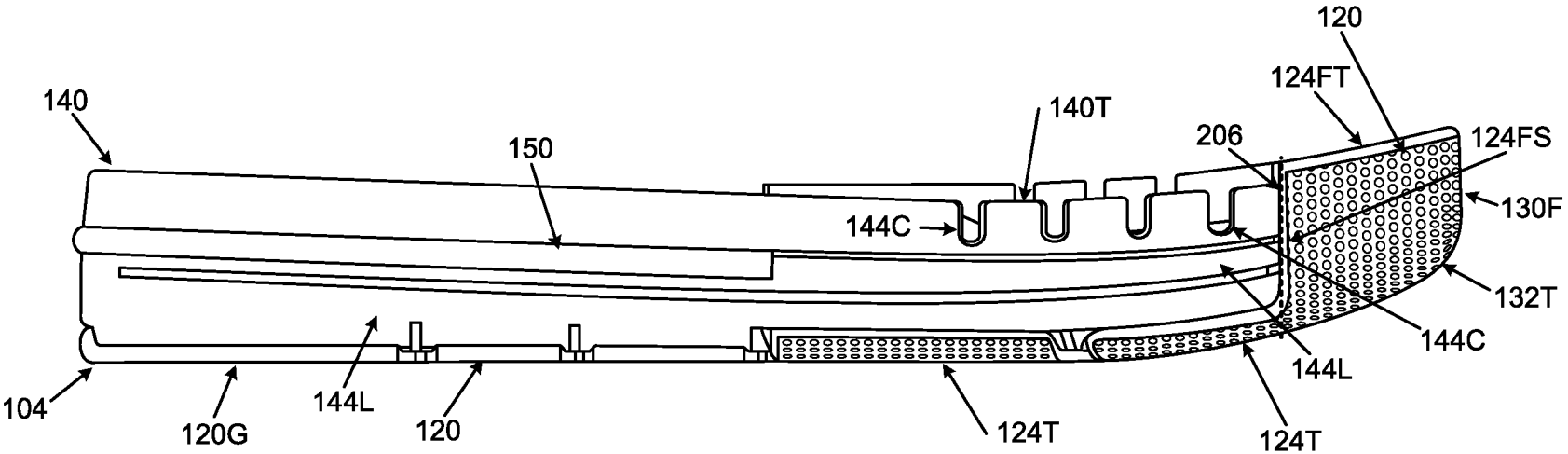
Figure 7C:
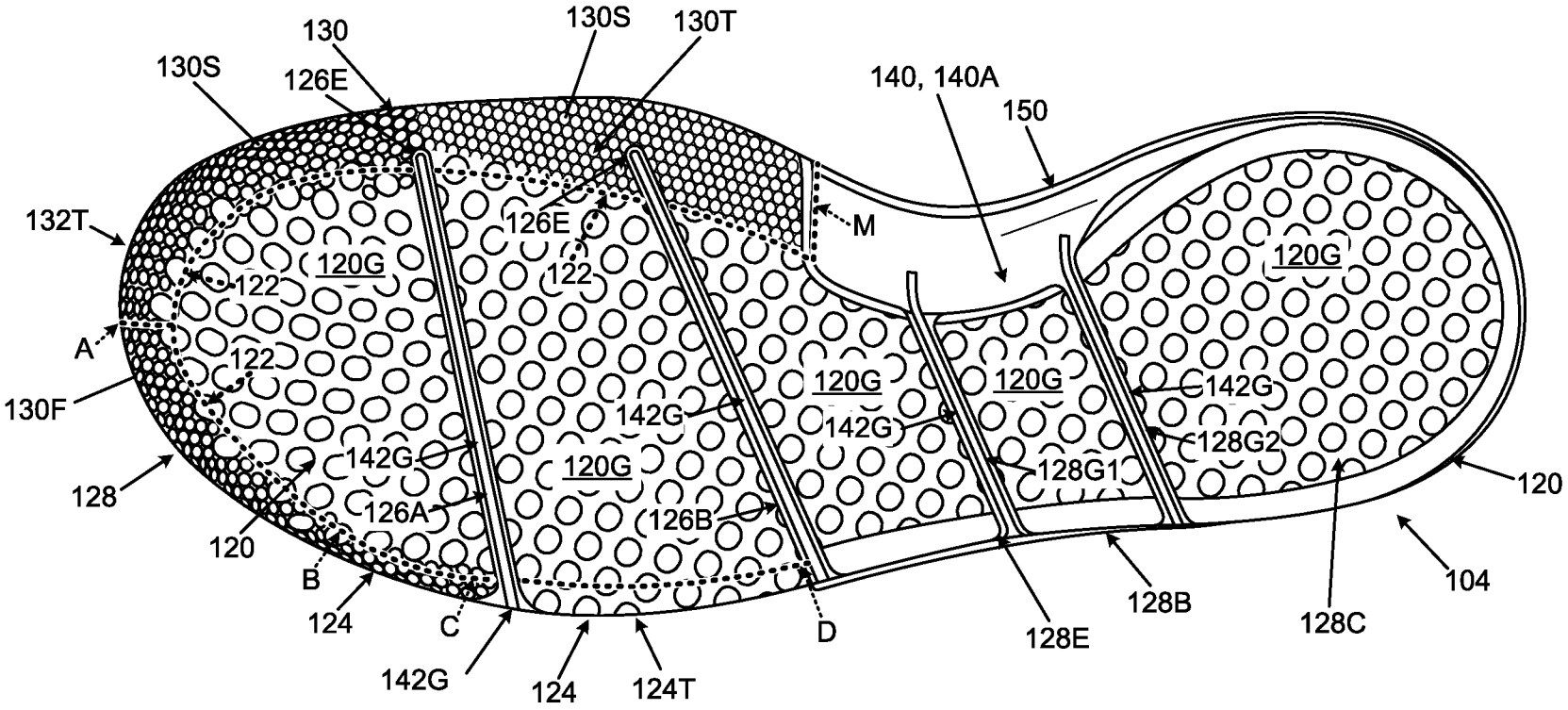
Figure 7D:
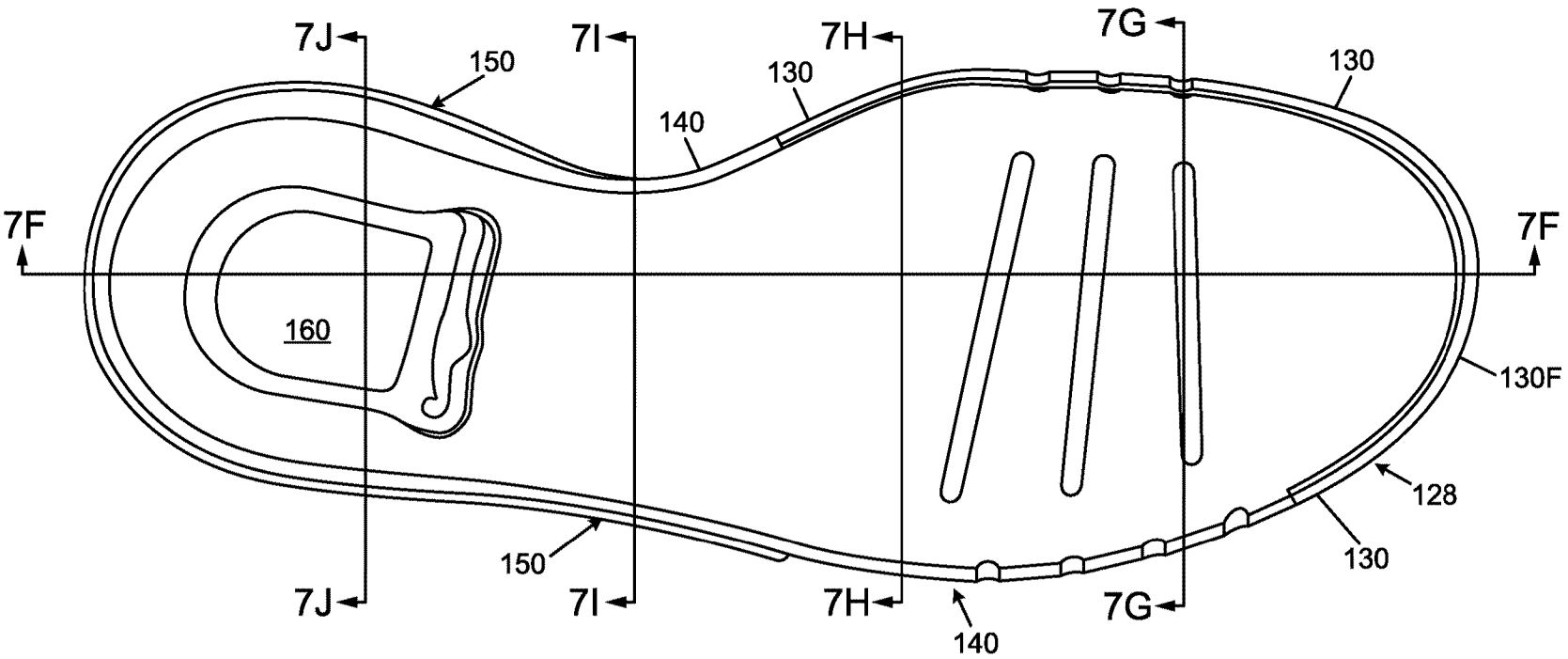
Figure 7E:
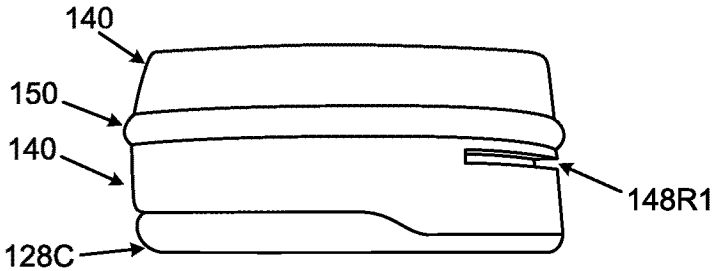
Figure 7F:
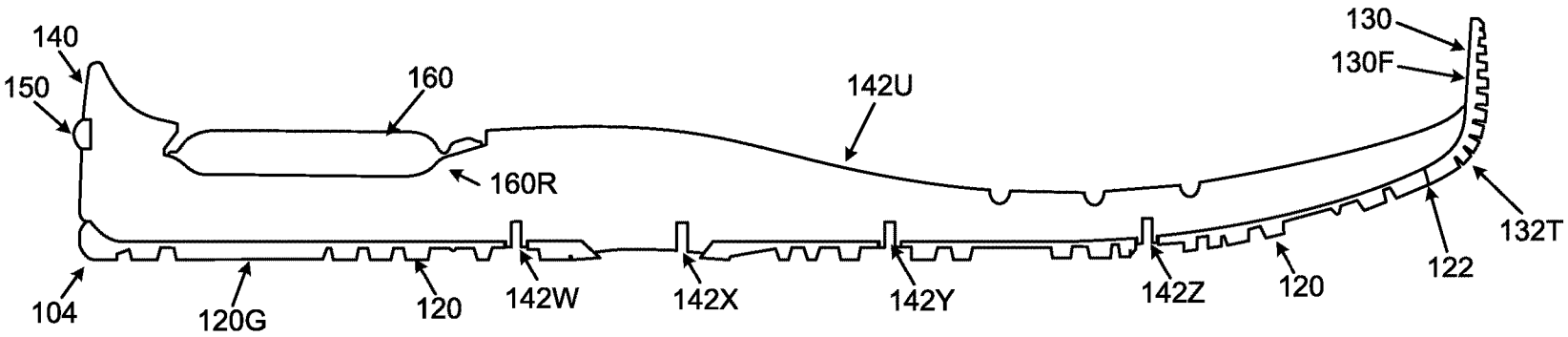
Figure 7H:
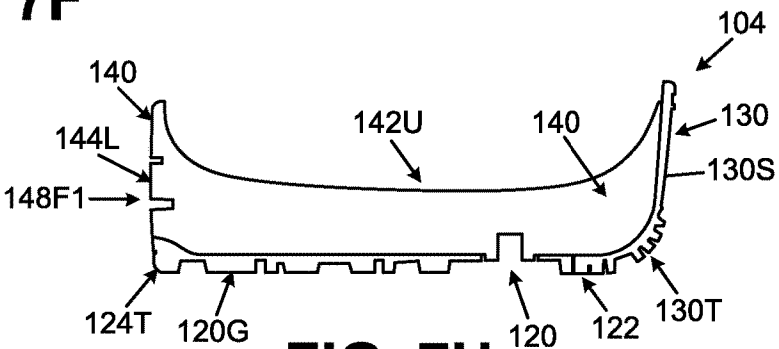
Figure 7J:
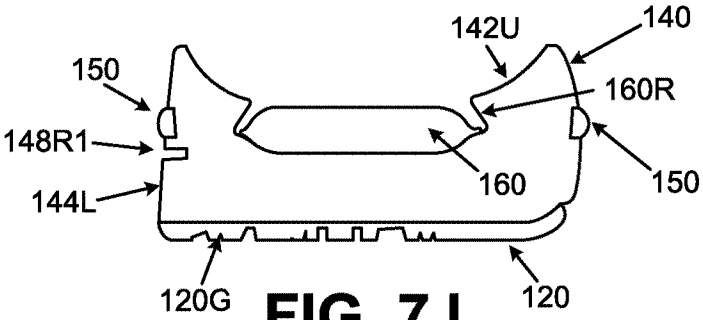
Figure 7G:
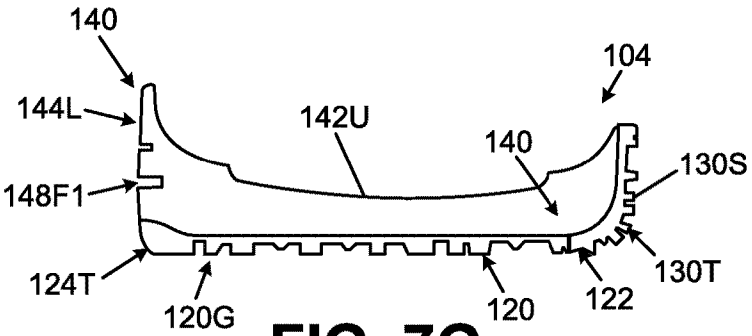
Figure 7I:
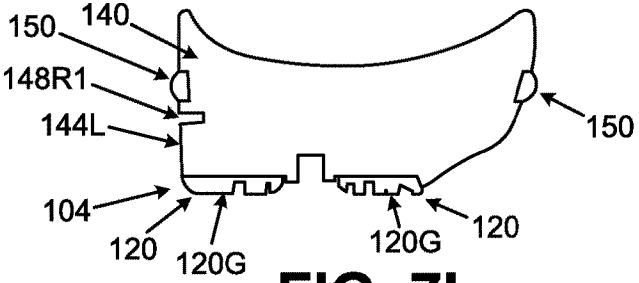
Figure 8A:
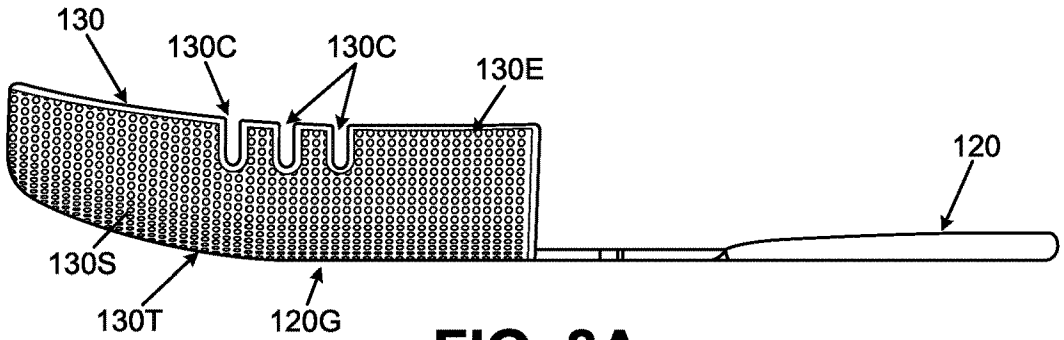
Figure 8B:
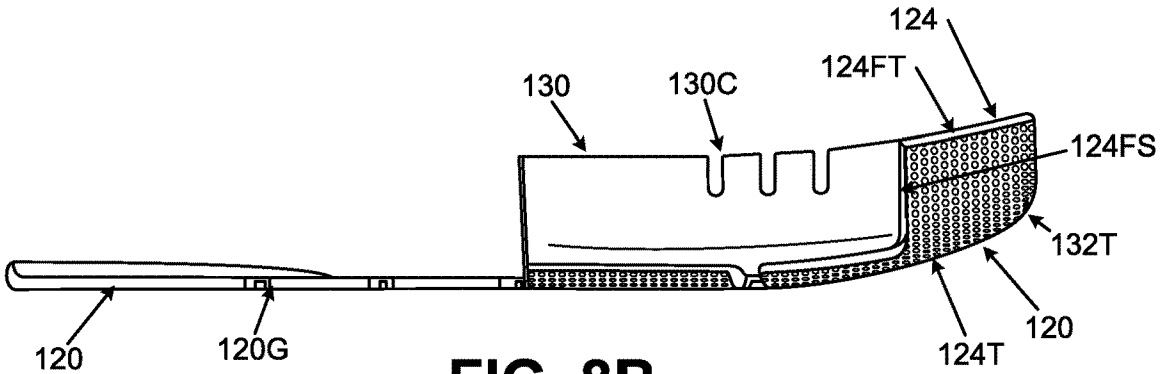
Figure 8C:
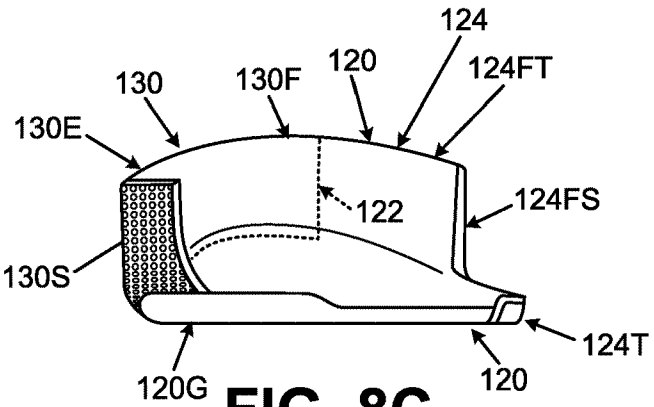
Figure 8E:
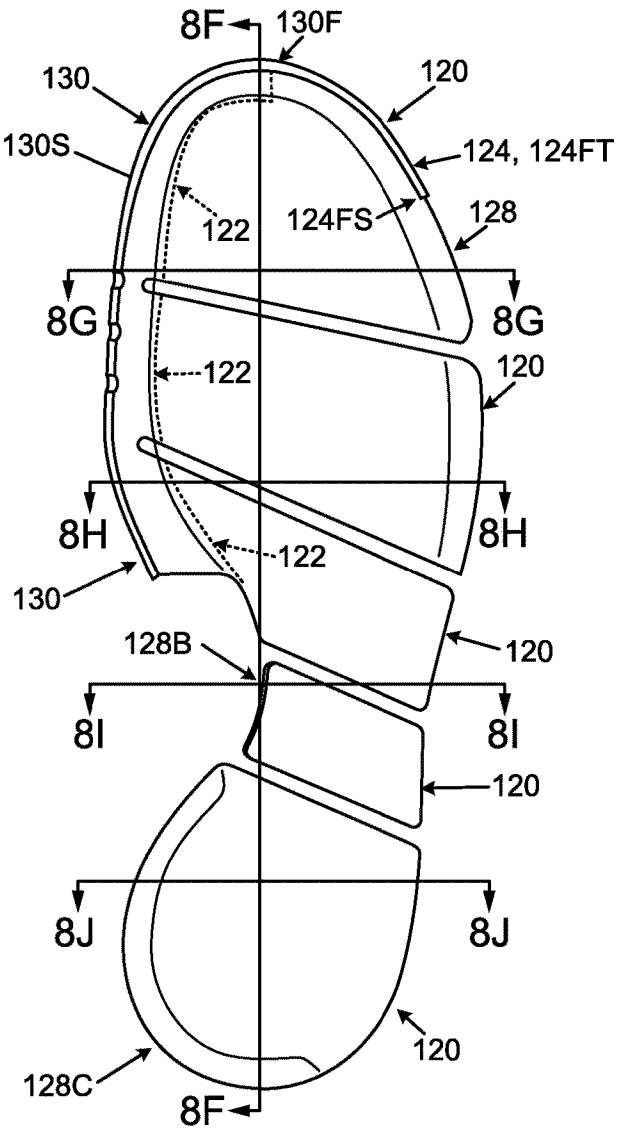
Figure 8D:
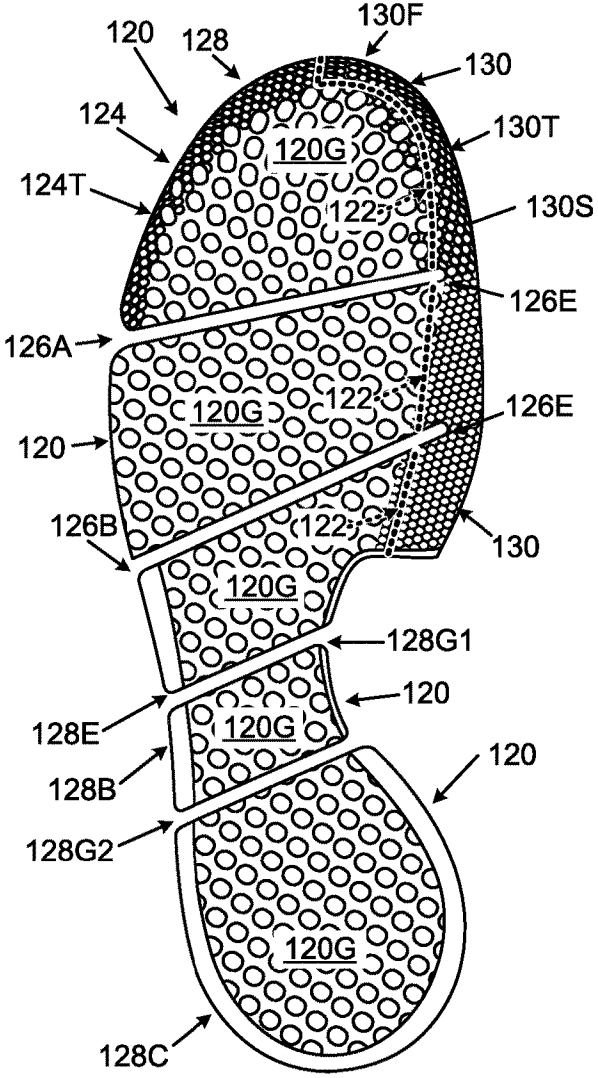
Figure 9D:
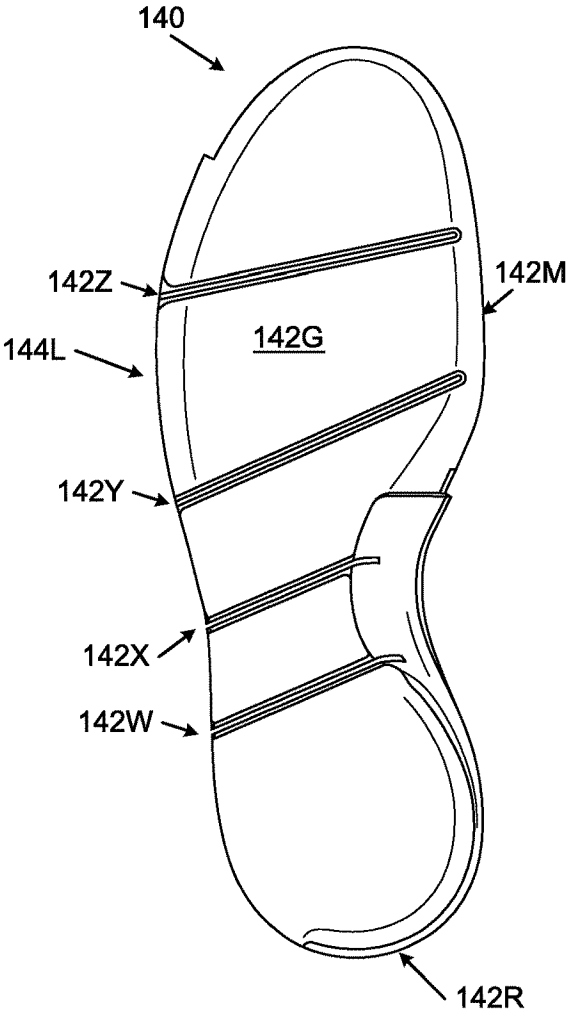
FIGS. 9A-9J provide various views of a midsole component in accordance with some examples of this technology
Figure 9A:
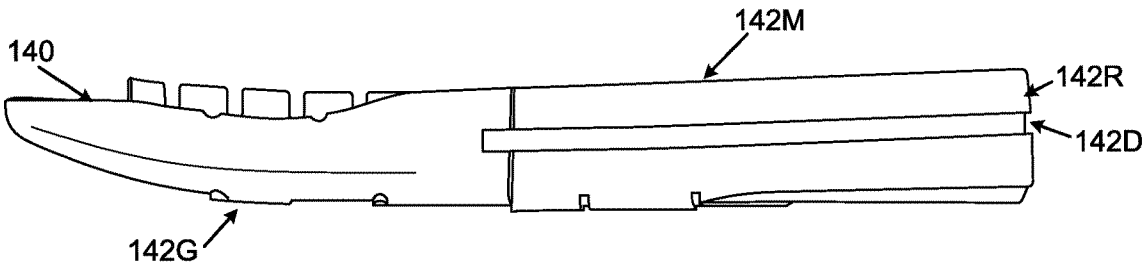
Figure 9B:
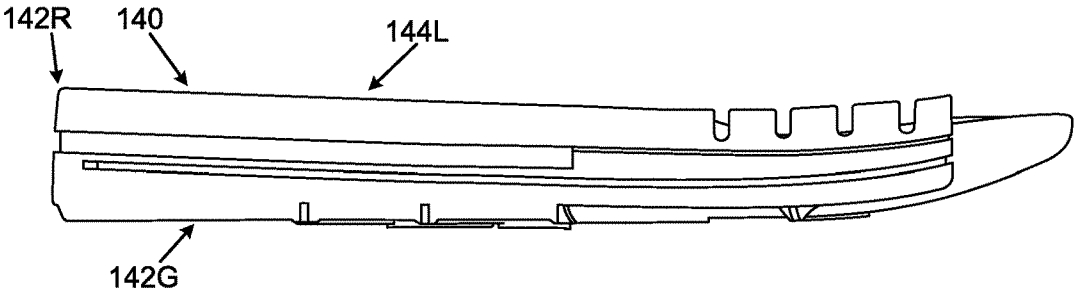
Figure 9C:
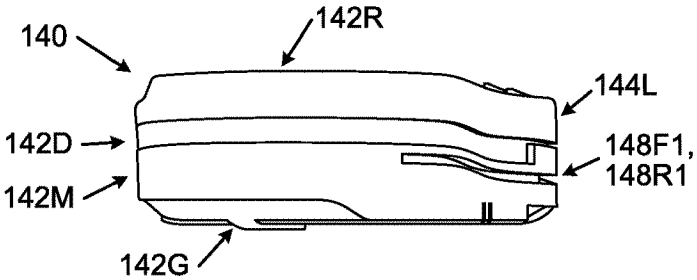
Figure 9G:
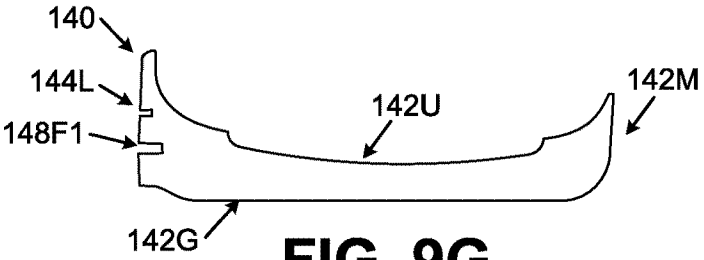
Figure 9H:
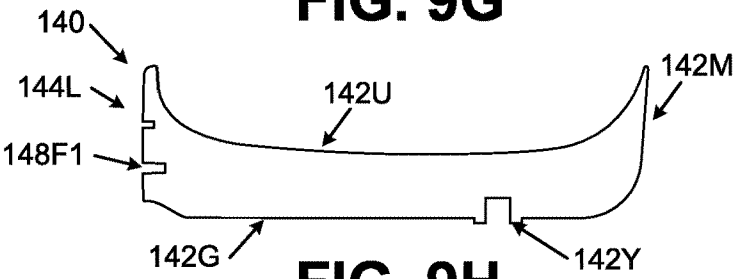
Figure 9I:
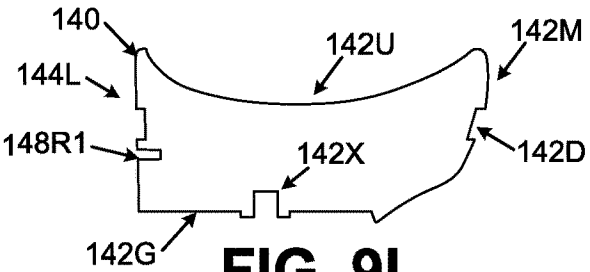
Figure 9J:
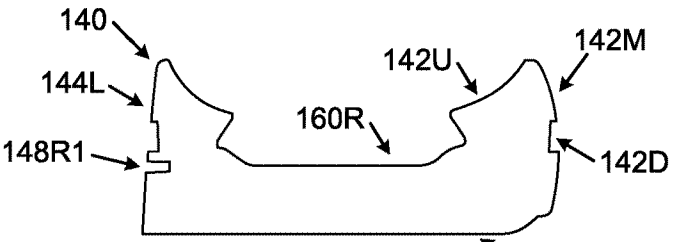
Figure 9F:
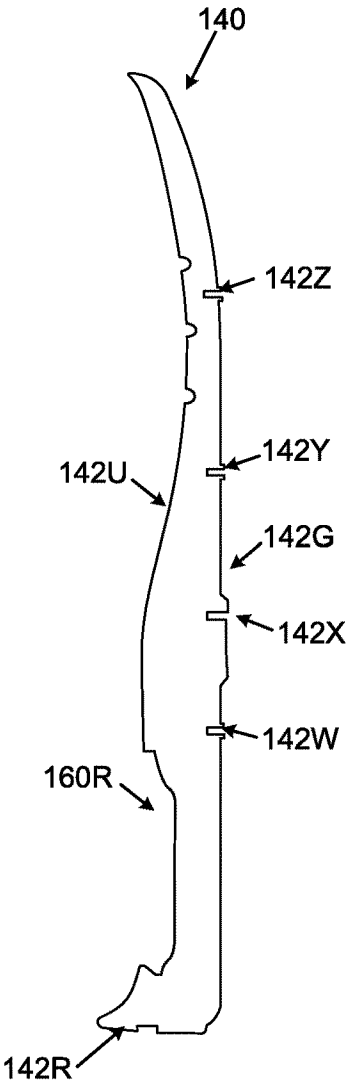
Figure 9E:
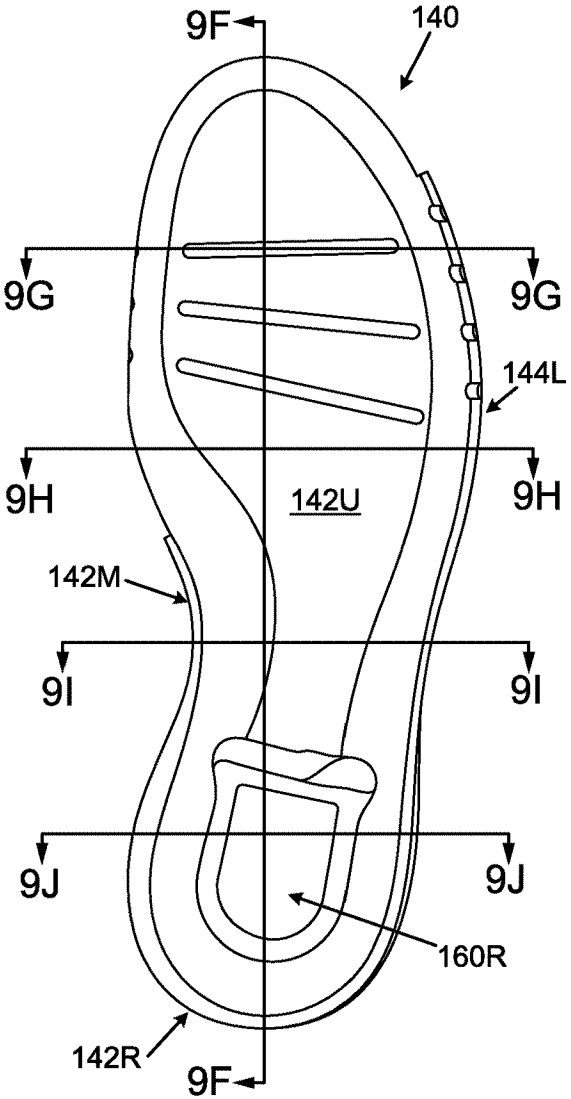

Various differences between the sole structure 104 of FIGS. 7A-9J and that of FIGS. 1A-6B now will be described in more detail. In these figures: FIG. 7A provides a medial side view of sole structure 104; FIG. 7B provides a lateral side view; FIG. 7C provides a bottom view; FIG. 7D provides a top view; FIG. 7E provides a rear view; FIG. 7F provides a longitudinal cross sectional view along line 7F-7F in FIG. 7D; FIG. 7G provides a transverse cross sectional view along line 7G-7G in FIG. 7D; FIG. 7H provides a transverse cross sectional view along line 7H-7H in FIG. 7D; FIG. 7I provides a transverse cross sectional view along line 7I-7I in FIG. 7D; and FIG. 7J provides a transverse cross sectional view along line 7J-7J in FIG. 7D. FIG. 8A provides a medial side view of outsole component (including first and second outsole components 120 and 130); FIG. 8B provides a lateral side view; FIG. 8C provides a rear view; FIG. 8D provides a bottom view; FIG. 8E provides a top view; FIG. 8F provides a longitudinal cross sectional view along line 8F-8F in FIG. 8E; FIG. 8G provides a transverse cross sectional view along line 8G-8G in FIG. 8E; FIG. 8H provides a transverse cross sectional view along line 8H-8H in FIG. 8E; FIG. 8I provides a transverse cross sectional view along line 8I-8I in FIG. 8E; and FIG. 8J provides a transverse cross sectional view along line 8J-8J in FIG. 8E. Similarly: FIG. 9A provides a medial side view of midsole component 140; FIG. 9B provides a lateral side view; FIG. 9C provides a rear view; FIG. 9D provides a bottom view; FIG. 9E provides a top view; FIG. 9F provides a longitudinal cross sectional view along line 9F-9F in FIG. 9E; FIG. 9G provides a transverse cross sectional view along line 9G-9G in FIG. 9E; FIG. 9H provides a transverse cross sectional view along line 9H-9H in FIG. 9E; FIG. 9I provides a transverse cross sectional view along line 9I-91 in FIG. 9E; and FIG. 9J provides a transverse cross sectional view along line 9J-9J in FIG. 9E.

One difference relates to the midsole structure 140. The example of FIGS. 1A-6B includes two separate midsole components 140A (e.g., FIGS. 3A-3J) and 140B (e.g., FIGS. 4A-4J) that are joined together along generally longitudinally extending sides 142L and 144M. One potential advantage of this multi-piece 140A, 140B midsole 140 construction relates to removing the midsole components from their mold(s). Because of the relatively deep, molded slits 148R1 and/or 148F1 provided in midsole component 140B (e.g., see FIGS. 4E-4H), the two part 140A, 140B midsole component 140 allows the midsole components 140A and/or 140B to be formed as separate parts, which may allow the parts 140A, 140B to be more easily removed from a mold in which it/they are formed.

In the example sole structure 104 of FIGS. 7A-9J, on the other hand, a single midsole component 140 is provided. Compare FIGS. 9A-9J with FIGS. 3A-3H. Thus, the one-piece midsole component 140 of the example of FIGS. 7A-9J extends from the lateral side to the medial side of the sole structure 104 and/or extends to support an entire plantar surface of a wearer's foot. If desired, in this one midsole component 140 structure shown in FIGS. 7G-7J and 9G-9J, the side slits 148F1 and/or 148R1 may extend a shorter distance into the sidewall of the midsole component 140. As some more specific examples, while dimension W in FIGS. 4E-4H is described as being at least 6 mm, and in some examples, at least 8 mm, between 6 mm and 20 mm, between 8 mm and 15 mm, etc., in the example of FIGS. 7G-7J and 9G-9J, the corresponding dimension W of side slits 148F1 and/or 148R1, if present at all, may be within a range of 0 mm to 6 mm, and in some examples, from 0.5 mm to 5.5 mm, or even within a range from 1 mm to 5 mm. The height dimension of side slits 148F1 and/or 148R1 of the example of FIGS. 7A-9J may be less than the width dimension, e.g., less than 5 mm, less than 3 mm, or even less than 2 mm. The width dimension W and the height dimension may vary over an overall length of the individual slits 148F1 and/or 148R1 of the example of FIGS. 7A-9J. As some more specific examples, the W/H ratio at a specific location along the slit(s) 148F1 and/or 148R1 of FIGS. 7A-9J be within a range of: 1 to 10, 1.5 to 8, and/or even 1.75 to 6. This W/H ratio may be applicable over at least a majority of the length of the slit(s) 148F1 and/or 148R1, and in some examples, over at least 60%, at least 75%, at least 80%, at least 90%, at least 95%, or even over 100% of the length of the slit(s) 148F1 and/or 148R1. While not a requirement, in the specific example illustrated in FIGS. 7A-9J, the side slits 148F2 and 148R2 defined between the midsole 140 and first outsole component 120 are omitted (compare FIGS. 1G-1J with FIGS. 7G-7J).

The example sole structure 104 of FIGS. 7A-9J also differs from those described above by eliminating the rearwardly spaced portion of the lateral sidewall 124 of the outsole located in the midfoot area of the sole structure 104. As shown in FIGS. 7A-8J, the lateral sidewall 124 segment between rearmost edge 124E and rear side edge 124RS in FIGS. 1B, 2B, 2C, and 2E) is omitted in this alternative sole structure 104. As a result of this change, the forefoot side slit 148F1 and rearfoot side slit 148R1 in the example of FIGS. 7A-9J connect together to form a single, continuous, side slit that extends almost an entire exposed length of the lateral sidewall 144L of the midsole 140. As shown, this slit 148F1/148R1 extends from a rear location—e.g., between perpendicular planes located at P=0.01 L to P=0.1 L—to a forward location—e.g., between perpendicular planes located at P=0.7 L to P=0.9 L—with the plane locations based on an overall length L of the sole structure 104 and/or a shoe containing it and measured forward from the rearmost heel location RH. The elimination of the midfoot portion of the lateral sidewall 124 as shown in this example may impact the flexion characteristics of the outsole (including first and second outsole components 120 and 130), the sole structure 104, and/or any shoe containing these parts.

As another difference, the outsole (including first and second outsole components 120 and 130) of FIGS. 7A-8J includes three medial sidewall 130S cutouts 130C in the forefoot region rather than the four cutouts 130C shown in FIGS. 1A-6B. These cutouts 130C may be located within any of the positional ranges and/or have any of the structural characteristics described above for the similar cutouts 130C of the example of FIGS. 1A-6B. The elimination of one or more cutouts 130C also may impact the flexion characteristics of the outsole (including first and second outsole components 120 and 130), the sole structure 104, and/or any shoe containing these parts.

FIGS. 10A-12J show various views of another alternative sole structure 104 and component parts thereof in accordance with some examples of this technology. More specifically, FIGS. 10A-10K show various views of an overall sole structure 104, while FIGS. 11A-11K provide various views of the outsole structure (e.g., including component parts 120 and 130) and FIGS. 12A-12J provide various views of a midsole structure (e.g., including component part 140). When the same reference number is used in FIGS. 10A-12J as those used in FIGS. 1A-9J, the same or similar parts are being referred to, and much of the overlapping and/or redundant disclosure is omitted from the discussion of FIGS. 10A-12J. Further, the sole structure 104 of FIGS. 10A-12J may have any of the component parts, features, options, properties, materials, alternatives, additions, and/or the like as described above for the similar sole structure 104 and/or component parts (e.g., 120, 130, 140, 150, 160, etc.) in FIGS. 1A-9J. Additionally or alternatively, the sole structure 104 and/or the component parts (e.g., 120, 130, 140, 150, 160, etc.) thereof shown in FIGS. 10A-12J may have any one or more and/or any combination of the features described above in Tables 1, 2, and/or 3. The sole structure 104 of FIGS. 10A-12J also may be engaged with a footwear upper, e.g., having any of the various materials, structures, properties, parts, features, options, alternatives, additions, etc., as described above for the upper 102 shown in FIGS. 1A-1J.

Figure 10A:
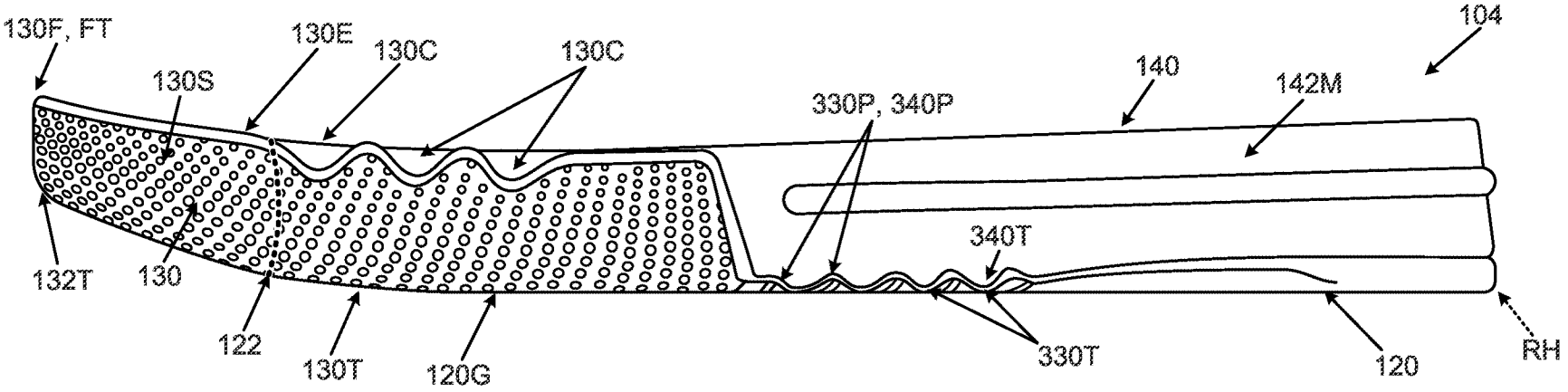
FIGS. 10A-10K provide various views of another sole structure for an article of footwear in accordance with some examples of this technology
Figure 10B:
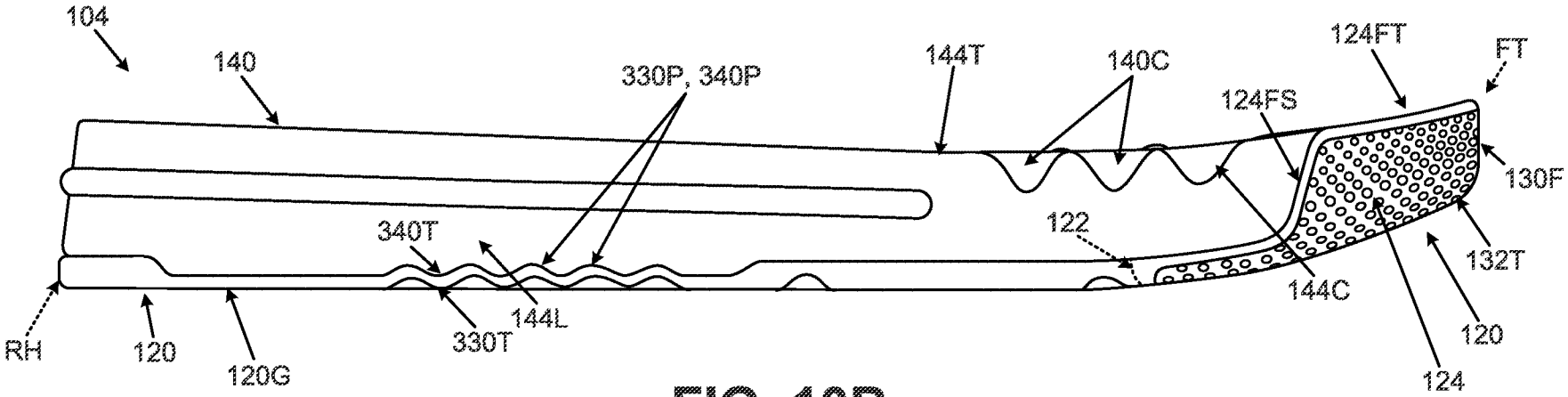
Figure 10C:
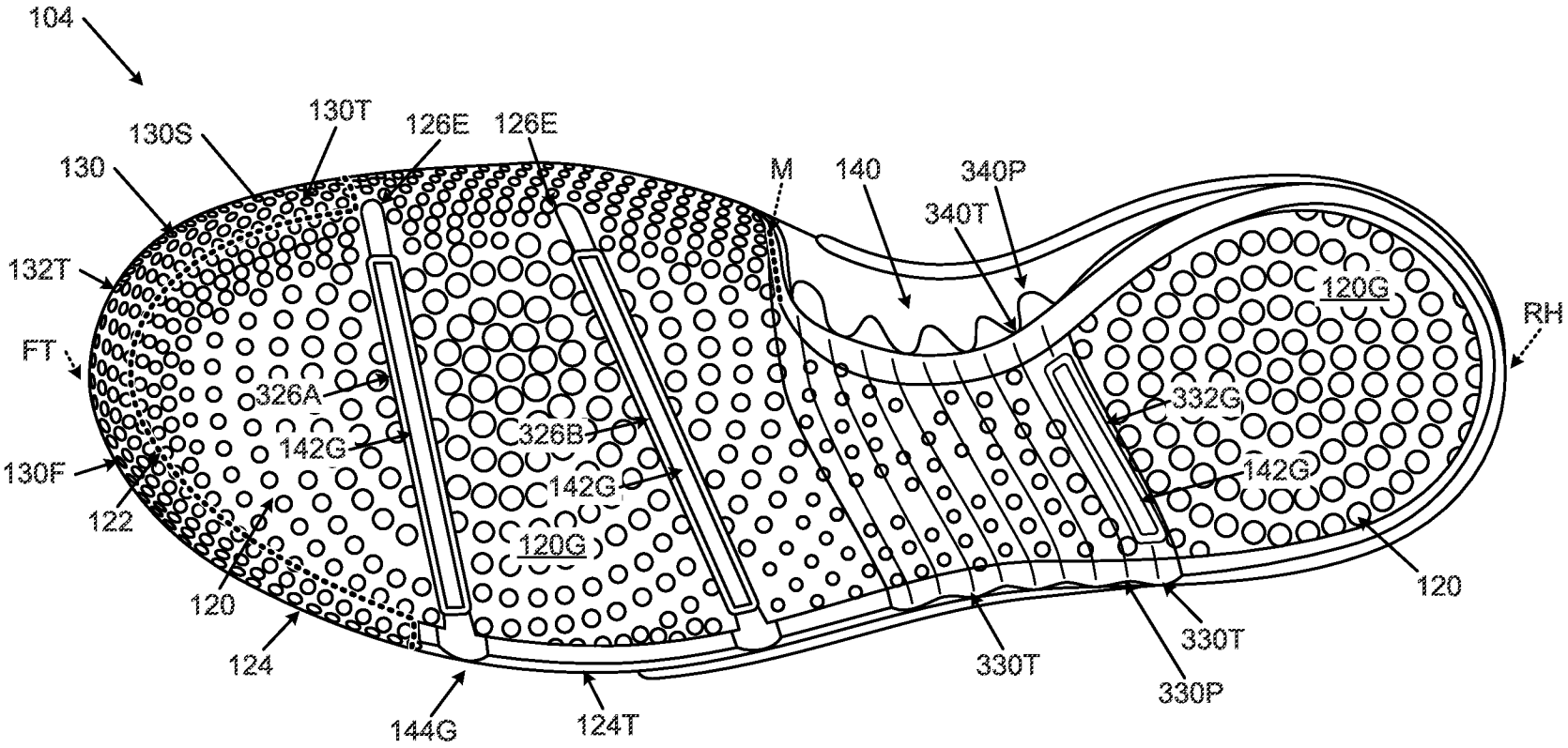
Figure 10D:
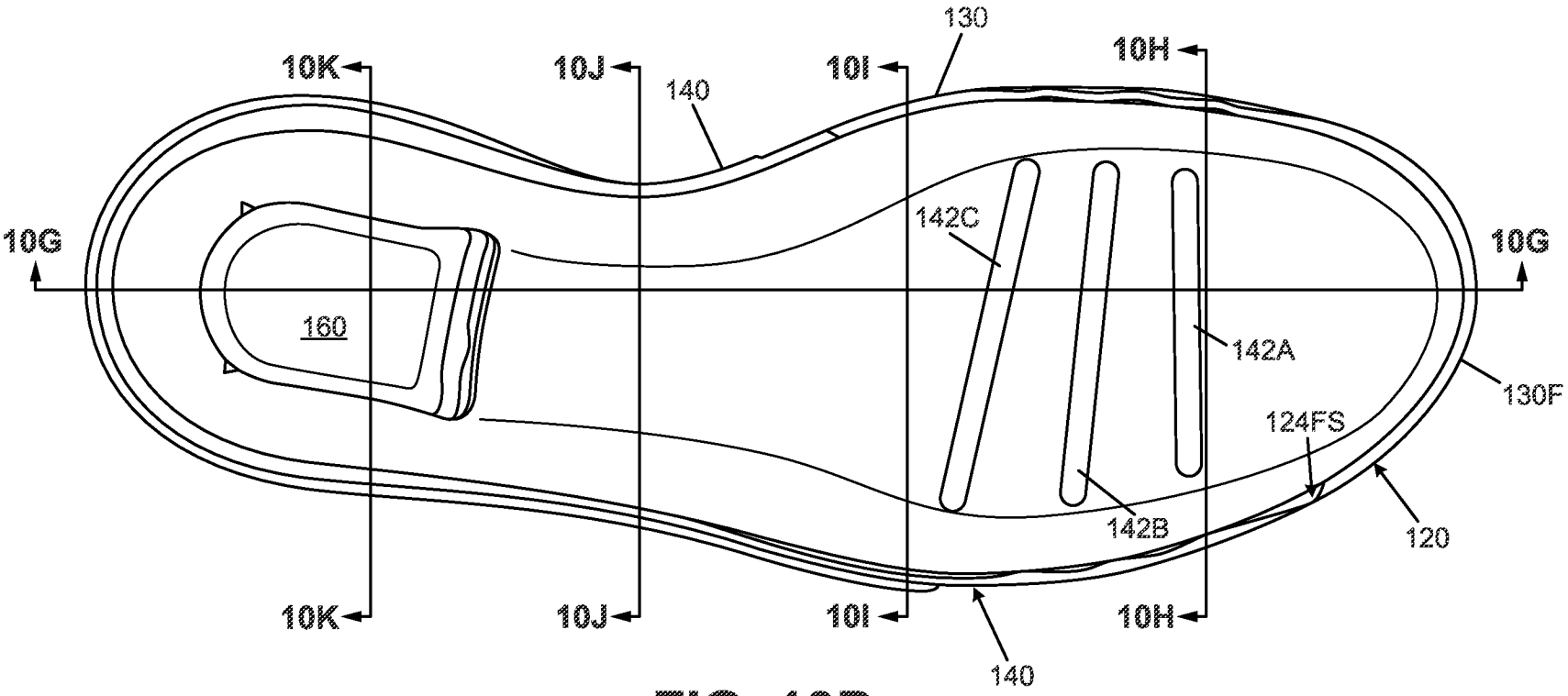
Figure 10F:
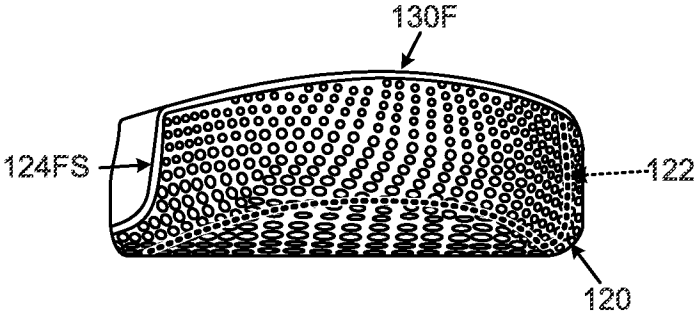
Figure 10E:
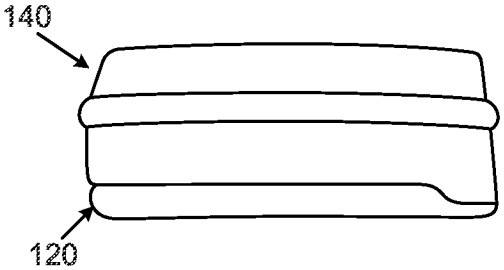
Figure 10G:
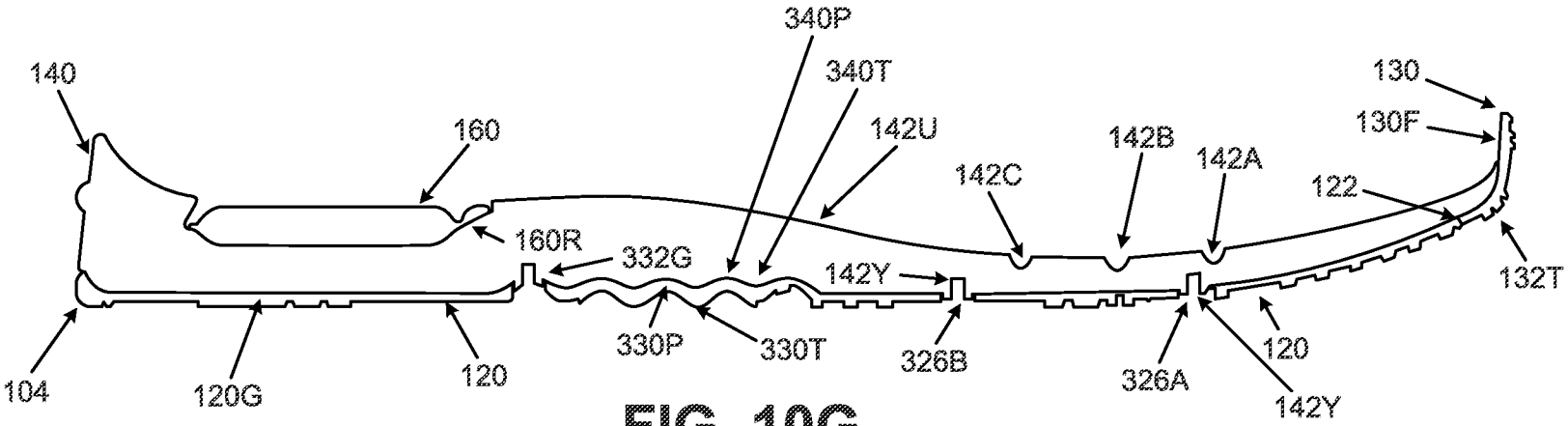
Figure 10I:
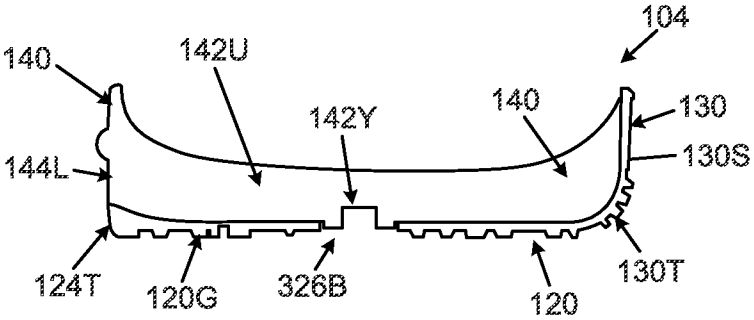
Figure 10K:
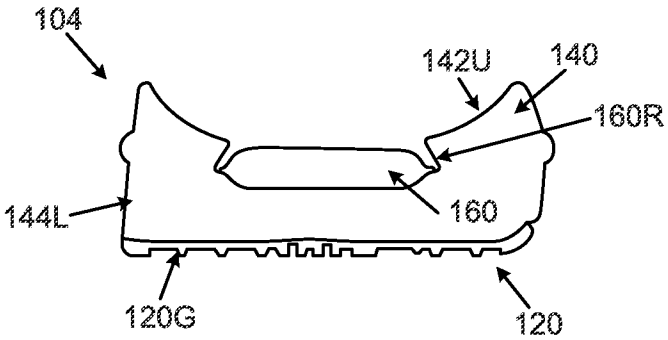
Figure 10H:
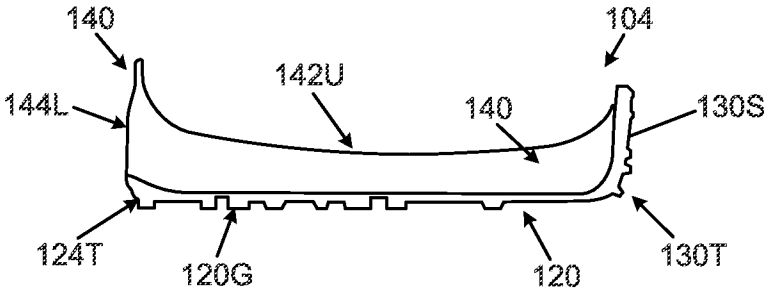
Figure 10J:
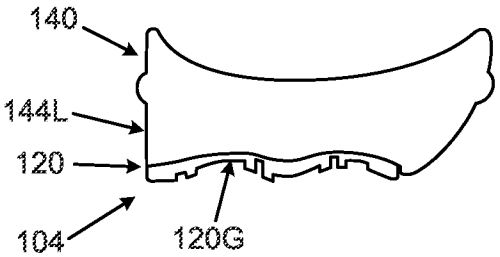
Figure 11A:
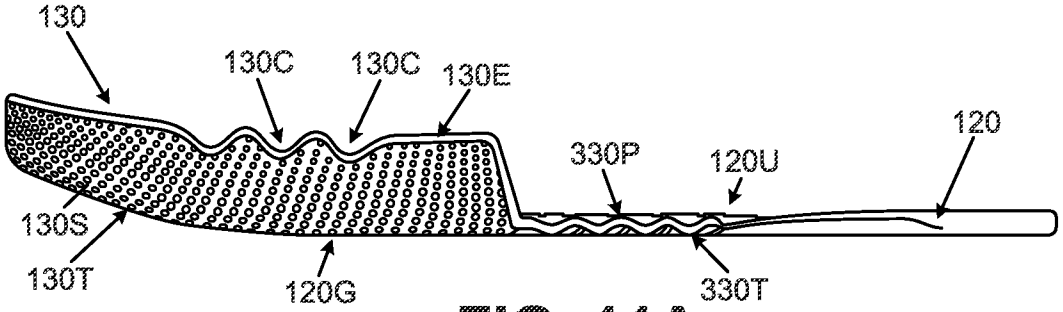
FIGS. 11A-11K provide various views of an outsole in accordance with some examples of this technology
Figure 11B:
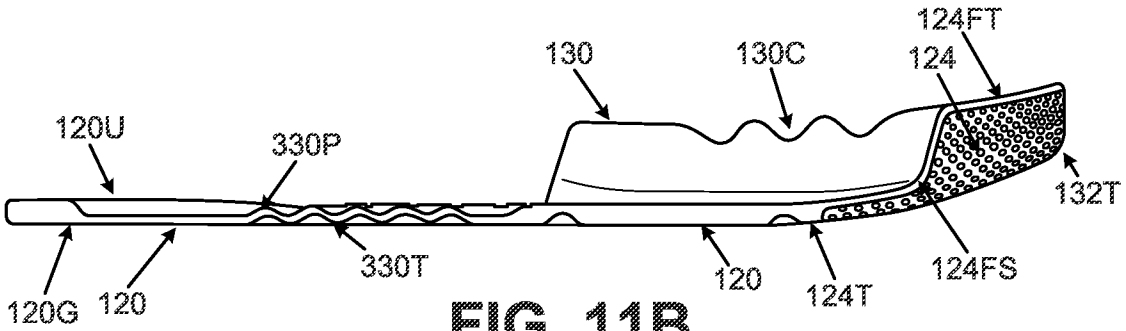
Figure 11C:
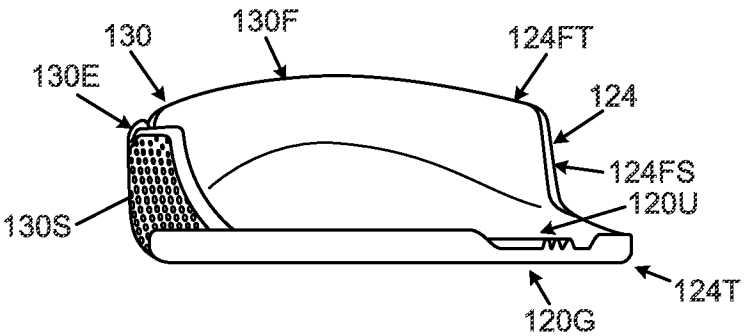
Figure 11E:
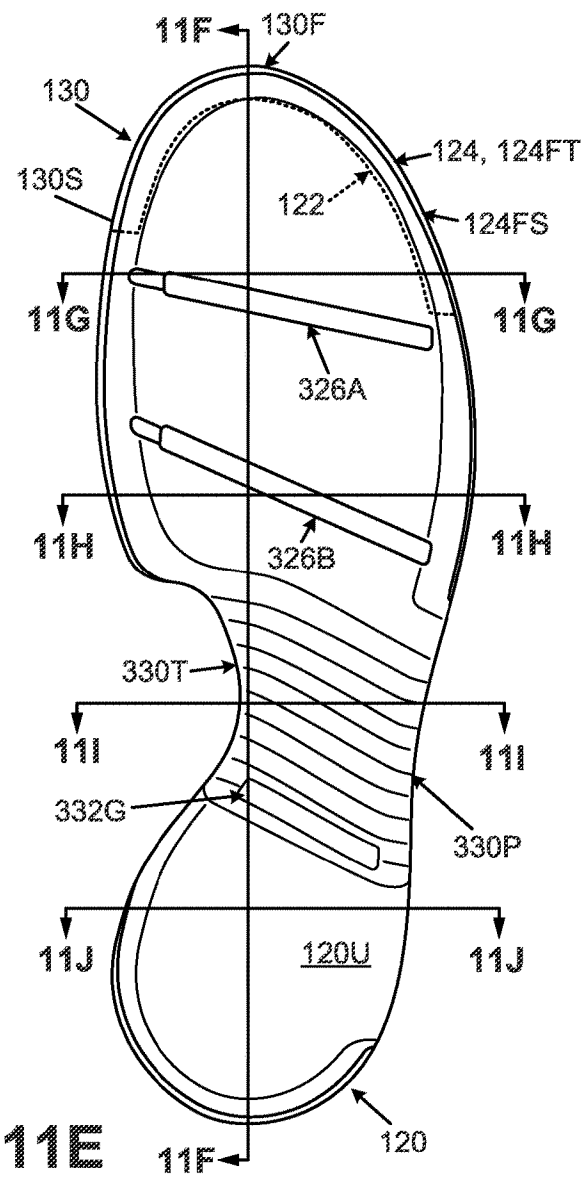
Figure 11D:
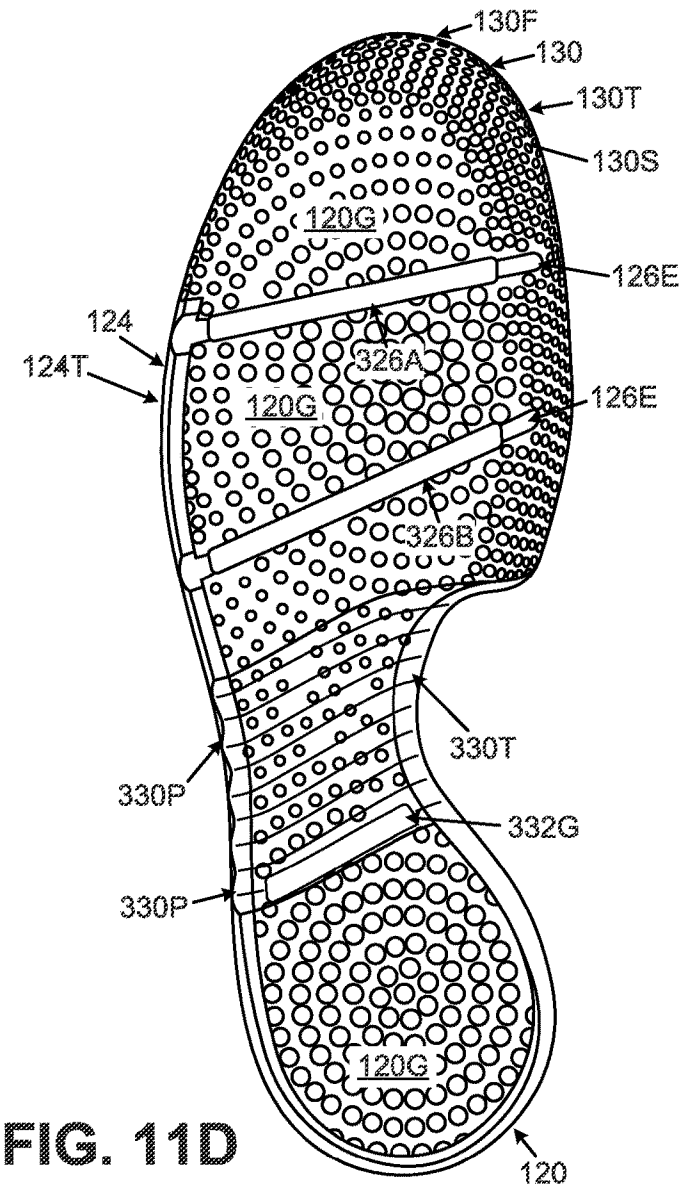
Figure 11G:
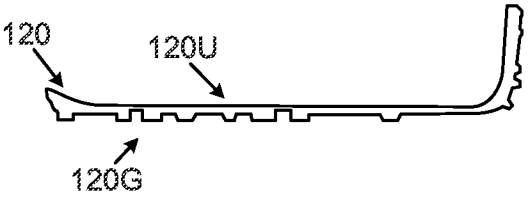
Figure 11H:
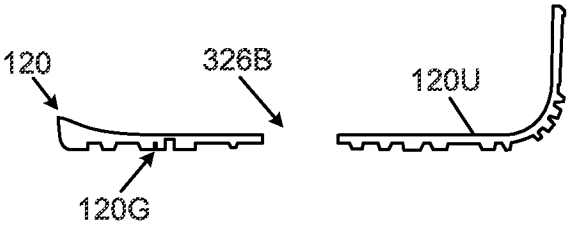
Figure 11J:
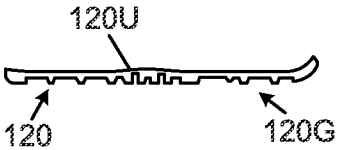
Figure 11I:
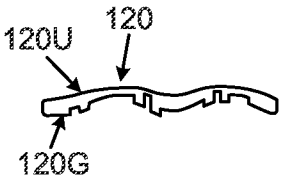
Figure 11F:
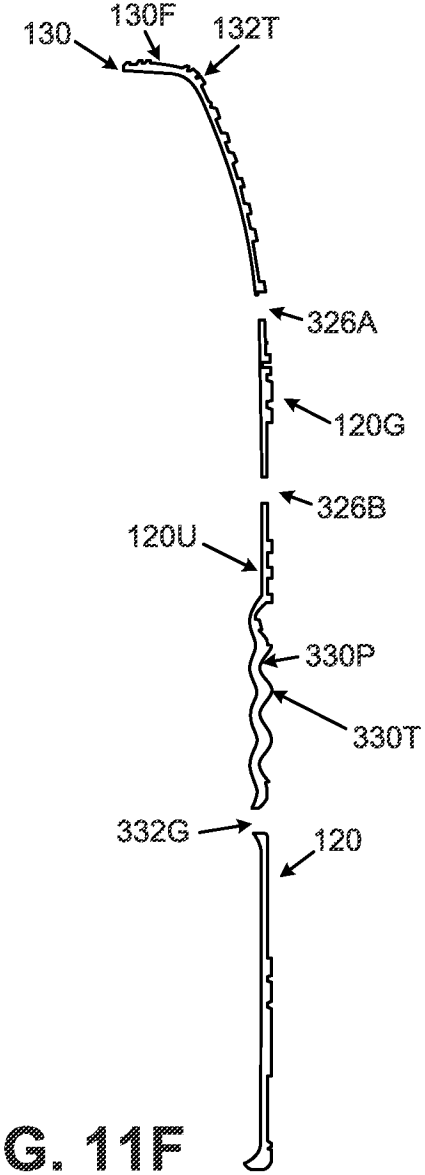
Figure 11K:
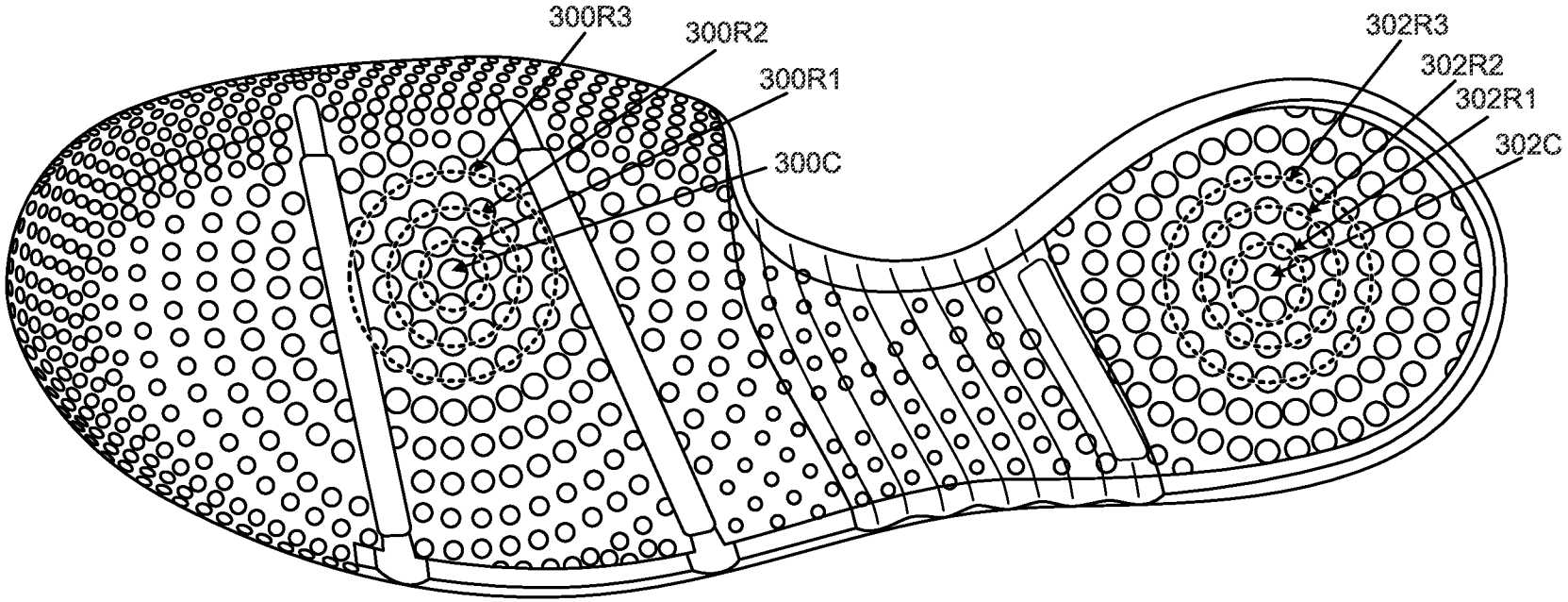
Figure 12A:
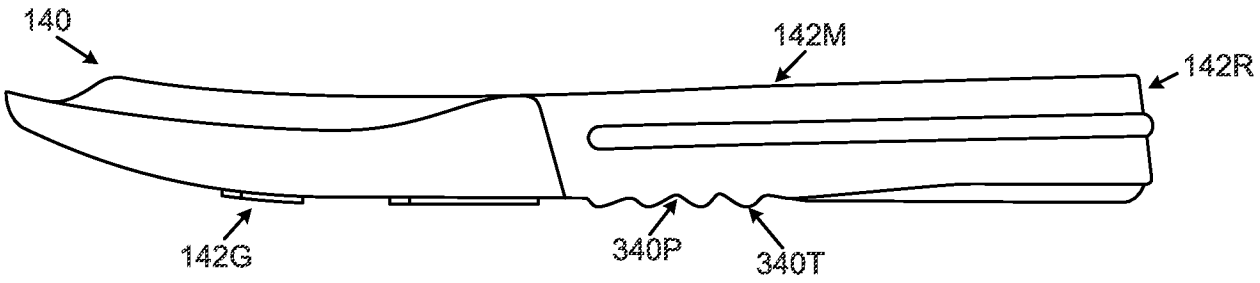
FIGS. 12A-12J provide various views of a midsole component in accordance with some examples of this technology
Figure 12B:
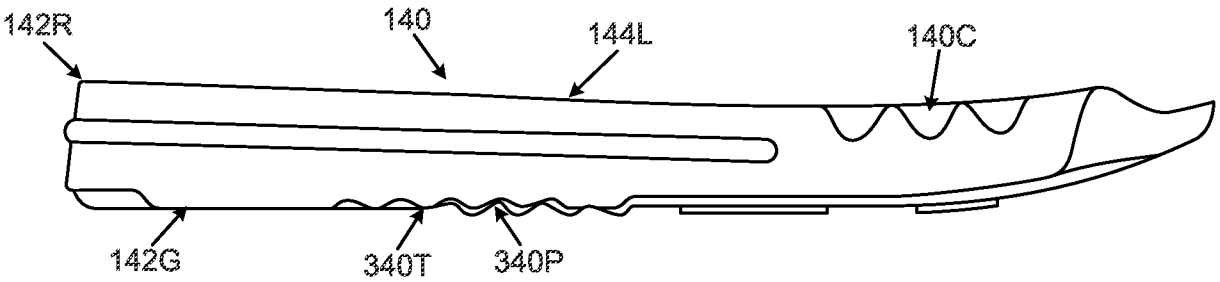
Figure 12C:
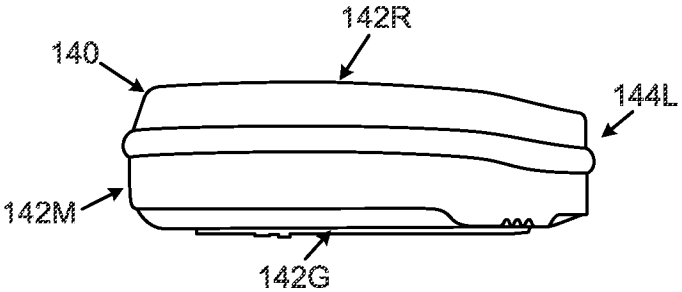
Figure 12E:
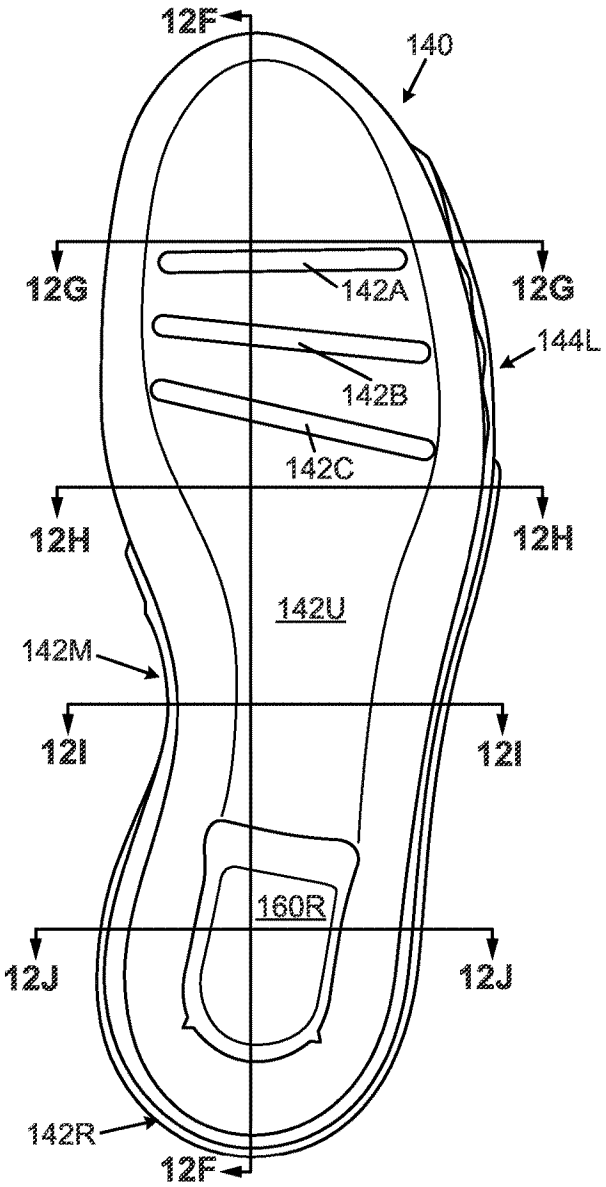
Figure 12D:
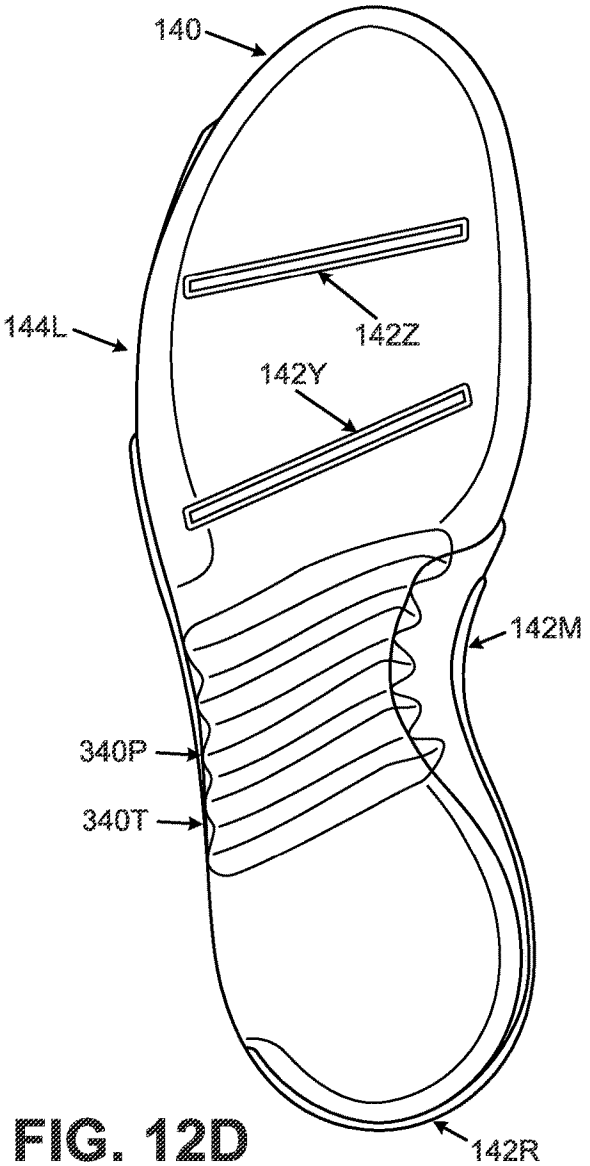
Figure 12F:
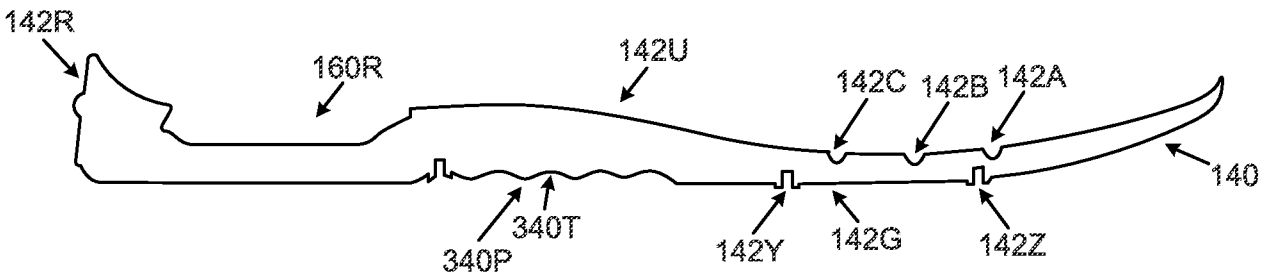
Figure 12H:
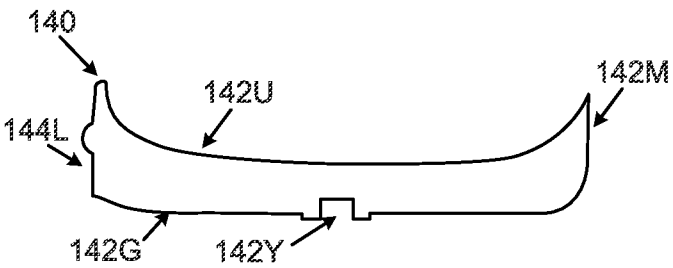
Figure 12J:
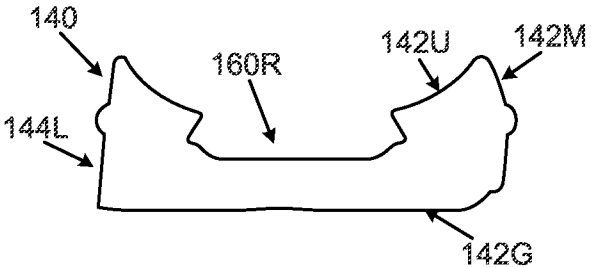
Figure 12G:
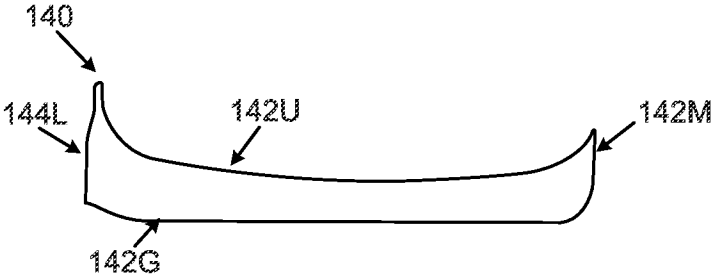
Figure 12I:
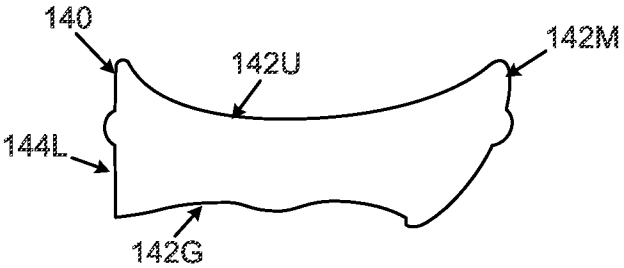

Various features of sole structure 10A-12J, including differences between the sole structure 104 of FIGS. 10A-12J and that of FIGS. 1A-9J, now will be described in more detail. In these figures: FIG. 10A provides a medial side view of sole structure 104; FIG. 10B provides a lateral side view; FIG. 10C provides a bottom view; FIG. 10D provides a top view; FIG. 10E provides a rear view; FIG. 10F provides a front view; FIG. 10G provides a longitudinal cross sectional view along line 10G-10G in FIG. 10D; FIG. 10H provides a transverse cross sectional view along line 10H-10H in FIG. 10D; FIG. 10I provides a transverse cross sectional view along line 10I-10I in FIG. 10D; FIG. 10J provides a transverse cross sectional view along line 10J-10J in FIG. 10D; and FIG. 10K provides a transverse cross sectional view along line 10K-10K in FIG. 10D. FIG. 11A provides a medial side view of outsole component (including first and second outsole components 120 and 130); FIG. 11B provides a lateral side view; FIG. 11C provides a rear view; FIG. 11D provides a bottom view; FIG. 11E provides a top view; FIG. 11F provides a longitudinal cross sectional view along line 11F-11F in FIG. 11E; FIG. 11G provides a transverse cross sectional view along line 11G-11G in FIG. 11E; FIG. 11H provides a transverse cross sectional view along line 11H-11H in FIG. 11E; FIG. 11I provides a transverse cross sectional view along line 11I-11I in FIG. 11E; FIG. 11J provides a transverse cross sectional view along line 11J-11J in FIG. 11E; and FIG. 11K provides a view explaining additional features of some examples of this technology. Similarly: FIG. 12A provides a medial side view of midsole component 140; FIG. 12B provides a lateral side view; FIG. 12C provides a rear view; FIG. 12D provides a bottom view; FIG. 12E provides a top view; FIG. 12F provides a longitudinal cross sectional view along line 12F-12F in FIG. 12E; FIG. 12G provides a transverse cross sectional view along line 12G-12G in FIG. 12E; FIG. 12H provides a transverse cross sectional view along line 12H-12H in FIG. 12E; FIG. 12I provides a transverse cross sectional view along line 12I-12I in FIG. 12E; and FIG. 12J provides a transverse cross sectional view along line 12J-12J in FIG. 12E.

As shown in FIGS. 10A-10C, 10F, 10G, and 11E in this illustrated example sole structure 104, the outsole comprises two different components, portions, and/or materials having different properties, namely: first outsole component 120 and second outsole component 130. The first outsole component 120 may be formed from a first material having a first hardness, and this first material (and/or first outsole component 120) may form at least a portion (e.g., at least a majority) of a ground-facing surface 120G of the sole structure 104. In some more specific examples, this first material (and/or this first outsole component 120) may form at least 60%, at least 75%, at least 85%, or even at least 90% of a ground-facing surface 120G of the sole structure 104 (e.g., measured based on overall surface area of the ground-facing surface 120G of the total outsole). First outsole component 120 may have any of the features, options, and/or alternatives described above for first outsole components 120 of FIGS. 1A-9J.

The outsole of this example further includes a second outsole component 130, e.g., formed from a second material having a second hardness. This second hardness (e.g., of the second outsole component 130) forms at least a portion of the forefoot medial sidewall 130S of the sole structure 104. This second outsole component 130 has a hardness at least 15 Shore A hardness points higher than a hardness of the material forming a majority of the ground-facing surface 120G of the first outsole component 120. As some additional or alternative examples, the second outsole component 130, at least a portion of the forefoot medial sidewall 130S, and/or a material forming at least a portion of the forefoot medial sidewall 130S may have hardness (the "second hardness" mentioned above) at least 18 Shore A hardness points higher, at least 20 Shore A hardness points higher, at least 22 Shore A hardness points higher, or even at least 24 Shore A hardness points higher than the hardness of the first outsole component 120, the ground-facing surface 120G, and/or a material forming at least a majority of the ground-facing surface 120G of the sole structure 104 (the "first hardness" mentioned above). Second outsole component 130 may have any of the features, options, and/or alternatives described above for second outsole components 130 of FIGS. 1A-9J.

In any of the sole structures 104 and/or aspects of this technology, the first outsole component 120, the ground-facing surface 120G, and/or a material of at least a majority of the ground-facing surface 120G of the sole structure 104 may be made from a material having a hardness (the "first hardness") between 50 Shore A and 75 Shore A, and in some examples, a hardness between 55 Shore A and 72 Shore A and/or a hardness below 75 Shore A. Additionally or alternatively, the second sole component 130, at least a portion of the forefoot medial sidewall 130S, and/or a material of at least a portion of the forefoot medial sidewall 130S may be made from a material having a hardness (the "second hardness") between 80 Shore A and 110 Shore A, and in some examples, a hardness between 88 Shore A and 100 Shore A and/or a hardness above 85 Shore A. Additionally or alternatively, as noted above, the two different hardness features (and therefore slickness features) may be provided in various ways as well. For example, if desired, an outsole component including different hardness in the forefoot ground-contacting surface 120G and at least a portion of the forefoot medial sidewall 130S may be formed as a single component (e.g., by molding a single composition) and then at least one of the two portions of the outsole component (e.g., a portion corresponding to first outsole component 120 and/or a portion corresponding to the second outsole component 130) may be treated (e.g., coated with a material, sprayed with a material, irradiated (e.g., with laser or other radiation), mechanically altered (e.g., formed with blind holes, sipes, etc.) etc.) to alter the hardness of one portion with respect to the other portion.

This second material (and second outsole component 130) extends from the first material of first outsole component 120 and is engaged with the first material (and first outsole component 120). In at least some examples of this technology, the first outsole component 120 and the second outsole component 130 will be fixedly joined together to form a unitary, one-piece construction, e.g., in any of the manners described above for the example of FIGS. 1A-2J. As noted above, this type of permanent connection to form a unitary, one-piece outsole component from the first outsole component 120 and the second outsole component 130 can be particularly beneficial for use of the sole structure in various urban dance environments, e.g., to maintain structural integrity under the forces experienced in some urban dance environments. In the illustrated example of FIGS. 10A-12J, the outsole component formed by joined outsole components 120 and 130 constitutes a single component part having a heel supporting region, a forefoot supporting region, and a central region connecting the heel supporting region and the forefoot supporting region.

In this illustrated example, the second outsole component 130 and/or the second (harder) material thereof forms at least a first portion of an exterior surface of a medial sidewall 130S of the sole structure 104. FIGS. 10A-10C, 10F, 10G, and 11E show an interface 122 location between the first outsole component 120 and the second outsole component 130 in accordance with some examples of this technology. More specifically, these figures show the second outsole component 130 and its (harder) material extending from: (i) a forefoot lateral side location of the sole structure 104, (ii) around the forward toe area of the sole structure 104, and to (iii) a forefoot medial side location of the sole structure 104. The harder material of the second outsole component 130 may form a perimeter rim of harder material at the ground-facing surface 120G. This harder perimeter rim, when present, may be less than 25 mm wide, less than 20 mm wide, less than 15 mm wide, or even less than 12 mm wide over at least a majority of its extent from the lateral origination point to the medial origination point around the forward toe area. Any of these width range features may be provided over at least 60%, at least 75%, at least 80%, at least 90%, at least 95%, or even over 100% of the perimeter extent of the second material from the lateral origination point to the medial origination point around the forward toe area. These same harder material perimeter rim features, sizes, and/or extents also may be provided in the outsole components shown in any of FIGS. 1A-9J above (e.g., at the perimeter defined by interface line 122 in FIG. 1C and FIG. 7C).

The second outsole component 130 (e.g., the harder material described above) may originate at a lateral side of the sole structure 104 at or forward of a fifth metatarsal head support region of the sole structure 104. See FIGS. 10B and 10C. As some more specific examples, at the lateral side of the sole structure 104, the second outsole component 130 may originate at or forward of a location 0.7 L of the sole length L forward of the rearmost heel RH location, and in some examples, at or forward of a location 0.75 L, 0.8 L, or even 0.85 L. At the medial side (e.g., see FIGS. 10A and 10C), the second outsole component 130 may originate at or forward of a first metatarsal head or first toe support region of the sole structure 104. As some more specific examples, at the lateral side of the sole structure 104, the second outsole component 130 may originate at or forward of a location 0.7 L of the sole length L forward of the rearmost heel RH location, and in some examples, at or forward of a location 0.75 L, 0.8 L, or even 0.85 L. Forward of these lateral and/or medial side origination points, at least a majority (and in some examples, at least 60%, at least 75%, at least 80%, at least 85%, at least 90%, at least 95%, or even 100%) of the lateral sidewall 124 and/or the medial sidewall 130S surface area may be formed of the harder material described above.

The harder material forming at least part of the lateral sidewall 124 and/or the medial sidewall 130S may continue downward in a vertical direction with respect to the sole structure 104 from a top edge of the second outsole component 130 to locations along the bottom (e.g., at the ground-facing surface) of the sole structure 104. As generally shown in FIGS. 10A-11J, the sole structure 104 incudes: (a) a ground-facing surface 120G (including part formed from the first outsole component 120); (b) forefoot medial sidewall 130S; and (c) forefoot lateral sidewall 124. A medial transition region 130T extends from the ground-facing surface 120G to the forefoot medial sidewall 130S, and this medial transition region 130T may include any of the curvature features described above for the example of FIGS. 1A-2J. Similarly, a lateral transition region 124T extends from the ground-facing surface 120G to the forefoot lateral sidewall 124, and this lateral transition region 124T may include the "corner" or any of the curvature features described above for the example of FIGS. 1A-1J. Additionally, in at least some aspects of this technology, a forward toe sidewall 130F may be provided around the forward toe area connecting the medial sidewall 130S and the lateral sidewall 124. This forward toe sidewall 130F may include a forward toe transition region 132T that extends from the ground-facing surface 120G to the forward toe sidewall 130F. This forward toe transition region 132T may have any of the features described above with respect to the example of FIGS. 1A-2J. As shown in FIGS. 10A-10C, the transition regions 130T, 132T, and 124T may be formed, at least in part, from the harder second outsole component 130 (made from the harder material) and may extend to provide at least a portion of the overall ground-facing surface 120G of the sole structure 104. The portion of the ground-facing surface 120G formed of the harder material of second outsole component 130 may have any of the size and/or extent features described above for the example of FIGS. 1A-2J and/or may begin at the lateral and/or medial sidewall origination points for second outsole component 130 described above.

The example sole structure 104 shown in FIGS. 10C, 10G, 11D, 11E, and 11F includes a forefoot flex groove 326A (e.g., formed in the first outsole component 120). In the illustrated example, forefoot flex groove 326A extends in a transverse direction across the sole structure 104 from the lateral side to the medial side of the sole structure 104. In the illustrated example, the forefoot flex groove 326A comprises an elongated slot. Further, while not required in all examples of this technology, at least a portion of the forefoot flex groove 326A includes a through-hole that extends completely through the first outsole component 120 (e.g., within the elongated slot), e.g., to expose the ground-facing surface 142G of the midsole 140. In at least some examples of this technology, e.g., as shown in FIG. 10C, all of the second outsole component 130 (the outsole component formed from the harder, second material) may be located forward of the forefoot flex groove 326A. Further, when the forefoot flex groove 326A is a forwardmost flex groove defined in the sole structure that is formed as an elongated slot and extends continuously from the lateral side to the medial side of the sole structure, all of the second outsole component 130 (the outsole component formed from the harder, second material) may be located forward of that forwardmost forefoot flex groove 326A. In the example shown in FIG. 10C, the first outsole component 120 also forms a portion of the ground-facing surface 120G forward of flex groove 326A (e.g., the portion behind interface line 122)

FIGS. 10C, 10G, 11D, 11E, and 11F further show that sole structure 104 of this example includes a forefoot and/or midfoot flex groove 326B (e.g., formed in the first outsole component 120) located rearward of forefoot flex groove 326A. Forefoot and/or midfoot flex groove 326B extends in a transverse direction across the sole structure 104 from the lateral side to the medial side of the sole structure 104. In this illustrated example, the forefoot and/or midfoot flex groove 326B comprises an elongated slot. While not required in all examples of this technology, at least a portion of the forefoot and/or midfoot flex groove 326B includes a through-hole that extends completely through the first outsole component 120 (e.g., within the elongated slot), e.g., to expose the ground-facing surface 142G of the midsole 140.

Forefoot flex groove 326A may have any of the size, angular, orientation, and/or positional features described above with respect to slot 126A. Additionally or alternatively, forefoot and/or midfoot flex groove 326B may have any of the size, angular, orientation, and/or positional features described above with respect to slot 126B.

FIGS. 10A-11J illustrate additional features present in the outsole of this example (and particularly first outsole component 120 in this example). As shown FIGS. 10A-10C, 10G, 11A, 11B, and 11D-11F, a central region of first outsole component 120 (e.g., a midfoot supporting region located between a forefoot supporting region and a heel supporting region) includes plural transverse waves extending across the sole structure 104 (e.g., from the lateral side edge to the medial side edge). The plural transverse waves include plural wave peaks 330P and plural wave troughs 330T (e.g., at least two upwardly extending wave peaks 330P and at least two downwardly extending wave troughs 330T when the sole structure 104 is oriented on a horizontal base surface on its ground-facing surface 120G). While the illustrated example shows five wave peaks 330P separated by four wave troughs 330T each extending from the lateral side edge to the medial side edge, any desired numbers of peaks and troughs may be provided (e.g., from 2 to 8) that extend any desired portion of the distance between the side edges. This type of plural wave configuration may assist in shock absorption and/or provide anterior-to-posterior compression or expansion, e.g., that can be useful in footwear targeted for urban dance uses. The plural waves 330P and troughs 330T may have any of the size, angular, orientation, and/or positional features described above with respect to gaps 128G1, and/or 128G2.

If desired, one or more of the plural waves (including all of the plural waves, if desired) may include a groove 332G extending completely through the first outsole component 120. When present, this type of through hole groove 332G can provide additional flexibility. The example sole structure 104 of FIGS. 10A-11J includes one (and only one) wave peak 330P (the rearmost wave peak, in this illustrated example) that includes through groove 332G. As shown, the ground-facing surface 142G of the midsole 140 is exposed through groove 332G. See FIGS. 10G, and 11D-11F. Further, while FIGS. 10A-10C, 10G, 11A, 11B, 11D-11F show the plural wave features on both the upper-facing surface 120U and ground-facing surface 120G of first outsole component 120, in some examples of this technology, such plural wave surface could be provided on just one of these surfaces 120U or 120G.

FIG. 11K shows some additional features that may be present in outsole structures in accordance with some aspects of this technology (including any of the outsole structures described above in conjunction with FIGS. 1A-9J). As shown, the outsole (and in this example, first outsole component 120) forms a forefoot supporting region and a heel supporting region (which are joined as a one piece construction by central supporting region in this example). The ground-facing surface 120G at the forefoot supporting region of this example includes a traction element pattern, e.g., that may assist in providing desired traction for various urban dance moves. This traction element pattern includes: (a) a central traction element 300C, (b) a first plurality of traction elements (in ring 300R1) arranged around and located immediately adjacent the central traction element 300C, and (c) a second plurality of traction elements (in ring 300R2) arranged around the first plurality of traction elements (300R1). FIG. 11K further shows at least one more plurality of traction elements (in ring 300R3) arranged around the second plurality of traction elements (300R2). The rings 300R2, 300R3, . . . may be arranged such that each of a majority of traction elements of a ring (e.g., the second plurality of traction elements in ring 300R2) is located immediately adjacent at least one of the traction elements of the ring located inward of that ring (e.g., the first plurality of traction elements 300R1). Two traction elements are considered to be "immediately adjacent" one another as that term is used herein in this context to mean that a straight line can be drawn between the two traction elements without that line passing through another traction element. In the example shown in FIG. 11K, the central traction element 300C of the forefoot traction element pattern is located closer to a medial side edge of the sole structure 104 than to a lateral side edge of the sole structure 104 (e.g., in a general first or second metatarsal head support region of the first outsole component 120).

Additionally or alternatively, as shown in FIG. 11K, the ground-facing surface 120G at the heel supporting region of this example includes a traction element pattern, e.g., that may assist in providing desired traction for various urban dance moves. This traction element pattern includes: (a) a central traction element 302C, (b) a first plurality of traction elements (in ring 302R1) arranged around and located immediately adjacent the central traction element 302C, and (c) a second plurality of traction elements (in ring 302R2) arranged around the first plurality of traction elements (302R1). FIG. 11K further shows at least one more plurality of traction elements (in ring 302R3) arranged around the second plurality of traction elements (302R2). The rings 302R2, 302R3, . . . may be arranged such that each of a majority of traction elements of a ring (e.g., the second plurality of traction elements in ring 302R2) is located immediately adjacent (having the same meaning described above) at least one of the traction elements of the ring located inward of that ring (e.g., the first plurality of traction elements 302R1). In the example shown in FIG. 11K, the central traction element 302C of this heel traction element pattern is located at a central heel location of the sole structure 104 (e.g., in a calcaneus support region of the first outsole component 120).

While not a requirement, when arranged in a ring, the rings 300R1, 300R2, 300R3, and/or 302R1, 302R2, 302R3, may be concentric. Additionally or alternatively, the rings 300R1, 300R2, 300R3, and/or 302R1, 302R2, 302R3, may be circular, oval, elliptical, and/or other shapes. Further, as shown in FIG. 11K, a "ring" may be interrupted by other sole structures, such as molded in logos or other features, provided the general "ring like" orientation of the traction elements present can be ascertained.

FIGS. 10A-11J show additional features that may be provided in outsoles (e.g., outsole component 120 and/or 130) in accordance with some aspects of this technology. More specifically, FIGS. 10A, 11A, and 11B show that the medial sidewall 130S of the sole structure 104 in the forefoot area includes a medial sidewall top edge 130E that has a plurality of medial recesses 130C spaced apart in an anterior-to-posterior direction of the sole structure 104. While FIG. 10A shows the recesses 130C formed in a portion of the sidewall 130S made from the first outsole component 120 (rearward of interface line 122), if desired, some or all of the recesses 130C could be formed in a portion of the sidewall 130S made from the second outsole component 130.

While FIGS. 10A, 11A, and 11B show these recesses 130C as generally wave shaped (e.g., a wave shaped portion including at least two wave peaks and at least two wave valleys), other recess shapes are possible, including the cutout shapes of the types described above in conjunction with FIGS. 1A-9J. The individual wave valleys 130C of this example sole structure 104 may have any of the size, location, and/or other features of any of the cutouts 130C described above in conjunction with the example of FIGS. 1A-9J. While the example of FIGS. 10A, 11A, and 11B shows two wave peaks and three wave valleys, any desired number of wave peaks and adjacent wave valleys may be provided without departing from this technology including from 2-8 wave peaks and/or valleys. These recesses 130C may assist in providing a desired amount of forefoot flexibility, e.g., for urban dance moves and/or other uses.

FIGS. 10A-10K and 12A-12J further show that the sole structure 104 includes a midsole 140. The midsole 140 may include any number of parts or components without departing from this technology including any of the parts and/or components described above in the examples of FIGS. 1A-9J. Like the example of FIGS. 7A-9J, the midsole 140 of this example includes a single polymeric foam component having its ground-facing surface 142G engaged with the outsole component 120, 130 (e.g., with the upper-facing surface 120U). The midsole 140 of this example includes a forefoot support region, a central support region, and a heel support region. Further, like the other examples described above, this illustrated example midsole 140 includes a fluid-filled bladder 160 (e.g., as are conventionally known and used in the footwear arts; see also FIG. 5), e.g., in a bladder receptacle 160R formed in the upper-facing surface 142U in the heel support area. Additionally or alternatively, one or more fluid-filled bladders could be provided in other location(s) and/or may be sized differently to support a larger, smaller, and/or different portion or proportion of a wearer's foot.

The midsole 140 in the sole structure 104 of FIGS. 10A-10K and 12A-12J forms a lateral sidewall 144L of the sole structure 104 rearward of a lateral side end 124FS of the outsole lateral sidewall 124 located at the forefoot lateral side location of the sole structure 104. See particularly FIGS. 10B, 10D, 10F, and 12B. The midsole 140 lateral sidewall 144L forms an exposed exterior surface of this example sole structure 104. In this illustrated example, the lateral sidewall 144L of the midsole 140 includes a lateral sidewall top edge 144T, and this lateral sidewall top edge 144T includes a plurality of lateral recesses 140C extending toward the ground-facing surface 142G.

FIGS. 10B and 12B show the plurality of lateral recesses 140C as generally wave shaped (e.g., a wave shaped portion including at least two wave peaks and at least two wave valleys). Other recess shapes are possible, including the cutout shapes of the types described above in conjunction with FIGS. 1A-9J. The individual wave valleys 140C of this example sole structure 104 may have any of the size, location, and/or other features of any of the cutouts 140C described above in conjunction with the example of FIGS. 1A-9J. While the example sole structure 104 of FIGS. 10A-10K and 12A-12J includes two wave peaks and three wave valleys, any desired number of wave peaks and adjacent wave valleys may be provided without departing from this technology including from 2-8 wave peaks and/or valleys. These recesses 140C may assist in providing a desired amount of forefoot flexibility, e.g., for urban dance moves and/or other uses. In at least some examples of this technology, the plurality of lateral recesses 140C and the plurality of medial recesses 130C may correspond to one another. For example, in at least some examples of this technology, recesses 140C may be provided at approximately the same longitudinal distance forward in the sole length L direction as a corresponding recess 130C. If desired, each of the plurality of lateral recesses 140C may pair with and/or substantially align in a transverse direction across the sole structure 104 with a corresponding medial recess 130C in outsole component 120 and/or 130.

The midsole 140 in this illustrated example sole structure 104 includes an upper-facing surface 142U, a ground-facing surface 142G, a medial sidewall 142M, a lateral sidewall 144L, and a rear wall 142R. The upper-facing surface 142U may be contoured, e.g., to better support and conform to the shape of a wearer's foot. The upper-facing surface 142U of this example further includes one or more flex grooves 142A, 142B, 142C, e.g., in the forefoot area, to enhance flexibility.

Further, the ground-facing surface 142G of this example sole structure 104 includes two relatively deep flexion grooves 142Y and 142Z that extend across the midsole 140 in a generally lateral heel-to-medial forefoot direction. The flexion grooves 142Y and 142Z may extend completely from the medial sidewall 142M to the lateral sidewall 144L, although the illustrated grooves 142Y and 142Z terminate near the edges by not at the sidewalls 142M, 144 L. Although two flexion grooves 142Y, 142Z are shown in this illustrated example, more or fewer such flexion grooves (optionally oriented in the lateral heel-to-medial forefoot direction) may be included, such as from 2 to 8 such grooves, and optionally, from 3 to 6 such grooves. These flexion grooves 142Y and 142Z may have any of the features, properties, orientations, positions, angles, etc. as described above for flexion grooves 142W-142Z in conjunction with the examples of FIGS. 1A-9J. As shown in FIGS. 10G and 12F, the upper-facing surface 142U grooves 142A-142C are vertically staggered from the grooves 142Y and 142Z in the ground-facing surface 142G when the sole structure 104 is supported on a horizontal support surface on its ground-facing surface 120G.

FIGS. 10A-10C, 10G, 12A, 12B, 12D, and 12F further illustrate that a central region of the ground-facing surface 142G of midsole component 140 of this example (e.g., a midfoot supporting region located between a forefoot supporting region and a heel supporting region) includes plural transverse waves extending across the sole structure 104 (e.g., from the lateral side edge to the medial side edge). The plural transverse waves include plural wave peaks 340P and plural wave troughs 340T (e.g., at least two upwardly extending wave peaks 340P and at least two downwardly extending wave troughs 340T when the sole structure 104 is oriented on a horizontal base surface on its ground-facing surface 120G). While the illustrated example shows five wave peaks 340P separated by four wave troughs 340T, any desired numbers of peaks and troughs may be provided (e.g., from 2 to 8). Further, these wave peaks 340P and wave troughs 340T align with (e.g., vertically stack) with corresponding wave peaks 330P and wave troughs 330T formed in the first outsole component 120. Thus, the plural transverse waves of the midsole 140 may have any of the variations, features, etc. as described above with respect to the plural transverse waves of the first outsole component 120.

While potentially useful for many styles of footwear, as mentioned above, aspects of this technology are well suited for use in dance shoes, e.g., shoes and/or soles designed to support urban dance and urban dance moves. As some more specific examples, the two types of outsole materials (e.g., rubbers of two different hardnesses, and therefore slickness) and their relatively positioning and amounts can assist wearers in certain dance moves. For example, the harder material (e.g., rubber) and its positioning can assist dancers to better perform "glides," toe drags," and "spins," while the softer material (e.g., rubber) and its positioning helps for overall balance and support. The various materials, grooves, cutouts, and/or sipes (e.g., one or more of any of: (a) one or more of cutouts 130C and/or 144C; (b) one or more of outsole slits 126A and/or 126B; (c) one or more of gaps 128G1 and/or 128G2; (d) one or more of slits or sipes 148F1, 148F2, 148R1 and/or 148R2; (e) one or more of grooves 142W, 142X, 142Y, and/or 142Z); (f) the medial transition region 130T features; and/or (g) the lateral transition region 124T features—as well as the relative placement of two or more of these features—may assist and support various dance moves, such as the "W" and the "S-drop" (which moves tend to get the user onto the sides of the shoes and/or soles). Aspects of this technology support or assist in performance of other dance moves as well.

III. Conclusion

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A sole structure for an article of footwear, comprising:

a first material having a first hardness, wherein the first material forms at least a majority of a ground-facing surface of the sole structure; and a second material having a second hardness, wherein the second material extends from the first material and forms at least a first portion of an exterior surface of a sidewall of the sole structure, wherein the first portion of the exterior surface of the sidewall formed by the second material comprises a forefoot sidewall surface that includes at least a portion of a surface area of the exterior surface extending from: (i) a first forward toe location (and in some examples, a forefoot lateral side location) of the sole structure to (ii) a forefoot medial side location of the sole structure around a forward toe region of the sole structure, wherein the second hardness is at least 15 Shore A hardness points higher than the first hardness.

Clause 2. The sole structure of Clause 1, wherein the first portion of the exterior surface of the sidewall formed from the second material originates at a forefoot lateral side location of the sole structure proximate a fifth metatarsal head support region of the sole structure.

Clause 3. The sole structure of Clause 1 or 2, wherein the first portion of the exterior surface of the sidewall formed from the second material originates at the forefoot medial side location of the sole structure proximate a first metatarsal head support region of the sole structure.

Clause 4. The sole structure of Clause 1, wherein the sidewall of the sole structure includes a lateral side and a medial side, wherein the ground-facing surface of the sole structure includes a forefoot flex groove extending in a transverse direction across the sole structure from the lateral side to the medial side of the sole structure, and wherein all of the first portion of the exterior surface formed by the second material is located forward of the forefoot flex groove.

Clause 5. The sole structure of Clause 4, wherein at least a portion of the forefoot flex groove comprises an elongated slot.

Clause 6. The sole structure of Clause 4 or 5, wherein at least a portion of the forefoot flex groove comprises a through-hole that extends through the first material.

Clause 7. The sole structure of any one of Clauses 4 to 6, wherein the forefoot flex groove is a forwardmost flex groove defined in the sole structure that is formed as an elongated slot and extends continuously from the lateral side to the medial side.

Clause 8. The sole structure of any one of Clauses 1 to 7, wherein the first material and the second material are fixed together to form an integral, one piece outsole component.

Clause 9. The sole structure of Clause 8, wherein the first material and the second material are fixed together by a melt-bond junction and/or a cross-linked junction.

Clause 10. The sole structure of any one of Clauses 1 to 9, wherein a transition region extends between the ground-facing surface of the sole structure and the sidewall of the sole structure, wherein the transition region is formed by the second material at least at the forefoot medial side location of the sole structure.

Clause 11. The sole structure of Clause 10, wherein the transition region is formed by the second material at a forefoot lateral side location of the sole structure.

Clause 12. The sole structure of Clause 10 or 11, wherein the transition region is formed by the second material at the forward toe region of the sole structure.

Clause 13. The sole structure of any one of Clauses 1 to 12, wherein the second material extends from the sidewall of the sole structure to the ground-facing surface of the sole structure such that the second material forms a portion of a perimeter of the ground-facing surface of the sole structure around the forward toe region of the sole structure.

Clause 14. The sole structure of Clause 13, wherein the portion of the perimeter formed by the second material has a width dimension of less than 15 mm wide.

Clause 15. The sole structure of any one of Clauses 1 to 14, wherein the first material and the second material are fixed together to form an outsole component.

Clause 16. The sole structure of Clause 15, wherein the outsole component constitutes a single component part including a heel supporting region, a forefoot supporting region, and a central region connecting the heel supporting region and the forefoot supporting region.

Clause 17. The sole structure of Clause 16, wherein the central region includes plural transverse waves having wave peaks and wave troughs extending from a lateral edge to a medial edge of the sole structure.

Clause 18. The sole structure of Clause 17, wherein at least one wave peak includes a groove extending completely through the outsole component.

Clause 19. The sole structure of Clause 17, wherein only one wave peak of the plural transverse waves has a groove extending completely through the outsole component.

Clause 20. The sole structure of Clause 19, wherein said only one wave peak is a rearmost wave peak of the plural transverse waves.

Clause 21. The sole structure of any one of Clauses 17 to 20, wherein the outsole component includes an upper-facing surface opposite the ground-facing surface, wherein the plural transverse waves are present on either or both of the upper-facing surface and the ground-facing surface.

Clause 22. The sole structure of any one of Clauses 1 to 21, wherein the first material and the second material are fixed together to form an outsole component having at least a forefoot supporting region.

Clause 23. The sole structure of Clause 22, wherein the ground-facing surface at the forefoot supporting region includes: (a) a central traction element, (b) a first plurality of traction elements arranged around and located immediately adjacent the central traction element, and (c) a second plurality of traction elements arranged around the first plurality of traction elements, wherein each of a majority of the traction elements of the second plurality of traction elements is located immediately adjacent at least one of the traction elements of the first plurality of traction elements.

Clause 24. The sole structure of Clause 23, wherein the first plurality of traction elements are arranged in a first ring around the central traction element, and wherein the second plurality of traction elements are arranged in a second ring around the first plurality of traction elements.

Clause 25. The sole structure of Clause 24, wherein the first ring and the second ring are concentric.

Clause 26. The sole structure of Clause 25, wherein the first ring and the second ring are circular, oval, or elliptical rings.

Clause 27. The sole structure of any one of Clauses 22 to 26, wherein the central traction element is located closer to a medial side edge of the sole structure than to a lateral side edge of the sole structure.

Clause 28. The sole structure of any one of Clauses 22 to 27, wherein the outsole component further includes a heel supporting region.

Clause 29. The sole structure of Clause 28, wherein the ground-facing surface at the heel supporting region includes: (a) a second central traction element, (b) a third plurality of traction elements arranged around and located immediately adjacent the second central traction element, and (c) a fourth plurality of traction elements arranged around the third plurality of traction elements, wherein each of a majority of the traction elements of the fourth plurality of traction elements is located immediately adjacent at least one of the traction elements of the third plurality of traction elements.

Clause 30. The sole structure of Clause 29, wherein the third plurality of traction elements are arranged in a third ring around the second central traction element, and wherein the fourth plurality of traction elements are arranged in a fourth ring around the third plurality of traction elements.

Clause 31. The sole structure of Clause 30, wherein the third ring and the fourth ring are concentric.

Clause 32. The sole structure of Clause 31, wherein the third ring and the fourth ring are circular, oval, or elliptical rings.

Clause 33. The sole structure of any one of Clauses 29 to 32, wherein the second central traction element is located at a central heel support area of the heel supporting region.

Clause 34. The sole structure of any one of Clauses 1 to 14, wherein the first material and the second material are fixed together to form an outsole component having at least a heel supporting region.

Clause 35. The sole structure of Clause 34, wherein the ground-facing surface at the heel supporting region includes: (a) a central traction element, (b) a first plurality of traction elements arranged around and located immediately adjacent the central traction element, and (c) a second plurality of traction elements arranged around the first plurality of traction elements, wherein each of a majority of the traction elements of the second plurality of traction elements is located immediately adjacent at least one of the traction elements of the first plurality of traction elements.

Clause 36. The sole structure of Clause 35, wherein the first plurality of traction elements are arranged in a first ring around the central traction element, and wherein the second plurality of traction elements are arranged in a second ring around the first plurality of traction elements.

Clause 37. The sole structure of Clause 36, wherein the first ring and the second ring are concentric.

Clause 38. The sole structure of Clause 37, wherein the first ring and the second ring are circular, oval, or elliptical rings.

Clause 39. The sole structure of any one of Clauses 34 to 38, wherein the central traction element is located at a central heel support area of the heel supporting region.

Clause 40. The sole structure of any one of Clauses 1 to 39, wherein the sidewall of the sole structure includes a medial sidewall top edge, wherein the medial sidewall top edge includes a wave shaped portion including at least two wave peaks and at least two wave valleys spaced apart in an anterior-to-posterior direction of the sole structure.

Clause 41. The sole structure of any one of Clauses 1 to 40, wherein the first material and the second material form an outsole component, and wherein the sole structure further comprises: a midsole component engaged with the outsole component.

Clause 42. The sole structure of Clause 41, wherein the midsole component comprises a polymeric foam member.

Clause 43. The sole structure of Clause 41 or 42, wherein the midsole component includes a forefoot support region, a central support region, and a heel support region.

Clause 44. The sole structure of Clause 43, wherein the midsole component includes a fluid-filled bladder in the heel support region.

Clause 45. The sole structure of any one of Clauses 41 to 43, wherein the midsole component includes a fluid-filled bladder.

Clause 46. The sole structure of any one of Clauses 41 to 45, wherein the midsole component forms a lateral sidewall of the sole structure rearward of a forefoot lateral side location of the sole structure formed from the second material.

Clause 47. The sole structure of Clause 46, wherein the lateral sidewall of the sole structure formed by the midsole component includes a lateral sidewall top edge, wherein the lateral sidewall top edge includes a wave shaped portion including at least two wave peaks and at least two wave valleys spaced apart in an anterior-to-posterior direction of the sole structure.

Clause 48. A sole structure for an article of footwear, comprising:

an outsole component including a ground-facing surface, an upper-facing surface opposite the ground facing surface, and an outsole sidewall extending from the ground-facing surface, the outsole sidewall extending continuously from: (i) a forefoot lateral side location of the sole structure to (ii) a forefoot or midfoot medial side location of the sole structure around a forward toe region of the sole structure, wherein the outsole sidewall includes a medial sidewall top edge, and wherein the medial sidewall top edge includes a plurality of medial recesses extending toward the ground-facing surface; and a midsole component including a polymeric foam element engaged with the upper-facing surface of the outsole component, wherein the midsole component forms a lateral sidewall of the sole structure rearward of a lateral side end of the outsole sidewall located at the forefoot lateral side location of the sole structure, wherein the lateral sidewall includes a lateral sidewall top edge, and wherein the lateral sidewall top edge includes a plurality of lateral recesses extending toward the ground-facing surface.

Clause 49. The sole structure of Clause 48, wherein the plurality of lateral recesses includes: (a) a wave shaped portion having at least two wave peaks and at least two wave valleys spaced apart in an anterior-to-posterior direction of the sole structure, or (b) a plurality of cutouts spaced apart in the anterior-to-posterior direction of the sole structure.

Clause 50. The sole structure of Clause 48 or 49, wherein the plurality of medial recesses includes: (a) a wave shaped portion having at least two wave peaks and at least two wave valleys spaced apart in an anterior-to-posterior direction of the sole structure, or (b) a plurality of cutouts spaced apart in the anterior-to-posterior direction of the sole structure.

Clause 51. The sole structure of Clause 48, wherein the plurality of lateral recesses includes: (a) a wave shaped portion having at least two wave peaks and at least two wave valleys spaced apart in an anterior-to-posterior direction of the sole structure, or (b) a plurality of cutouts spaced apart in the anterior-to-posterior direction of the sole structure; and wherein the plurality of medial recesses includes: (a) a wave shaped portion having at least two wave peaks and at least two wave valleys spaced apart in an anterior-to-posterior direction of the sole structure, or (b) a plurality of cutouts spaced apart in the anterior-to-posterior direction of the sole structure, and wherein the plurality of lateral recesses and the plurality of medial recesses substantially align in a transverse direction across the sole structure in a forefoot region of the sole structure.

Clause 52. The sole structure of any one of Clauses 48 to 51, wherein the outsole component includes: (a) a first material having a first hardness forming at least a portion of the ground-facing surface, and (b) a second material having a second hardness greater than the first hardness forming at least a portion of a surface area of an exterior surface of the outsole sidewall.

Clause 53. The sole structure of Clause 52, wherein the second hardness is at least 15 Shore A hardness points higher than the first hardness.

Clause 54. The sole structure of Clause 52 or 53, wherein the second material forming the portion of the exterior surface of the outsole sidewall originates proximate a fifth metatarsal head support region of the sole structure.

Clause 55. The sole structure of any of Clauses 52 to 54, wherein the second material forming the portion of the exterior surface of the outsole sidewall originates proximate a first metatarsal head support region of the sole structure.

Clause 56. The sole structure of any of Clauses 52 to 55, wherein the ground-facing surface of the outsole component includes a forefoot flex groove extending in a transverse direction across the sole structure from a lateral side of the sole structure to a medial side of the sole structure, and wherein all of the second material of the outsole sidewall is located forward of the forefoot flex groove.

Clause 57. The sole structure of Clause 56, wherein at least a portion of the forefoot flex groove comprises an elongated slot.

Clause 58. The sole structure of Clause 56 or 57, wherein at least a portion of the forefoot flex groove comprises a through-hole that extends through the first material.

Clause 59. The sole structure of any one of Clauses 56 to 58, wherein the forefoot flex groove is a forwardmost flex groove defined in the outsole component that is formed as an elongated slot and extends continuously from the lateral side to the medial side of the sole structure.

Clause 60. The sole structure of any of Clauses 48 to 59, wherein the outsole component constitutes a single component part including a heel supporting region, a forefoot supporting region, and a central region connecting the heel supporting region and the forefoot supporting region.

Clause 61. The sole structure of Clause 60, wherein the central region includes plural transverse waves having wave peaks and wave troughs extending from a lateral edge to a medial edge of the sole structure.

Clause 62. The sole structure of Clause 61, wherein at least one wave peak of the plural transverse waves includes a groove extending completely through the outsole component.

Clause 63. The sole structure of Clause 61, wherein only one wave peak of the plural transverse waves has a groove extending completely through the outsole component.

Clause 64. The sole structure of Clause 63, wherein said only one wave peak is a rearmost wave peak of the plural transverse waves.

Clause 65. The sole structure of any one of Clauses 61 to 64, wherein the plural transverse waves are present on either or both of the upper-facing surface and the ground-facing surface.

Clause 66. The sole structure of any one of Clauses 48 to 65, wherein the outsole component includes at least a forefoot supporting region, and wherein the ground-facing surface at the forefoot supporting region includes: (a) a central traction element, (b) a first plurality of traction elements arranged around and located immediately adjacent the central traction element, and (c) a second plurality of traction elements arranged around the first plurality of traction elements, wherein each of a majority of the traction elements of the second plurality of traction elements is located immediately adjacent at least one of the traction elements of the first plurality of traction elements.

Clause 67. The sole structure of Clause 66, wherein the first plurality of traction elements are arranged in a first ring around the central traction element, and wherein the second plurality of traction elements are arranged in a second ring around the first plurality of traction elements.

Clause 68. The sole structure of Clause 67, wherein the first ring and the second ring are concentric.

Clause 69. The sole structure of Clause 68, wherein the first ring and the second ring are circular, oval, or elliptical rings.

Clause 70. The sole structure of any one of Clauses 66 to 69, wherein the central traction element is located closer to a medial side edge of the outsole component than to a lateral side edge of the outsole component.

Clause 71. The sole structure of any one of Clauses 66 to 70, wherein the outsole component further includes a heel supporting region.

Clause 72. The sole structure of Clause 71, wherein the ground-facing surface at the heel supporting region includes: (a) a second central traction element, (b) a third plurality of traction elements arranged around and located immediately adjacent the second central traction element, and (c) a fourth plurality of traction elements arranged around the third plurality of traction elements, wherein each of a majority of the traction elements of the fourth plurality of traction elements is located immediately adjacent at least one of the traction elements of the third plurality of traction elements.

Clause 73. The sole structure of Clause 72, wherein the third plurality of traction elements are arranged in a third ring around the second central traction element, and wherein the fourth plurality of traction elements are arranged in a fourth ring around the third plurality of traction elements.

Clause 74. The sole structure of Clause 73, wherein the third ring and the fourth ring are concentric.

Clause 75. The sole structure of Clause 74, wherein the third ring and the fourth ring are circular, oval, or elliptical rings.

Clause 76. The sole structure of any one of Clauses 72 to 75, wherein the second central traction element is located at a central heel support area of the heel supporting region.

Clause 77. The sole structure of any one of Clauses 48 to 65, wherein the outsole component includes at least a heel supporting region, and wherein the ground-facing surface at the heel supporting region includes: (a) a central traction element, (b) a first plurality of traction elements arranged around and located immediately adjacent the central traction element, and (c) a second plurality of traction elements arranged around the first plurality of traction elements, wherein each of a majority of the traction elements of the second plurality of traction elements is located immediately adjacent at least one of the traction elements of the first plurality of traction elements.

Clause 78. The sole structure of Clause 77, wherein the first plurality of traction elements are arranged in a first ring around the central traction element, and wherein the second plurality of traction elements are arranged in a second ring around the first plurality of traction elements.

Clause 79. The sole structure of Clause 78, wherein the first ring and the second ring are concentric.

Clause 80. The sole structure of Clause 79, wherein the first ring and the second ring are circular, oval, or elliptical rings.

Clause 81. The sole structure of any one of Clauses 77 to 80, wherein the central traction element is located at a central heel support area of the heel supporting region.

Clause 82. The sole structure of any one of Clauses 48 to 81, wherein the midsole component includes a forefoot support region, a central support region, and a heel support region.

Clause 83. The sole structure of Clause 82, wherein the midsole component includes a fluid-filled bladder in the heel support region.

Clause 84. The sole structure of any one of Clauses 48 to 82, wherein the midsole component includes a fluid-filled bladder.

Clause 85. A sole structure for an article of footwear, comprising:

a first material having a first hardness, wherein the first material forms at least a majority of a ground-facing surface of the sole structure; and a second material having a second hardness, wherein the second material extends from the first material and forms at least a first portion of an exterior surface of a sidewall of the sole structure, wherein the first portion of the exterior surface of the sidewall formed by the second material comprises a forefoot medial sidewall surface that includes at least a majority of a surface area of the exterior surface extending from: (i) a first forward toe location of the sole structure to (ii) a forefoot medial side location of the sole structure rearward of a first metatarsal head support region of the sole structure, wherein the second hardness is at least 18 Shore A hardness points higher than the first hardness.

Clause 86. The sole structure of Clause 85, wherein the first portion of the exterior surface of the sidewall formed by the second material further comprises a forefoot lateral sidewall surface that includes at least a majority of the surface area of the exterior surface extending from a second forward toe location at a forefoot lateral side location of the sole structure to a location rearward of a fifth metatarsal head support region of the sole structure.

Clause 87. The sole structure of Clause 85 or 86, wherein, with the sole structure supported on the ground-facing surface in an unloaded condition, a forefoot lateral sidewall of the sole structure comprises:

a rear top edge, a rear side edge extending downward from the rear top edge, a forward top edge, a forward side edge extending downward from the forward top edge, and an intermediate top edge extending from the rear side edge to the forward side edge and for a longitudinal distance of at least 25 mm, wherein the intermediate top edge is spaced vertically downward with respect to the rear top edge and the forward top edge by a distance of at least 10 mm.

Clause 88. The sole structure of Clause 87, further comprising:

an upper-facing surface located opposite the ground-facing surface; and a midsole engaged with the upper-facing surface and extending from a forefoot medial sidewall of the sole structure to the forefoot lateral sidewall, wherein an exterior surface of a sidewall of the midsole is exposed at an exterior surface of the sole structure extending above the intermediate top edge and from the rear side edge to the forward side edge.

Clause 89. The sole structure of Clause 88, wherein the sidewall of the midsole defines a first cutout extending from a top edge of the midsole.

Clause 90. The sole structure of Clause 88, wherein the sidewall of the midsole defines a plurality of cutouts extending from a top edge of the midsole.

Clause 91. The sole structure of Clause 85 or 86, further comprising:

an upper-facing surface located opposite the ground-facing surface; and a midsole engaged with the upper-facing surface and extending from a forefoot medial sidewall of the sole structure that includes the forefoot medial sidewall surface to a forefoot lateral sidewall of the sole structure.

Clause 92. The sole structure of any one of Clauses 85 to 87, wherein the first material and the second material comprise a first sole component as a unitary, one-piece construction, wherein the first sole component includes a rearmost end.

Clause 93. The sole structure of Clause 92, wherein a slit is defined completely through the first sole component forward of the rearmost end and extending for at least 50 mm from a lateral perimeter side edge of the first sole component toward but not completely to the forefoot medial sidewall surface.

Clause 94. The sole structure of Clause 93, wherein the first sole component defines an upper-facing surface, wherein the sole structure further comprises: a midsole having a ground-facing surface engaged with the upper-facing surface of the first sole component.

Clause 95. The sole structure of Clause 94, wherein the ground-facing surface of the midsole includes a first flexion groove defined therein and vertically aligned with the slit.

Clause 96. The sole structure of Clause 92 or Clause 93, wherein the rearmost end is located in a midfoot region of the sole structure.

Clause 97. The sole structure of any one of Clauses 92, 93, or 96, further comprising: a second sole component located rearward and spaced from the first sole component by a first gap.

Clause 98. The sole structure of Clause 97, further comprising: a third sole component located rearward and spaced from the second sole component by a second gap.

Clause 99. The sole structure of Clause 98, wherein each of the first sole component, the second sole component, and the third sole component defines an upper-facing surface, wherein the sole structure further comprises:

a midsole having a ground-facing surface engaged with the upper-facing surface of each of the first sole component, the second sole component, and the third sole component.

Clause 100. The sole structure of Clause 99, wherein the ground-facing surface of the midsole includes: (a) a first flexion groove defined therein and vertically aligned with the slit, (b) a second flexion groove defined therein and vertically aligned with the first gap, and (c) a third flexion groove defined therein and vertically aligned with the second gap.

Clause 101. The sole structure of Clause 97, wherein each of the first sole component and the second sole component defines an upper-facing surface, wherein the sole structure further comprises:

a midsole having a ground-facing surface engaged with the upper-facing surface of each of the first sole component and the second sole component.

Clause 102. The sole structure of Clause 101, wherein the ground-facing surface of the midsole includes: (a) a first flexion groove defined therein and vertically aligned with the slit, and (b) a second flexion groove defined therein and vertically aligned with the first gap.

Clause 103. The sole structure of any one of Clauses 85 to 87, wherein the first material and the second material comprise a first sole component as a unitary, one-piece construction, wherein the first sole component includes a rearmost end, wherein a first slit is defined completely through the first sole component forward of the rearmost end and extending for at least 50 mm from a lateral perimeter side edge of the first sole component toward but not completely to the forefoot medial sidewall surface, and wherein a second slit is defined completely through the first sole component forward of the first slit and extending for at least 50 mm from the lateral perimeter side edge of the first sole component toward but not completely to the forefoot medial sidewall surface.

Clause 104. The sole structure of Clause 103, wherein the first sole component defines an upper-facing surface, wherein the sole structure further comprises: a midsole having a ground-facing surface engaged with the upper-facing surface of the first sole component.

Clause 105. The sole structure of Clause 104, wherein the ground-facing surface of the midsole includes a first flexion groove defined therein and aligned with the first slit and a second flexion groove defined therein and aligned with the second slit.

Clause 106. The sole structure of Clause 103, wherein the rearmost end is located in a midfoot region of the sole structure.

Clause 107. The sole structure of Clause 103 or 106, further comprising: a second sole component located rearward and spaced from the first sole component by a first gap.

Clause 108. The sole structure of Clause 107, further comprising: a third sole component located rearward and spaced from the second sole component by a second gap.

Clause 109. The sole structure of Clause 108, wherein each of the first sole component, the second sole component, and the third sole component defines an upper-facing surface, wherein the sole structure further comprises:

a midsole having a ground-facing surface engaged with the upper-facing surface of each of the first sole component, the second sole component, and the third sole component.

Clause 110. The sole structure of Clause 109, wherein the ground-facing surface of the midsole includes: (a) a first flexion groove defined therein and aligned with the first slit, (b) a second flexion groove defined therein and aligned with the second slit, (c) a third flexion groove defined therein and aligned with the first gap, and (d) a fourth flexion groove defined therein and aligned with the second gap.

Clause 111. The sole structure of any one of Clauses 85 to 110, wherein a forefoot medial sidewall of the sole structure that includes the forefoot medial sidewall surface comprises a top edge, and wherein a first cutout extends from the top edge of the forefoot medial sidewall.

Clause 112. The sole structure of any one of Clauses 85 to 110, wherein a forefoot medial sidewall of the sole structure that includes the forefoot medial sidewall surface comprises a top edge, and wherein a plurality of cutouts extend from the top edge of the forefoot medial sidewall.

Clause 113. The sole structure of any one of Clauses 85 to 112, wherein the first hardness is between 50 Shore A and 75 Shore A, and the second hardness is between 80 Shore A and 110 Shore A.

Clause 114. The sole structure of any one of Clauses 85 to 112, wherein the first hardness is between 55 Shore A and 72 Shore A, and the second hardness is between 88 Shore A and 100 Shore A.

Clause 115. The sole structure of any one of Clauses 85 to 112, wherein the first hardness is below 75 Shore A, and the second hardness is above 85 Shore A.

Clause 116. The sole structure of any one of Clauses 85 to 115, wherein a medial transition region connects the forefoot medial sidewall surface with the ground-facing surface of the sole structure, and wherein a first portion of the medial transition region has a first curvature that is greater than a 5.5 mm radius.

Clause 117. The sole structure of Clause 116, wherein a second portion of the medial transition region located forward of the first portion of the medial transition region includes a second curvature, wherein the second curvature is greater than a 5 mm radius and less than the first curvature, and wherein the medial transition region smoothly changes curvature from the second curvature to the first curvature in a direction moving rearward in the sole structure.

Clause 118. The sole structure of Clause 115 or 116, further comprising:

a forward toe sidewall extending from the first forward toe location to a second forward toe location and from a forefoot medial sidewall that includes the forefoot medial sidewall surface to a forefoot lateral sidewall; and a forward toe transition region extending from the ground-facing surface to the forward toe sidewall, wherein curvature of the forward toe transition region increases moving in a direction from the forefoot lateral sidewall to the forefoot medial sidewall.

Clause 119. The sole structure of Clause 115 or 116, wherein at least a majority of the ground-facing surface in a forefoot support area of the sole structure is formed as a first sole component, and wherein at least a majority of a forefoot medial sidewall that includes the forefoot medial sidewall surface is formed as a second sole component that is engaged with the first sole component.

Clause 120. The sole structure of any one of Clauses 85 to 119, wherein the first material and the second material are fixedly engaged together by a melt-bonded and/or cross-linked connection to form a unitary, one-piece construction.

Clause 121. The sole structure of Clause 120, wherein the first material and the second material are fixedly engaged together by an in-molded connection.

Clause 122. The sole structure of any one of Clauses 85 to 121, wherein the sole structure includes a lateral sidewall extending from a heel region to a midfoot region of the sole structure, wherein a first inwardly extending slit is defined in the lateral sidewall, wherein the first inwardly extending slit extends continuously from the heel region to the midfoot region.

Clause 123. The sole structure of Clause 122, wherein a second inwardly extending slit is defined in the lateral sidewall, wherein the first inwardly extending slit extends continuously from the heel region to the midfoot region and is spaced below the first inwardly extending slit.

Clause 124. The sole structure of Clause 123, wherein the second inwardly extending slit is formed as a space between surfaces of two distinct components of the sole structure.

Clause 125. The sole structure of Clause 122 or 123, wherein the lateral sidewall further extends in a forefoot region of the sole structure, wherein a third inwardly extending slit is defined in the lateral sidewall in the forefoot region.

Clause 126. The sole structure of any one of Clauses 85 to 121, wherein the sole structure includes a lateral sidewall extending at least within a forefoot region of the sole structure, wherein a first inwardly extending slit is defined in the lateral sidewall in the forefoot region.

Clause 127. A sole structure for an article of footwear, comprising:

a ground-facing surface;

a forefoot medial sidewall extending from a first forward toe location of the sole structure to a forefoot medial side location of the sole structure rearward of a first metatarsal head support region of the sole structure;

a medial transition region extending from the ground-facing surface to the forefoot medial sidewall, wherein the medial transition region includes a first portion having a first curvature, and wherein the first curvature extends continuously in an anterior-to-posterior direction of the sole structure for a distance of at least 25 mm;

a forefoot lateral sidewall extending from a second forward toe location to a forefoot lateral side location of the sole structure rearward of a fifth metatarsal head support region of the sole structure; and a lateral transition region extending from the ground-facing surface to the forefoot lateral sidewall, wherein the lateral transition region includes a corner or a second curvature, and wherein the corner or the second curvature extends continuously in the anterior-to-posterior direction of the sole structure for a distance of at least 25 mm, wherein the first curvature is greater than a 5 mm radius, and wherein the corner or the second curvature has less than a 5 mm radius.

Clause 128. The sole structure of Clause 127, wherein a second portion of the medial transition region located forward of the first portion includes a third curvature, wherein the third curvature is greater than a 5 mm radius and less than the first curvature, and wherein the medial transition region smoothly changes curvature from the third curvature to the first curvature in the anterior-to-posterior direction of the sole structure.

Clause 129. The sole structure of Clause 127 or 128, further comprising:

a forward toe sidewall extending from the first forward toe location to the second forward toe location and from the forefoot medial sidewall to the forefoot lateral sidewall; and a forward toe transition region extending from the ground-facing surface to the forward toe sidewall, wherein curvature of the forward toe transition region increases in a direction around the forward toe location from the lateral transition region to the medial transition region.

Clause 130. The sole structure of Clause 129, wherein at least a majority of the ground-facing surface in a forefoot support area of the sole structure is formed as a first sole component, and wherein at least a majority of the forefoot medial sidewall, the medial transition region, the forefoot lateral sidewall, the lateral transition region, the forward toe sidewall, and the forward toe transition region are formed as a second sole component that is engaged with the first sole component.

Clause 131. The sole structure of any one of Clauses 127 to 129, wherein a majority of an exposed exterior surface area of the ground-facing surface is formed from a softer material than a material forming a majority of an exposed exterior surface area of the forefoot medial sidewall and the medial transition region.

Clause 132. The sole structure of any one of Clauses 127 to 129 or Clause 131, wherein at least a majority of the ground-facing surface in a forefoot support area of the sole structure is formed as a first sole component, and wherein at least a majority of the forefoot medial sidewall and the medial transition region are formed as a second sole component that is engaged with the first sole component.

Clause 133. The sole structure of any one of Clauses 127 to 129 or Clause 131, wherein at least a majority of the ground-facing surface in a forefoot support area of the sole structure is formed as a first sole component, and wherein at least a majority of the forefoot medial sidewall, the medial transition region, the forefoot lateral sidewall, and the lateral transition region are formed as a second sole component that is engaged with the first sole component.

Clause 134. The sole structure of any one of Clauses 127 to 133, wherein, with the sole structure supported on the ground-facing surface in an unloaded condition, the forefoot lateral sidewall includes:

a rear top edge, a rear side edge extending downward from the rear top edge, a forward top edge, a forward side edge extending downward from the forward top edge, and an intermediate top edge extending from the rear side edge to the forward side edge and for a longitudinal distance of at least 25 mm, wherein the intermediate top edge is spaced vertically downward with respect to the rear top edge and the forward top edge by a distance of at least 10 mm.

Clause 135. The sole structure of Clause 134, further comprising:

an upper-facing surface located opposite the ground-facing surface; and a midsole engaged with the upper-facing surface and extending from the forefoot medial sidewall to the forefoot lateral sidewall, wherein an exterior surface of a sidewall of the midsole is exposed at an exterior surface of the sole structure extending above the intermediate top edge and from the rear side edge to the forward side edge.

Clause 136. The sole structure of Clause 135, wherein the sidewall of the midsole defines a first cutout extending from a top edge of the midsole.

Clause 137. The sole structure of Clause 135, wherein the sidewall of the midsole defines a plurality of cutouts extending from a top edge of the midsole.

Clause 138. The sole structure of Clause 134, further comprising:

an upper-facing surface located opposite the ground-facing surface; and a midsole engaged with the upper-facing surface and extending from the forefoot medial sidewall to the forefoot lateral sidewall.

Clause 139. The sole structure of any one of Clauses 127 to 138, wherein a first sole component of the sole structure includes a rearmost end located in a forefoot support region or a midfoot support region of the sole structure.

Clause 140. The sole structure of Clause 139, wherein a slit is defined completely through the first sole component forward of the rearmost end and extending for at least 50 mm from a lateral perimeter side edge of the first sole component toward but not completely to the forefoot medial sidewall.

Clause 141. The sole structure of Clause 140, wherein the first sole component further includes an upper-facing surface, wherein the sole structure further comprises: a midsole having a ground-facing surface engaged with the upper-facing surface of the first sole component.

Clause 142. The sole structure of Clause 141, wherein the ground-facing surface of the midsole includes a first flexion groove defined therein and vertically aligned with the slit.

Clause 143. The sole structure of Clause 139 or 140, further comprising: a second sole component located rearward and spaced from the first sole component by a first gap.

Clause 144. The sole structure of Clause 143, further comprising: a third sole component located rearward and spaced from the second sole component by a second gap.

Clause 145. The sole structure of Clause 144, wherein each of the first sole component, the second sole component, and the third sole component defines an upper-facing surface, wherein the sole structure further comprises:

a midsole having a ground-facing surface engaged with the upper-facing surface of each of the first sole component, the second sole component, and the third sole component.

Clause 146. The sole structure of Clause 145, wherein the ground-facing surface of the midsole includes: (a) a first flexion groove defined therein and vertically aligned with the slit, (b) a second flexion groove defined therein and vertically aligned with the first gap, and (c) a third flexion groove defined therein and vertically aligned with the second gap.

Clause 147. The sole structure of Clause 143, wherein each of the first sole component and the second sole component defines an upper-facing surface, wherein the sole structure further comprises:

a midsole having a ground-facing surface engaged with the upper-facing surface of each of the first sole component and the second sole component.

Clause 148. The sole structure of Clause 147, wherein the ground-facing surface of the midsole includes: (a) a first flexion groove defined therein and vertically aligned with the slit, and (b) a second flexion groove defined therein and vertically aligned with the first gap.

Clause 149. The sole structure of any one of Clauses 127 to 138, wherein a first sole component of the sole structure includes a rearmost end located in a forefoot support region or a midfoot support region of the sole structure, wherein a first slit is defined completely through the first sole component forward of the rearmost end and extending for at least 50 mm from a lateral perimeter side edge of the first sole component toward but not completely to the forefoot medial sidewall, and wherein a second slit is defined completely through the first sole component forward of the first slit and extending for at least 50 mm from the lateral perimeter side edge of the first sole component toward but not completely to the forefoot medial sidewall.

Clause 150. The sole structure of Clause 149, wherein the first sole component further includes an upper-facing surface, wherein the sole structure further comprises: a midsole having a ground-facing surface engaged with the upper-facing surface of the first sole component.

Clause 151. The sole structure of Clause 150, wherein the ground-facing surface of the midsole includes a first flexion groove defined therein and vertically aligned with the first slit and a second flexion groove defined therein and aligned with the second slit.

Clause 152. The sole structure of Clause 149, further comprising: a second sole component located rearward and spaced from the first sole component by a first gap.

Clause 153. The sole structure of Clause 152, further comprising: a third sole component located rearward and spaced from the second sole component by a second gap.

Clause 154. The sole structure of Clause 153, wherein each of the first sole component, the second sole component, and the third sole component defines an upper-facing surface, wherein the sole structure further comprises:

a midsole having a ground-facing surface engaged with the upper-facing surface of each of the first sole component, the second sole component, and the third sole component.

Clause 155. The sole structure of Clause 154, wherein the ground-facing surface of the midsole includes: (a) a first flexion groove defined therein and aligned with the first slit, (b) a second flexion groove defined therein and aligned with the second slit, (c) a third flexion groove defined therein and aligned with the first gap, and (c) a fourth flexion groove defined therein and aligned with the second gap.

Clause 156. The sole structure of any one of Clauses 127 to 155, wherein at least a majority of the ground-facing surface is made from a material having a hardness between 50 Shore A and 75 Shore A, and wherein at least a majority of the forefoot medial sidewall is made from a material having a hardness between 80 Shore A and 110 Shore A.

Clause 157. The sole structure of any one of Clauses 127 to 155, wherein at least a majority of the ground-facing surface is made from a material having a hardness between 55 Shore A and 72 Shore A, and wherein at least a majority of the forefoot medial sidewall is made from a material having a hardness is between 88 Shore A and 100 Shore A.

Clause 158. The sole structure of any one of Clauses 127 to 155, wherein at least a majority of the ground-facing surface is made from a material having a hardness below 75 Shore A, and wherein at least a majority of the forefoot medial sidewall is made from a material having a hardness above 85 Shore A.

Clause 159. The sole structure of any one of Clauses 127 to 158, wherein the sole structure includes a lateral sidewall extending from a heel region to a midfoot region of the sole structure, wherein a first inwardly extending slit is defined in the lateral sidewall, wherein the first inwardly extending slit extends continuously from the heel region to the midfoot region.

Clause 160. The sole structure of Clause 159, wherein a second inwardly extending slit is defined in the lateral sidewall, wherein the first inwardly extending slit extends continuously from the heel region to the midfoot region and is spaced below the first inwardly extending slit.

Clause 161. The sole structure of Clause 160, wherein the second inwardly extending slit is formed as a space between surfaces of two distinct components of the sole structure.

Clause 162. The sole structure of Clause 159 or 160, wherein a third inwardly extending slit is defined in the forefoot lateral sidewall.

Clause 163. The sole structure of any one of Clauses 127 to 158, wherein a first inwardly extending slit is defined in the forefoot lateral sidewall.

Clause 164. A sole structure for an article of footwear, comprising:

a first sole component including a ground-facing surface of the sole structure; and a second sole component extending from the first sole component and including a sidewall of the sole structure, wherein the sidewall comprises: (i) a forward toe sidewall at a forward toe location of the sole structure and (ii) a forefoot medial sidewall at a forefoot medial side location of the sole structure, wherein the forefoot medial sidewall extends from the forward toe sidewall to a location at least rearward of a first metatarsal head support region of the sole structure, wherein at least a majority of the forefoot medial sidewall has a hardness at least 15 Shore A hardness points higher than a hardness of a majority of the ground-facing surface of the first sole component.

Clause 165. The sole structure of Clause 164, wherein the second sole component further includes a forefoot lateral sidewall at a forefoot lateral side location of the sole structure extending to a location at least rearward of a fifth metatarsal head support region of the sole structure.

Clause 166. The sole structure of Clause 165, wherein, with the sole structure supported on the ground-facing surface in an unloaded condition, the forefoot lateral sidewall includes:

a rear top edge, a rear side edge extending downward from the rear top edge, a forward top edge, a forward side edge extending downward from the forward top edge, and an intermediate top edge extending from the rear side edge to the forward side edge and for a longitudinal distance of at least 25 mm, wherein the intermediate top edge is spaced vertically downward with respect to the rear top edge and the forward top edge by a distance of at least 10 mm.

Clause 167. The sole structure of Clause 166, wherein the first sole component further includes an upper-facing surface located opposite the ground-facing surface, and wherein the sole structure further comprises:

a midsole engaged with the upper-facing surface and extending from the forefoot medial sidewall to the forefoot lateral sidewall, wherein an exterior surface of a sidewall of the midsole is exposed at an exterior surface of the sole structure extending above the intermediate top edge and from the rear side edge to the forward side edge.

Clause 168. The sole structure of Clause 167, wherein the sidewall of the midsole defines a first cutout extending from a top edge of the midsole.

Clause 169. The sole structure of Clause 167, wherein the sidewall of the midsole defines a plurality of cutouts extending from a top edge of the midsole.

Clause 170. The sole structure of Clause 165 or 166, wherein the first sole component further includes an upper-facing surface located opposite the ground-facing surface, and wherein the sole structure further comprises:

a midsole engaged with the upper-facing surface and extending from the forefoot medial sidewall to the forefoot lateral sidewall.

Clause 171. The sole structure of any one of Clauses 164 to 166, wherein the first sole component includes a rearmost end located in a forefoot support region or a midfoot support region of the sole structure.

Clause 172. The sole structure of Clause 171, wherein a slit is defined completely through the first sole component forward of the rearmost end and extending for at least 50 mm from a lateral perimeter side edge of the first sole component toward but not completely to the forefoot medial sidewall.

Clause 173. The sole structure of Clause 172, wherein the first sole component further includes an upper-facing surface, wherein the sole structure further comprises: a midsole having a ground-facing surface engaged with the upper-facing surface of the first sole component.

Clause 174. The sole structure of Clause 173, wherein the ground-facing surface of the midsole includes a first flexion groove defined therein and vertically aligned with the slit.

Clause 175. The sole structure of Clause 171 or 172, further comprising: a third sole component located rearward and spaced from the first sole component by a first gap.

Clause 176. The sole structure of Clause 175, further comprising: a fourth sole component located rearward and spaced from the third sole component by a second gap.

Clause 177. The sole structure of Clause 176, wherein each of the first sole component, the third sole component, and the fourth sole component defines an upper-facing surface, wherein the sole structure further comprises:

a midsole having a ground-facing surface engaged with the upper-facing surface of each of the first sole component, the third sole component, and the fourth sole component.

Clause 178. The sole structure of Clause 177, wherein the ground-facing surface of the midsole includes: (a) a first flexion groove defined therein and vertically aligned with the slit, (b) a second flexion groove defined therein and vertically aligned with the first gap, and (c) a third flexion groove defined therein and vertically aligned with the second gap.

Clause 179. The sole structure of Clause 175, wherein each of the first sole component and the third sole component defines an upper-facing surface, wherein the sole structure further comprises:

a midsole having a ground-facing surface engaged with the upper-facing surface of each of the first sole component and the third sole component.

Clause 180. The sole structure of Clause 179, wherein the ground-facing surface of the midsole includes: (a) a first flexion groove defined therein and vertically aligned with the slit, and (b) a second flexion groove defined therein and vertically aligned with the first gap.

Clause 181. The sole structure of any one of Clauses 164 to 166, wherein the first sole component includes a rearmost end located in a forefoot support region or a midfoot support region of the sole structure, wherein a first slit is defined completely through the first sole component forward of the rearmost end and extending for at least 50 mm from a lateral perimeter side edge of the first sole component toward but not completely to the forefoot medial sidewall, and wherein a second slit is defined completely through the first sole component forward of the first slit and extending for at least 50 mm from the lateral perimeter side edge of the first sole component toward but not completely to the forefoot medial sidewall.

Clause 182. The sole structure of Clause 181, wherein the first sole component further includes an upper-facing surface, wherein the sole structure further comprises: a midsole having a ground-facing surface engaged with the upper-facing surface of the first sole component.

Clause 183. The sole structure of Clause 182, wherein the ground-facing surface of the midsole includes a first flexion groove defined therein and aligned with the first slit and a second flexion groove defined therein and aligned with the second slit.

Clause 184. The sole structure of Clause 181, further comprising: a third sole component located rearward and spaced from the first sole component by a first gap.

Clause 185. The sole structure of Clause 184, further comprising: a fourth sole component located rearward and spaced from the third sole component by a second gap.

Clause 186. The sole structure of Clause 185, wherein each of the first sole component, the third sole component, and the fourth sole component defines an upper-facing surface, wherein the sole structure further comprises:

a midsole having a ground-facing surface engaged with the upper-facing surface of each of the first sole component, the third sole component, and the fourth sole component.

Clause 187. The sole structure of Clause 186, wherein the ground-facing surface of the midsole includes: (a) a first flexion groove defined therein and aligned with the first slit, (b) a second flexion groove defined therein and aligned with the second slit, (c) a third flexion groove defined therein and aligned with the first gap, and (d) a fourth flexion groove defined therein and vertically aligned with the second gap.

Clause 188. The sole structure of any one of Clauses 164 to 187, wherein the first sole component and the second sole component are fixedly engaged together to form a unitary, one-piece construction.

Clause 189. The sole structure of Clause 188, wherein the first sole component and the second sole component are fixedly engaged together by an in-molded connection.

Clause 190. The sole structure of any one of Clauses 164 to 189, wherein a medial transition region connects the forefoot medial sidewall surface with the ground-facing surface of the sole structure, and wherein a first portion of the medial transition region has a first curvature that is greater than a 5.5 mm radius.

Clause 191. The sole structure of Clause 190, wherein a second portion of the medial transition region located forward of the first portion includes a second curvature, wherein the second curvature is greater than a 5 mm radius and less than the first curvature, and wherein the medial transition region smoothly changes curvature from the second curvature to the first curvature in a direction moving rearward in the sole structure.

Clause 192. The sole structure of Clause 190 or 191, further comprising:

a forward toe sidewall extending from the first forward toe location to a second forward toe location and from the forefoot medial sidewall to a forefoot lateral sidewall; and a forward toe transition region extending from the ground-facing surface to the forward toe sidewall, wherein curvature of the forward toe transition region increases moving in a direction from the forefoot lateral sidewall to the forefoot medial sidewall.

Clause 193. The sole structure of any one of Clauses 164 to 192, wherein the first sole component is made from a material having a hardness between 50 Shore A and 75 Shore A, and wherein the second sole component is made from a material having a hardness between 80 Shore A and 110 Shore A.

Clause 194. The sole structure of any one of Clauses 164 to 192, wherein the first sole component is made from a material having a hardness between 55 Shore A and 72 Shore A, and wherein the second sole component is made from a material having a hardness between 88 Shore A and 100 Shore A.

Clause 195. The sole structure of any one of Clauses 164 to 192, wherein the first sole component is made from a material having a hardness below 75 Shore A, and wherein the second sole component is made from a material having a hardness above 85 Shore A.

Clause 196. The sole structure of any one of Clauses 164 to 195, wherein the sole structure includes a lateral sidewall extending from a heel region to a midfoot region of the sole structure, wherein a first inwardly extending slit is defined in the lateral sidewall, wherein the first inwardly extending slit extends continuously from the heel region to the midfoot region.

Clause 197. The sole structure of Clause 196, wherein a second inwardly extending slit is defined in the lateral sidewall, wherein the first inwardly extending slit extends continuously from the heel region to the midfoot region and is spaced below the first inwardly extending slit.

Clause 198. The sole structure of Clause 197, wherein the second inwardly extending slit is formed as a space between surfaces of two distinct components of the sole structure.

Clause 199. The sole structure of Clause 196 or 197, wherein the lateral sidewall further extends in a forefoot region of the sole structure, wherein a third inwardly extending slit is defined in the lateral sidewall in the forefoot region.

Clause 200. The sole structure of any one of Clauses 164 to 195, wherein the sole structure includes a lateral sidewall extending at least within a forefoot region of the sole structure, wherein a first inwardly extending slit is defined in the lateral sidewall in the forefoot region.

Clause 201. The sole structure of any preceding Clause, wherein the sole structure includes any one or more of the properties and/or parameter values set forth in Table 1.

Clause 202. A sole structure for an article of footwear, comprising: one or more sole components having a plurality of flexure promoting structures having any one or more of the properties and/or parameter values set forth in Table 1:

TABLE 1

| Parameter | Value A | Value B | Value C |
|---|---|---|---|
| Rearmost Medial Sidewall Cutout 130C Location | Between 0.55 L and 0.75 L | Between 0.6 L and 0.7 L | Between 0.62 L and 0.68 L |
| Rear Intermediate Medial Sidewall Cutout 130C Location | Between 0.61 L and 0.81 L | Between 0.66 L and 0.76 L | Between 0.68 L and 0.74 L |
| Forward Intermediate Sidewall Cutout 130C Location | Between 0.67 L and 0.87 L | Between 0.71 L and 0.83 L | Between 0.73 L and 0.81 L |
| Forwardmost Medial Sidewall Cutout 130C Location | Between 0.73 L and 0.93 L | Between 0.78 L and 0.89 L | Between 0.8 L and 0.87 L |
| Rearmost Lateral Sidewall Cutout 144C Location | Between 0.55 L and 0.75 L | Between 0.6 L and 0.7 L | Between 0.62 L and 0.68 L |
| Rear Intermediate Lateral Sidewall Cutout 144C Location | Between 0.61 L and 0.81 L | Between 0.66 L and 0.76 L | Between 0.68 L and 0.74 L |
| Forward Intermediate Lateral Sidewall Cutout 144C Location | Between 0.67 L and 0.87 L | Between 0.71 L and 0.83 L | Between 0.73 L and 0.81 L |
| Forwardmost Lateral Sidewall Cutout 144C Location | Between 0.73 L and 0.93 L | Between 0.78 L and 0.89 L | Between 0.8 L and 0.87 L |
| Midsole Flexion Groove 142W Lateral Edge | Between 0.14 L and 0.34 L | Between 0.18 L and 0.3 L | Between 0.2 L and 0.28 L |
| Midsole Flexion Groove 142W Medial Edge | Between 0.22 L and 0.42 L | Between 0.26 L and 0.39 L | Between 0.29 L and 0.36 L |
| Midsole Flexion Groove 142X Lateral Edge | Between 0.26 L and 0.46 L | Between 0.3 L and 0.42 L | Between 0.32 L and 0.4 L |
| Midsole Flexion Groove 142X Medial Edge | Between 0.34 L and 0.54 L | Between 0.37 L and 0.51 L | Between 0.4 L and 0.47 L |
| Midsole Flexion Groove 142Y Lateral Edge | Between 0.4 L and 0.6 L | Between 0.43 L and 0.57 L | Between 0.46 L and 0.54 L |
| Midsole Flexion Groove 142Y Medial Edge | Between 0.53 L and 0.73 L | Between 0.57 L and 0.7 L | Between 0.59 L and 0.67 L |
| Midsole Flexion Groove 142Z Lateral Edge | Between 0.61 L and 0.82 L | Between 0.65 L and 0.78 L | Between 0.68 L and 0.75 L |
| Midsole Flexion Groove 142Z Medial Edge | Between 0.68 L and 0.9 L | Between 0.7 L and 0.86 L | Between 0.72 L and 0.83 L |
| Rear Outsole Component Part 128C Forward Lateral Edge | Between 0.14 L and 0.34 L | Between 0.18 L and 0.3 L | Between 0.2 L and 0.28 L |
| Rear Outsole Component Part 128C Forward Medial Edge | Between 0.22 L and 0.42 L | Between 0.26 L and 0.39 L | Between 0.29 L and 0.36 L |
| Middle Outsole Component Part 128B Forward Lateral Edge | Between 0.26 L and 0.46 L | Between 0.3 L and 0.42 L | Between 0.32 L and 0.4 L |
| Middle Outsole Component Part 128B Forward Medial Edge | Between 0.33 L and 0.53 L | Between 0.36 L and 0.5 L | Between 0.39 L and 0.46 L |
| Rear Outsole Slit 126B Lateral Edge | Between 0.4 L and 0.6 L | Between 0.43 L and 0.57 L | Between 0.46 L and 0.54 L |
| Rear Outsole Slit 126B Medial Edge or Closed End 126E | Between 0.53 L and 0.73 L | Between 0.57 L and 0.7 L | Between 0.59 L and 0.67 L |
| Forward Outsole Slit 126A Lateral Edge | Between 0.61 L and 0.82 L | Between 0.65 L and 0.78 L | Between 0.68 L and 0.75 L |
| Forward Outsole Slit 126A Medial Edge or Closed End 126E | Between 0.68 L and 0.9 L | Between 0.7 L and 0.86 L | Between 0.72 L and 0.83 L |
| Groove 142W and/or Gap 128G2 Angle from L Direction | Between 95 degrees and 125 degrees | Between 100 degrees and 122 degrees | Between 104 degrees and 118 degrees |
| Groove 142X and/or Gap 128G1 Angle from L | Between 95 degrees and 125 | Between 100 degrees and 122 | Between 104 degrees and 118 |

TABLE 1-continued

| Parameter | Value A | Value B | Value C |
|---|---|---|---|
| Direction | degrees | degrees | degrees |
| Groove 142Y and/or Slit 126B Angle from L Direction | Between 100 degrees and 130 degrees | Between 105 degrees and 127 degrees | Between 110 degrees and 120 degrees |
| Groove 142Z and/or Slit 126A Angle from L Direction | Between 94 degrees and 122 degrees | Between 96 degrees and 116 degrees | Between 98 degrees and 110 degrees |
| Rear Slit(s) 148R1 and/or 148R2 Rear Origin Point | Rearward of 0.2 L | Rearward of 0.15 L | Rearward of 0.1 L |
| Rear Slit(s) 148R1 and/or 148R2 Rear Origin Point | Between 0 L and 0.2 L | Between 0.01 L and 0.15 L | Between 0.02 L and 0.1 L |
| Rear Slit(s) 148R1 and/or 148R2 Forward Origin Point | Forward of 0.25 L | Forward of 0.3 L | Forward of 0.4 L |
| Rear Slit(s) 148R1 and/or 148R2 Forward Origin Point | Between 0.25 L and 0.65 L | Between 0.35 L and 0.62 L | Between 0.4 L and 0.6 L |
| Forefoot Slit(s) 148F1 and/or 148F2 Rear Origin Point | Between 0.5 L and 0.75 L | Between 0.52 L and 0.7 L | Between 0.54 L and 0.66 L |
| Forefoot Slit(s) 148F1 and/or 148F2 Forward Origin Point | Rearward of 0.98 L | Rearward of 0.95 L | Rearward of 0.92 L |
| Forefoot Slit(s) 148F1 and/or 148F2 Forward Origin Point | Between 0.72 L and 0.98 L | Between 0.76 L and 0.95 L | Between 0.82 L and 0.92 L |

Clause 203. The sole structure of any preceding Clause, wherein the sole structure includes any one or more of the properties and/or parameter values set forth in Table 3.

Clause 204. A sole structure for an article of footwear, comprising: one or more sole components having a plurality of flexure promoting structures having any one or more of the properties and/or parameter values set forth in Table 3:

TABLE 3

| Parameter | Parallel Plane Location | Transition Region Curvature |
|---|---|---|
| Medial Transition Region 130T | Forward of P = 0.7 L | >5 mm Radii |
| Medial Transition Region 130T | Forward of P = 0.7 L | >5.5 mm Radii |
| Medial Transition Region 130T | Forward of P = 0.7 L | >6 mm Radii |
| Medial Transition Region 130T | Forward of P = 0.7 L | >6.5 mm Radii |
| Medial Transition Region 130T | Forward of P = 0.72 L | >5 mm Radii |
| Medial Transition Region 130T | Forward of P = 0.72 L | >5.5 mm Radii |
| Medial Transition Region 130T | Forward of P = 0.72 L | >6 mm Radii |
| Medial Transition Region 130T | Forward of P = 0.72 L | >6.5 mm Radii |
| Medial Transition Region 130T | Forward of P = 0.75 L | >5 mm Radii |
| Medial Transition Region 130T | Forward of P = 0.75 L | >5.5 mm Radii |
| Medial Transition Region 130T | Forward of P = 0.75 L | >6 mm Radii |
| Medial Transition Region 130T | Forward of P = 0.75 L | >6.5 mm Radii |
| Medial Transition Region 130T | Between P = 0.7 L and P = 0.92 L | >5 mm Radii |
| Medial Transition Region 130T | Between P = 0.7 L and P = 0.92 L | >5.5 mm Radii |
| Medial Transition Region 130T | Between P = 0.7 L and P = 0.92 L | >6 mm Radii |
| Medial Transition Region 130T | Between P = 0.7 L and P = 0.92 L | >6.5 mm Radii |
| Medial Transition Region 130T | Between of P = 0.72 L and P = 0.9 L | >5 mm Radii |

TABLE 3-continued

| Parameter | Parallel Plane Location | Transition Region Curvature |
|---|---|---|
| Medial Transition Region 130T | Between of P = 0.72 L and P = 0.9 L | >5.5 mm Radii |
| Medial Transition Region 130T | Between of P = 0.72 L and P = 0.9 L | >6 mm Radii |
| Medial Transition Region 130T | Between of P = 0.72 L and P = 0.9 L | >6.5 mm Radii |
| Medial Transition Region 130T | Between of P = 0.75 L and P = 0.88 L | >5 mm Radii |
| Medial Transition Region 130T | Between of P = 0.75 L and P = 0.88 L | >5.5 mm Radii |
| Medial Transition Region 130T | Between of P = 0.75 L and P = 0.88 L | >6 mm Radii |
| Medial Transition Region 130T | Between of P = 0.75 L and P = 0.88 L | >6.5 mm Radii |
| Medial Transition Region 130T | Forward of P = 0.7 L | Between 5 mm and 12 mm Radii |
| Medial Transition Region 130T | Forward of P = 0.7 L | Between 5.5 mm and 11 mm Radii |
| Medial Transition Region 130T | Forward of P = 0.7 L | Between 6 mm and 10.5 mm Radii |
| Medial Transition Region 130T | Forward of P = 0.7 L | Between 6.5 mm and 10 mm Radii |
| Medial Transition Region 130T | Forward of P = 0.72 L | Between 5 mm and 12 mm Radii |
| Medial Transition Region 130T | Forward of P = 0.72 L | Between 5.5 mm and 11 mm Radii |
| Medial Transition Region 130T | Forward of P = 0.72 L | Between 6 mm and 10.5 mm Radii |
| Medial Transition Region 130T | Forward of P = 0.72 L | Between 6.5 mm and 10 mm Radii |
| Medial Transition Region 130T | Forward of P = 0.75 L | Between 5 mm and 12 mm Radii |
| Medial Transition Region 130T | Forward of P = 0.75 L | Between 5.5 mm and 11 mm Radii |
| Medial Transition Region 130T | Forward of P = 0.75 L | Between 6 mm and 10.5 mm Radii |
| Medial Transition Region 130T | Forward of P = 0.75 L | Between 6.5 mm and 10 mm Radii |
| Medial Transition Region 130T | Between P = 0.7 L and P = 0.92 L | Between 5 mm and 12 mm Radii |
| Medial Transition Region 130T | Between P = 0.7 L and P = 0.92 L | Between 5.5 mm and 11 mm Radii |
| Medial Transition Region 130T | Between P = 0.7 L and P = 0.92 L | Between 6 mm and 10.5 mm Radii |

TABLE 3-continued

| Parameter | Parallel Plane Location | Transition Region Curvature |
|---|---|---|
| Medial Transition Region 130T | Between P = 0.7 L and P = 0.92 L | Between 6.5 mm and 10 mm Radii |
| Medial Transition Region 130T | Between of P = 0.72 L and P = 0.9 L | Between 5 mm and 12 mm Radii |
| Medial Transition Region 130T | Between of P = 0.72 L and P = 0.9 L | Between 5.5 mm and 11 mm Radii |
| Medial Transition Region 130T | Between of P = 0.72 L and P = 0.9 L | Between 6 mm and 10.5 mm Radii |
| Medial Transition Region 130T | Between of P = 0.72 L and P = 0.9 L | Between 6.5 mm and 10 mm Radii |
| Medial Transition Region 130T | Between of P = 0.75 L and P = 0.88 L | Between 5 mm and 12 mm Radii |
| Medial Transition Region 130T | Between of P = 0.75 L and P = 0.88 L | Between 5.5 mm and 11 mm Radii |
| Medial Transition Region 130T | Between of P = 0.75 L and P = 0.88 L | Between 6 mm and 10.5 mm Radii |
| Medial Transition Region 130T | Between of P = 0.75 L and P = 0.88 L | Between 6.5 mm and 10 mm Radii |
| Lateral Transition Region 124T | Forward of P = 0.7 L | <5 mm Radii |
| Lateral Transition Region 124T | Forward of P = 0.7 L | <4.75 mm Radii |
| Lateral Transition Region 124T | Forward of P = 0.7 L | <4.5 mm Radii |
| Lateral Transition Region 124T | Forward of P = 0.7 L | <4.25 mm Radii |
| Lateral Transition Region 124T | Forward of P = 0.72 L | <5 mm Radii |
| Lateral Transition Region 124T | Forward of P = 0.72 L | <4.75 mm Radii |
| Lateral Transition Region 124T | Forward of P = 0.72 L | <4.5 mm Radii |
| Lateral Transition Region 124T | Forward of P = 0.72 L | <4.25 mm Radii |
| Lateral Transition Region 124T | Forward of P = 0.75 L | <5 mm Radii |
| Lateral Transition Region 124T | Forward of P = 0.75 L | <4.75 mm Radii |
| Lateral Transition Region 124T | Forward of P = 0.75 L | <4.5 mm Radii |
| Lateral Transition Region 124T | Forward of P = 0.75 L | <4.25 mm Radii |
| Lateral Transition Region 124T | Between P = 0.7 L and P = 0.92 L | <5 mm Radii |
| Lateral Transition Region 124T | Between P = 0.7 L and P = 0.92 L | <4.75 mm Radii |
| Lateral Transition Region 124T | Between P = 0.7 L and P = 0.92 L | <4.5 mm Radii |
| Lateral Transition Region 124T | Between P = 0.7 L and P = 0.92 L | <4.25 mm Radii |
| Lateral Transition Region 124T | Between of P = 0.72 L and P = 0.9 L | <5 mm Radii |
| Lateral Transition Region 124T | Between of P = 0.72 L and P = 0.9 L | <4.75 mm Radii |
| Lateral Transition Region 124T | Between of P = 0.72 L and P = 0.9 L | <4.5 mm Radii |
| Lateral Transition Region 124T | Between of P = 0.72 L and P = 0.9 L | <4.25 mm Radii |
| Lateral Transition Region 124T | Between of P = 0.75 L and P = 0.88 L | <5 mm Radii |
| Lateral Transition Region 124T | Between of P = 0.75 L and P = 0.88 L | <4.75 mm Radii |
| Lateral Transition Region 124T | Between of P = 0.75 L and P = 0.88 L | <4.5 mm Radii |
| Lateral Transition Region 124T | Between of P = 0.75 L and P = 0.88 L | <4.25 mm Radii |
| Lateral Transition Region 124T | Forward of P = 0.7 L | Between a Corner and 5 mm Radii |
| Lateral Transition Region 124T | Forward of P = 0.7 L | Between a Corner and 4.75 mm Radii |
| Lateral Transition Region 124T | Forward of P = 0.7 L | Between a Corner and 4.5 mm Radii |
| Lateral Transition Region 124T | Forward of P = 0.7 L | Between a Corner and 4.25 mm Radii |
| Lateral Transition Region 124T | Forward of P = 0.72 L | Between a Corner and 5 mm Radii |
| Lateral Transition Region 124T | Forward of P = 0.72 L | Between a Corner and 4.75 mm Radii |
| Lateral Transition Region 124T | Forward of P = 0.72 L | Between a Corner and 4.5 mm Radii |
| Lateral Transition Region 124T | Forward of P = 0.72 L | Between a Corner and 4.25 mm Radii |
| Lateral Transition Region 124T | Forward of P = 0.75 L | Between a Corner and 5 mm Radii |
| Lateral Transition Region 124T | Forward of P = 0.72 L | Between a Corner and 4.75 mm Radii |
| Lateral Transition Region 124T | Forward of P = 0.72 L | Between a Corner and 4.5 mm Radii |
| Lateral Transition Region 124T | Forward of P = 0.72 L | Between a Corner and 4.25 mm Radii |
| Lateral Transition Region 124T | Forward of P = 0.75 L | Between a Corner and 5 mm Radii |
| Lateral Transition Region 124T | Forward of P = 0.75 L | Between a Corner and 4.75 mm Radii |
| Lateral Transition Region 124T | Forward of P = 0.75 L | Between a Corner and 4.5 mm Radii |
| Lateral Transition Region 124T | Forward of P = 0.75 L | Between a Corner and 4.25 mm Radii |
| Lateral Transition Region 124T | Between P = 0.7 L and P = 0.92 L | Between a Corner and 5 mm Radii |
| Lateral Transition Region 124T | Between P = 0.7 L and P = 0.92 L | Between a Corner and 4.75 mm Radii |
| Lateral Transition Region 124T | Between P = 0.7 L and P = 0.92 L | Between a Corner and 4.5 mm Radii |
| Lateral Transition Region 124T | Between P = 0.7 L and P = 0.92 L | Between a Corner and 4.25 mm Radii |
| Lateral Transition Region 124T | Between of P = 0.72 L and P = 0.9 L | Between a Corner and 5 mm Radii |
| Lateral Transition Region 124T | Between of P = 0.72 L and P = 0.9 L | Between a Corner and 4.75 mm Radii |
| Lateral Transition Region 124T | Between of P = 0.72 L and P = 0.9 L | Between a Corner and 4.5 mm Radii |
| Lateral Transition Region 124T | Between of P = 0.72 L and P = 0.9 L | Between a Corner and 4.25 mm Radii |
| Lateral Transition Region 124T | Between of P = 0.75 L and P = 0.88 L | Between a Corner and 5 mm Radii |
| Lateral Transition Region 124T | Between of P = 0.75 L and P = 0.88 L | Between a Corner and 4.75 mm Radii |
| Lateral Transition Region 124T | Between of P = 0.75 L and P = 0.88 L | Between a Corner and 4.5 mm Radii |
| Lateral Transition Region 124T | Between of P = 0.75 L and P = 0.88 L | Between a Corner and 4.25 mm Radii |

Clause 205. An article of footwear, comprising:

an upper; and a sole structure according to any preceding Clause engaged with the upper.

What is claimed is:

1. A sole structure for an article of footwear, comprising:

an outsole component including: (a) a first material having a first hardness, wherein the first material forms a majority of a ground-contacting surface of the outsole component; and (b) a second material having a second hardness, wherein the second hardness is at least 15 Shore A hardness points higher than the first hardness, and wherein the second material extends from the first material and forms a portion of the ground-contacting surface of the outsole component; and a first slit defined completely through the outsole component and extending from an outermost lateral perimeter side edge of the outsole component to a first closed end located less than 25 mm from a medial sidewall of the sole structure.

2. The sole structure according to claim 1, further comprising a second slit defined completely through the outsole component and extending from the outermost lateral perimeter side edge of the outsole component to a second closed end located less than 25 mm from the medial sidewall of the sole structure.

3. The sole structure according to claim 2, further comprising a midsole component located opposite the ground-contacting surface of the outsole component, wherein the midsole component is exposed through the first slit and the second slit.

4. The sole structure according to claim 3, wherein the midsole component includes a first flex groove aligned with the first slit and a second flex groove aligned with the second slit.

5. The sole structure according to claim 1, further comprising a midsole component located opposite the ground-contacting surface of the outsole component, wherein the midsole component is exposed through the first slit.

6. The sole structure according to claim 5, wherein the midsole component includes a first flex groove aligned with the first slit.

7. The sole structure according to claim 5, wherein the outsole component forms a portion of the medial sidewall of the sole structure and includes an outsole sidewall extending from the ground-contacting surface, the outsole sidewall extending continuously from: (i) a forefoot lateral side location of the sole structure to (ii) a forefoot or midfoot medial side location of the sole structure around a forward toe region of the sole structure, wherein the outsole sidewall includes a medial sidewall top edge, and wherein the medial sidewall top edge includes a plurality of medial recesses extending toward the ground-contacting surface, and wherein the midsole component includes a lateral sidewall of the sole structure rearward of a lateral side end of the outsole sidewall located at the forefoot lateral side location of the sole structure, wherein the lateral sidewall includes a lateral sidewall top edge, and wherein the lateral sidewall top edge includes a plurality of lateral recesses extending toward the ground-contacting surface.

8. The sole structure according to claim 1, wherein the second material extends upward from the ground-contacting surface and forms at least a first portion of an exterior surface of a sidewall of the sole structure.

9. The sole structure according to claim 1, wherein the outsole component forms a portion of the medial sidewall of the sole structure and includes an outsole sidewall extending from the ground-contacting surface, the outsole sidewall extending continuously from: (i) a forefoot lateral side location of the sole structure to (ii) a forefoot or midfoot medial side location of the sole structure around a forward toe region of the sole structure, wherein the outsole sidewall includes a medial sidewall top edge, and wherein the medial sidewall top edge includes a plurality of medial recesses extending toward the ground-contacting surface.

10. The sole structure according to claim 1, wherein the outsole component includes a first traction element pattern provided on the ground-contacting surface, the first traction element pattern including: (i) a first plurality of traction elements arranged in a first ring around a first center, (ii) a second plurality of traction elements arranged in a second ring around and adjacent the first ring, and (iii) a third plurality of traction elements arranged in a third ring around and adjacent the second ring.

11. A sole structure for an article of footwear, comprising:

an outsole component including: (a) a first material having a first hardness, wherein the first material forms a majority of a ground-contacting surface of the outsole component; and (b) a second material having a second hardness, wherein the second hardness is at least 15 Shore A hardness points higher than the first hardness, and wherein the second material extends from the first material and forms a portion of the ground-contacting surface of the outsole component; and a first traction element pattern provided on the ground-contacting surface of the outsole component, the first traction element pattern including: (i) a first plurality of traction elements arranged in a first ring around a first center, (ii) a second plurality of traction elements arranged in a second ring around and adjacent the first ring, and (iii) a third plurality of traction elements arranged in a third ring around and adjacent the second ring;

a midsole component located opposite the ground-contacting surface of the outsole component;

wherein the outsole component includes an outsole sidewall extending from the ground-contacting surface, the outsole sidewall extending continuously from: (i) a forefoot lateral side location of the sole structure to (ii) a forefoot or midfoot medial side location of the sole structure around a forward toe region of the sole structure, wherein the outsole sidewall includes a medial sidewall top edge, and wherein the medial sidewall top edge includes a plurality of medial recesses extending toward the ground-contacting surface, and wherein the midsole component includes a lateral sidewall of the sole structure rearward of a lateral side end of the outsole sidewall located at the forefoot lateral side location of the sole structure, wherein the lateral sidewall includes a lateral sidewall top edge, and wherein the lateral sidewall top edge includes a plurality of lateral recesses extending toward the ground-contacting surface.

12. A sole structure for an article of footwear, comprising:

an outsole component including: (a) a first material having a first hardness, wherein the first material forms a majority of a ground-contacting surface of the outsole component; and (b) a second material having a second hardness, wherein the second hardness is at least 15 Shore A hardness points higher than the first hardness, and wherein the second material extends from the first material and forms a portion of the ground-contacting surface of the outsole component; and a first traction element pattern provided on the ground-contacting surface of the outsole component, the first traction element pattern including: (i) a first plurality of traction elements arranged in a first ring around a first center, (ii) a second plurality of traction elements arranged in a second ring around and adjacent the first ring, and (iii) a third plurality of traction elements arranged in a third ring around and adjacent the second ring;

wherein the outsole component further includes a first slit defined completely through the outsole component and extending from an outermost lateral perimeter side edge of the outsole component to a first closed end located less than 25 mm from a medial sidewall of the sole structure.

* * * * *